US006995311B2

(12) United States Patent
Stevenson

(10) Patent No.: US 6,995,311 B2
(45) Date of Patent: Feb. 7, 2006

(54) AUTOMATIC PITCH PROCESSING FOR ELECTRIC STRINGED INSTRUMENTS

(76) Inventor: Alexander J. Stevenson, 11 Ledegewood Dr., Dover, MA (US) 02030

( * ) Notice: Subject to any disclaimer, the term of this patent is extended or adjusted under 35 U.S.C. 154(b) by 187 days.

(21) Appl. No.: 10/403,927

(22) Filed: Mar. 31, 2003

(65) Prior Publication Data

US 2004/0187673 A1 Sep. 30, 2004

(51) Int. Cl.
*G10H 1/02* (2006.01)

(52) U.S. Cl. ..... 84/737; 84/654

(58) Field of Classification Search ..... 84/616, 84/654, 737

See application file for complete search history.

(56) References Cited

U.S. PATENT DOCUMENTS

| | | | | |
|---|---|---|---|---|
| 4,044,239 | A | 8/1977 | Shimauchi | |
| 4,088,052 | A | 5/1978 | Hedrick | |
| 4,171,661 | A | 10/1979 | Rose | |
| 4,375,180 | A | 3/1983 | Scholz | |
| 4,803,908 | A | 2/1989 | Skinn | |
| 4,909,126 | A | 3/1990 | Skinn | |
| 5,009,142 | A | 4/1991 | Kurtz | |
| 5,038,657 | A | 8/1991 | Busley | |
| 5,095,797 | A | 3/1992 | Zacaroli | |
| 5,343,793 | A | 9/1994 | Pattie | |
| 5,528,970 | A | 6/1996 | Zacaroli | |
| 5,760,321 | A | 6/1998 | Seabert | |
| 5,767,429 | A | 6/1998 | Milano | |
| 5,808,218 | A | 9/1998 | Grace | |
| 5,824,929 | A | 10/1998 | Freeland | |
| 5,886,270 | A | 3/1999 | Wynn | |
| 5,973,252 | A | 10/1999 | Hildebrand | |
| 6,184,452 | B1 | 2/2001 | Long | |
| 6,359,202 | B1 | 3/2002 | Feiten | |
| 6,372,973 | B1 * | 4/2002 | Schneider | 84/609 |
| 6,415,584 | B1 | 7/2002 | Whittall | |
| 6,437,226 | B2 | 8/2002 | Oudshoorn | |
| 6,653,546 | B2 * | 11/2003 | Jameson | 84/735 |

FOREIGN PATENT DOCUMENTS

| | | |
|---|---|---|
| JP | 2745215 | 1/1997 |
| JP | 2000-220106 | 7/2000 |

OTHER PUBLICATIONS

Roland Corporation Roland V-Guitar System Owner's Manual, p. 17.

* cited by examiner

*Primary Examiner*—Jeffrey W Donels

(57) ABSTRACT

An invention using a data processing system, herein called the Pitch Processing System, comprising a Pitch Processing Module, a User Control Module, a transducer, software, and signal processing techniques integrated into an electric stringed musical instrument. The system automatically and dynamically provides pitch alteration of the instrument without requiring human or electromechanical intervention to physically change string tension. The system corrects unintentional pitch drift and intonation errors, and provides intentional pitch altering techniques for temperament changes, altered tuning styles, and pitch bending. The result is a pitch altered signal output from the instrument. Embodiments herein include a variety of input/output signal configurations for both analog and digital interfaces to support maximum flexibility of the Pitch Processing System.

16 Claims, 17 Drawing Sheets

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | 0.00000 |
| F3 | 1 | 87.31 | 0.00000 | 0.00000 | 0.00000 |
| F3#/G3b | 2 | 92.50 | 0.00000 | 0.00000 | 0.00000 |
| G3 | 3 | 98.00 | 0.00000 | 0.00000 | 0.00000 |
| G3#/A4b | 4 | 103.83 | 0.00000 | 0.00000 | 0.00000 |
| A4 | 5 | 110.00 | 0.00000 | 0.00000 | 0.00000 |
| A4#/B4b | 6 | 116.54 | 0.00000 | 0.00000 | 0.00000 |
| B4 | 7 | 123.47 | 0.00000 | 0.00000 | 0.00000 |
| C4 | 8 | 130.81 | 0.00000 | 0.00000 | 0.00000 |
| C4#/D4b | 9 | 138.59 | 0.00000 | 0.00000 | 0.00000 |
| D4 | 10 | 146.83 | 0.00000 | 0.00000 | 0.00000 |
| D4#/E4b | 11 | 155.56 | 0.00000 | 0.00000 | 0.00000 |
| E4 | 12 | 164.81 | 0.00000 | 0.00000 | 0.00000 |
| F4 | 13 | 174.61 | 0.00000 | 0.00000 | 0.00000 |
| F4#/G4b | 14 | 185.00 | 0.00000 | 0.00000 | 0.00000 |
| G4 | 15 | 196.00 | 0.00000 | 0.00000 | 0.00000 |
| G4#/A4b | 16 | 207.65 | 0.00000 | 0.00000 | 0.00000 |
| A5 | 17 | 220.00 | 0.00000 | 0.00000 | 0.00000 |
| A5#/B5b | 18 | 233.08 | 0.00000 | 0.00000 | 0.00000 |
| B5 | 19 | 246.94 | 0.00000 | 0.00000 | 0.00000 |
| C5 | 20 | 261.63 | 0.00000 | 0.00000 | 0.00000 |
| C5#/D5b | 21 | 277.18 | 0.00000 | 0.00000 | 0.00000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | 0.00000 |
| A4#/B4b | 1 | 116.54 | 0.00000 | 0.00000 | 0.00000 |
| B4 | 2 | 123.47 | 0.00000 | 0.00000 | 0.00000 |
| C4 | 3 | 130.81 | 0.00000 | 0.00000 | 0.00000 |
| C4#/D4b | 4 | 138.59 | 0.00000 | 0.00000 | 0.00000 |
| D4 | 5 | 146.83 | 0.00000 | 0.00000 | 0.00000 |
| D4#/E4b | 6 | 155.56 | 0.00000 | 0.00000 | 0.00000 |
| E4 | 7 | 164.81 | 0.00000 | 0.00000 | 0.00000 |
| F4 | 8 | 174.61 | 0.00000 | 0.00000 | 0.00000 |
| F4#/G4b | 9 | 185.00 | 0.00000 | 0.00000 | 0.00000 |
| G4 | 10 | 196.00 | 0.00000 | 0.00000 | 0.00000 |
| G4#/A4b | 11 | 207.65 | 0.00000 | 0.00000 | 0.00000 |
| A5 | 12 | 220.00 | 0.00000 | 0.00000 | 0.00000 |
| A5#/B5b | 13 | 233.08 | 0.00000 | 0.00000 | 0.00000 |
| B5 | 14 | 246.94 | 0.00000 | 0.00000 | 0.00000 |
| C5 | 15 | 261.63 | 0.00000 | 0.00000 | 0.00000 |
| C5#/D5b | 16 | 277.18 | 0.00000 | 0.00000 | 0.00000 |
| D5 | 17 | 293.66 | 0.00000 | 0.00000 | 0.00000 |
| D5#/E5b | 18 | 311.13 | 0.00000 | 0.00000 | 0.00000 |
| E5 | 19 | 329.63 | 0.00000 | 0.00000 | 0.00000 |
| F5 | 20 | 349.23 | 0.00000 | 0.00000 | 0.00000 |
| F5#/G5b | 21 | 369.99 | 0.00000 | 0.00000 | 0.00000 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | 0.00000 | 0.00000 |
| D4#/E4b | 1 | 155.56 | 0.00000 | 0.00000 | 0.00000 |
| E4 | 2 | 164.81 | 0.00000 | 0.00000 | 0.00000 |
| F4 | 3 | 174.61 | 0.00000 | 0.00000 | 0.00000 |
| F4#/G4b | 4 | 185.00 | 0.00000 | 0.00000 | 0.00000 |
| G4 | 5 | 196.00 | 0.00000 | 0.00000 | 0.00000 |
| G4#/A4b | 6 | 207.65 | 0.00000 | 0.00000 | 0.00000 |
| A5 | 7 | 220.00 | 0.00000 | 0.00000 | 0.00000 |
| A5#/B5b | 8 | 233.08 | 0.00000 | 0.00000 | 0.00000 |
| B5 | 9 | 246.94 | 0.00000 | 0.00000 | 0.00000 |
| C5 | 10 | 261.63 | 0.00000 | 0.00000 | 0.00000 |
| C5#/D5b | 11 | 277.18 | 0.00000 | 0.00000 | 0.00000 |
| D5 | 12 | 293.66 | 0.00000 | 0.00000 | 0.00000 |
| D5#/E5b | 13 | 311.13 | 0.00000 | 0.00000 | 0.00000 |
| E5 | 14 | 329.63 | 0.00000 | 0.00000 | 0.00000 |
| F5 | 15 | 349.23 | 0.00000 | 0.00000 | 0.00000 |
| F5#/G5b | 16 | 369.99 | 0.00000 | 0.00000 | 0.00000 |
| G5 | 17 | 392.00 | 0.00000 | 0.00000 | 0.00000 |
| G5#/A5b | 18 | 415.30 | 0.00000 | 0.00000 | 0.00000 |
| A6 | 19 | 440.00 | 0.00000 | 0.00000 | 0.00000 |
| A6#/B6b | 20 | 466.16 | 0.00000 | 0.00000 | 0.00000 |
| B6 | 21 | 493.88 | 0.00000 | 0.00000 | 0.00000 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | 0.00000 |
| G4#/A4b | 1 | 207.65 | 0.00000 | 0.00000 | 0.00000 |
| A5 | 2 | 220.00 | 0.00000 | 0.00000 | 0.00000 |
| A5#/B5b | 3 | 233.08 | 0.00000 | 0.00000 | 0.00000 |
| B5 | 4 | 246.94 | 0.00000 | 0.00000 | 0.00000 |
| C5 | 5 | 261.63 | 0.00000 | 0.00000 | 0.00000 |
| C5#/D5b | 6 | 277.18 | 0.00000 | 0.00000 | 0.00000 |
| D5 | 7 | 293.66 | 0.00000 | 0.00000 | 0.00000 |
| D5#/E5b | 8 | 311.13 | 0.00000 | 0.00000 | 0.00000 |
| E5 | 9 | 329.63 | 0.00000 | 0.00000 | 0.00000 |
| F5 | 10 | 349.23 | 0.00000 | 0.00000 | 0.00000 |
| F5#/G5b | 11 | 369.99 | 0.00000 | 0.00000 | 0.00000 |
| G5 | 12 | 392.00 | 0.00000 | 0.00000 | 0.00000 |
| G5#/A5b | 13 | 415.30 | 0.00000 | 0.00000 | 0.00000 |
| A6 | 14 | 440.00 | 0.00000 | 0.00000 | 0.00000 |
| A6#/B6b | 15 | 466.16 | 0.00000 | 0.00000 | 0.00000 |
| B6 | 16 | 493.88 | 0.00000 | 0.00000 | 0.00000 |
| C6 | 17 | 523.25 | 0.00000 | 0.00000 | 0.00000 |
| C6#/D6b | 18 | 554.37 | 0.00000 | 0.00000 | 0.00000 |
| D6 | 19 | 587.33 | 0.00000 | 0.00000 | 0.00000 |
| D6#/E6b | 20 | 622.25 | 0.00000 | 0.00000 | 0.00000 |
| E6 | 21 | 659.26 | 0.00000 | 0.00000 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | 0.00000 |
| C5 | 1 | 261.63 | 0.00000 | 0.00000 | 0.00000 |
| C5#/D5b | 2 | 277.18 | 0.00000 | 0.00000 | 0.00000 |
| D5 | 3 | 293.66 | 0.00000 | 0.00000 | 0.00000 |
| D5#/E5b | 4 | 311.13 | 0.00000 | 0.00000 | 0.00000 |
| E5 | 5 | 329.63 | 0.00000 | 0.00000 | 0.00000 |
| F5 | 6 | 349.23 | 0.00000 | 0.00000 | 0.00000 |
| F5#/G5b | 7 | 369.99 | 0.00000 | 0.00000 | 0.00000 |
| G5 | 8 | 392.00 | 0.00000 | 0.00000 | 0.00000 |
| G5#/A5b | 9 | 415.30 | 0.00000 | 0.00000 | 0.00000 |
| A6 | 10 | 440.00 | 0.00000 | 0.00000 | 0.00000 |
| A6#/B6b | 11 | 466.16 | 0.00000 | 0.00000 | 0.00000 |
| B6 | 12 | 493.88 | 0.00000 | 0.00000 | 0.00000 |
| C6 | 13 | 523.25 | 0.00000 | 0.00000 | 0.00000 |
| C6#/D6b | 14 | 554.37 | 0.00000 | 0.00000 | 0.00000 |
| D6 | 15 | 587.33 | 0.00000 | 0.00000 | 0.00000 |
| D6#/E6b | 16 | 622.25 | 0.00000 | 0.00000 | 0.00000 |
| E6 | 17 | 659.26 | 0.00000 | 0.00000 | 0.00000 |
| F6 | 18 | 698.46 | 0.00000 | 0.00000 | 0.00000 |
| F6#/G6b | 19 | 739.99 | 0.00000 | 0.00000 | 0.00000 |
| G7 | 20 | 783.99 | 0.00000 | 0.00000 | 0.00000 |
| G7#/A7b | 21 | 830.61 | 0.00000 | 0.00000 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | 0.00000 |
| F5 | 1 | 349.23 | 0.00000 | 0.00000 | 0.00000 |
| F5#/G5b | 2 | 369.99 | 0.00000 | 0.00000 | 0.00000 |
| G5 | 3 | 392.00 | 0.00000 | 0.00000 | 0.00000 |
| G5#/A5b | 4 | 415.30 | 0.00000 | 0.00000 | 0.00000 |
| A6 | 5 | 440.00 | 0.00000 | 0.00000 | 0.00000 |
| A6#/B6b | 6 | 466.16 | 0.00000 | 0.00000 | 0.00000 |
| B6 | 7 | 493.88 | 0.00000 | 0.00000 | 0.00000 |
| C6 | 8 | 523.25 | 0.00000 | 0.00000 | 0.00000 |
| C6#/D6b | 9 | 554.37 | 0.00000 | 0.00000 | 0.00000 |
| D6 | 10 | 587.33 | 0.00000 | 0.00000 | 0.00000 |
| D6#/E6b | 11 | 622.25 | 0.00000 | 0.00000 | 0.00000 |
| E6 | 12 | 659.26 | 0.00000 | 0.00000 | 0.00000 |
| F6 | 13 | 698.46 | 0.00000 | 0.00000 | 0.00000 |
| F6#/G6b | 14 | 739.99 | 0.00000 | 0.00000 | 0.00000 |
| G7 | 15 | 783.99 | 0.00000 | 0.00000 | 0.00000 |
| G7#/A7b | 16 | 830.61 | 0.00000 | 0.00000 | 0.00000 |
| A7 | 17 | 880.00 | 0.00000 | 0.00000 | 0.00000 |
| A7#/B7b | 18 | 932.33 | 0.00000 | 0.00000 | 0.00000 |
| B7 | 19 | 987.77 | 0.00000 | 0.00000 | 0.00000 |
| C7 | 20 | 1046.50 | 0.00000 | 0.00000 | 0.00000 |
| C7#/D7b | 21 | 1108.73 | 0.00000 | 0.00000 | 0.00000 |

FIG.9

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 77.78 | 0.02000 | 0.00000 | 0.00000 |
| F3 | 1 | 82.41 | 0.00000 | 0.00000 | 0.00000 |
| F3#/G3b | 2 | 87.31 | 0.00000 | 0.00000 | 0.00000 |
| G3 | 3 | 92.50 | 0.00000 | 0.00000 | 0.00000 |
| G3#/A4b | 4 | 98.00 | 0.00000 | 0.00000 | 0.00000 |
| A4 | 5 | 103.83 | 0.00000 | 0.00000 | 0.00000 |
| A4#/B4b | 6 | 110.00 | 0.00000 | 0.00000 | 0.00000 |
| B4 | 7 | 116.54 | 0.00000 | 0.00000 | 0.00000 |
| C4 | 8 | 123.47 | 0.00000 | 0.00000 | 0.00000 |
| C4#/D4b | 9 | 130.81 | 0.00000 | 0.00000 | 0.00000 |
| D4 | 10 | 138.59 | 0.00000 | 0.00000 | 0.00000 |
| D4#/E4b | 11 | 146.83 | 0.00000 | 0.00000 | 0.00000 |
| E4 | 12 | 155.56 | 0.00000 | 0.00000 | 0.00000 |
| F4 | 13 | 164.81 | 0.00000 | 0.00000 | 0.00000 |
| F4#/G4b | 14 | 174.61 | 0.00000 | 0.00000 | 0.00000 |
| G4 | 15 | 185.00 | 0.00000 | 0.00000 | 0.00000 |
| G4#/A4b | 16 | 196.00 | 0.00000 | 0.00000 | 0.00000 |
| A5 | 17 | 207.65 | 0.00000 | 0.00000 | 0.00000 |
| A5#/B5b | 18 | 220.00 | 0.00000 | 0.00000 | 0.00000 |
| B5 | 19 | 233.08 | 0.00000 | 0.00000 | 0.00000 |
| C5 | 20 | 246.94 | 0.00000 | 0.00000 | 0.00000 |
| C5#/D5b | 21 | 261.63 | 0.00000 | 0.00000 | 0.00000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 103.83 | 0.02400 | 0.00000 | 0.00000 |
| A4#/B4b | 1 | 110.00 | 0.00000 | 0.00000 | 0.00000 |
| B4 | 2 | 116.54 | 0.00000 | 0.00000 | 0.00000 |
| C4 | 3 | 123.47 | 0.00000 | 0.00000 | 0.00000 |
| C4#/D4b | 4 | 130.81 | 0.00000 | 0.00000 | 0.00000 |
| D4 | 5 | 138.59 | 0.00000 | 0.00000 | 0.00000 |
| D4#/E4b | 6 | 146.83 | 0.00000 | 0.00000 | 0.00000 |
| E4 | 7 | 155.56 | 0.00000 | 0.00000 | 0.00000 |
| F4 | 8 | 164.81 | 0.00000 | 0.00000 | 0.00000 |
| F4#/G4b | 9 | 174.61 | 0.00000 | 0.00000 | 0.00000 |
| G4 | 10 | 185.00 | 0.00000 | 0.00000 | 0.00000 |
| G4#/A4b | 11 | 196.00 | 0.00000 | 0.00000 | 0.00000 |
| A5 | 12 | 207.65 | 0.00000 | 0.00000 | 0.00000 |
| A5#/B5b | 13 | 220.00 | 0.00000 | 0.00000 | 0.00000 |
| B5 | 14 | 233.08 | 0.00000 | 0.00000 | 0.00000 |
| C5 | 15 | 246.94 | 0.00000 | 0.00000 | 0.00000 |
| C5#/D5b | 16 | 261.63 | 0.00000 | 0.00000 | 0.00000 |
| D5 | 17 | 277.18 | 0.00000 | 0.00000 | 0.00000 |
| D5#/E5b | 18 | 293.66 | 0.00000 | 0.00000 | 0.00000 |
| E5 | 19 | 311.13 | 0.00000 | 0.00000 | 0.00000 |
| F5 | 20 | 329.63 | 0.00000 | 0.00000 | 0.00000 |
| F5#/G5b | 21 | 349.23 | 0.00000 | 0.00000 | 0.00000 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 138.59 | -0.01000 | 0.00000 | 0.00000 |
| D4#/E4b | 1 | 146.83 | 0.00000 | 0.00000 | 0.00000 |
| E4 | 2 | 155.56 | 0.00000 | 0.00000 | 0.00000 |
| F4 | 3 | 164.81 | 0.00000 | 0.00000 | 0.00000 |
| F4#/G4b | 4 | 174.61 | 0.00000 | 0.00000 | 0.00000 |
| G4 | 5 | 185.00 | 0.00000 | 0.00000 | 0.00000 |
| G4#/A4b | 6 | 196.00 | 0.00000 | 0.00000 | 0.00000 |
| A5 | 7 | 207.65 | 0.00000 | 0.00000 | 0.00000 |
| A5#/B5b | 8 | 220.00 | 0.00000 | 0.00000 | 0.00000 |
| B5 | 9 | 233.08 | 0.00000 | 0.00000 | 0.00000 |
| C5 | 10 | 246.94 | 0.00000 | 0.00000 | 0.00000 |
| C5#/D5b | 11 | 261.63 | 0.00000 | 0.00000 | 0.00000 |
| D5 | 12 | 277.18 | 0.00000 | 0.00000 | 0.00000 |
| D5#/E5b | 13 | 293.66 | 0.00000 | 0.00000 | 0.00000 |
| E5 | 14 | 311.13 | 0.00000 | 0.00000 | 0.00000 |
| F5 | 15 | 329.63 | 0.00000 | 0.00000 | 0.00000 |
| F5#/G5b | 16 | 349.23 | 0.00000 | 0.00000 | 0.00000 |
| G5 | 17 | 369.99 | 0.00000 | 0.00000 | 0.00000 |
| G5#/A5b | 18 | 392.00 | 0.00000 | 0.00000 | 0.00000 |
| A6 | 19 | 415.30 | 0.00000 | 0.00000 | 0.00000 |
| A6#/B6b | 20 | 440.00 | 0.00000 | 0.00000 | 0.00000 |
| B6 | 21 | 466.16 | 0.00000 | 0.00000 | 0.00000 |

| G(3) string | TBL[2] | $F_R$ | $F_C$ | $F_{MOD}$ | $F_{SHIFT}$ |
|---|---|---|---|---|---|
| Note Name | Fret Position* | 0 | 1 | 2 | 3 |
| G4 | 0 | 185.00 | 0.00340 | 0.00000 | 0.00000 |
| G4#/A4b | 1 | 196.00 | 0.00000 | 0.00000 | 0.00000 |
| A5 | 2 | 207.65 | 0.00000 | 0.00000 | 0.00000 |
| A5#/B5b | 3 | 220.00 | 0.00000 | 0.00000 | 0.00000 |
| B5 | 4 | 233.08 | 0.00000 | 0.00000 | 0.00000 |
| C5 | 5 | 246.94 | 0.00000 | 0.00000 | 0.00000 |
| C5#/D5b | 6 | 261.63 | 0.00000 | 0.00000 | 0.00000 |
| D5 | 7 | 277.18 | 0.00000 | 0.00000 | 0.00000 |
| D5#/E5b | 8 | 293.66 | 0.00000 | 0.00000 | 0.00000 |
| E5 | 9 | 311.13 | 0.00000 | 0.00000 | 0.00000 |
| F5 | 10 | 329.63 | 0.00000 | 0.00000 | 0.00000 |
| F5#/G5b | 11 | 349.23 | 0.00000 | 0.00000 | 0.00000 |
| G5 | 12 | 369.99 | 0.00000 | 0.00000 | 0.00000 |
| G5#/A5b | 13 | 392.00 | 0.00000 | 0.00000 | 0.00000 |
| A6 | 14 | 415.30 | 0.00000 | 0.00000 | 0.00000 |
| A6#/B6b | 15 | 440.00 | 0.00000 | 0.00000 | 0.00000 |
| B6 | 16 | 466.16 | 0.00000 | 0.00000 | 0.00000 |
| C6 | 17 | 493.88 | 0.00000 | 0.00000 | 0.00000 |
| C6#/D6b | 18 | 523.25 | 0.00000 | 0.00000 | 0.00000 |
| D6 | 19 | 554.37 | 0.00000 | 0.00000 | 0.00000 |
| D6#/E6b | 20 | 587.33 | 0.00000 | 0.00000 | 0.00000 |
| E6 | 21 | 622.25 | 0.00000 | 0.00000 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 233.08 | 0.00760 | 0.00000 | 0.00000 |
| C5 | 1 | 246.94 | 0.00000 | 0.00000 | 0.00000 |
| C5#/D5b | 2 | 261.63 | 0.00000 | 0.00000 | 0.00000 |
| D5 | 3 | 277.18 | 0.00000 | 0.00000 | 0.00000 |
| D5#/E5b | 4 | 293.66 | 0.00000 | 0.00000 | 0.00000 |
| E5 | 5 | 311.13 | 0.00000 | 0.00000 | 0.00000 |
| F5 | 6 | 329.63 | 0.00000 | 0.00000 | 0.00000 |
| F5#/G5b | 7 | 349.23 | 0.00000 | 0.00000 | 0.00000 |
| G5 | 8 | 369.99 | 0.00000 | 0.00000 | 0.00000 |
| G5#/A5b | 9 | 392.00 | 0.00000 | 0.00000 | 0.00000 |
| A6 | 10 | 415.30 | 0.00000 | 0.00000 | 0.00000 |
| A6#/B6b | 11 | 440.00 | 0.00000 | 0.00000 | 0.00000 |
| B6 | 12 | 466.16 | 0.00000 | 0.00000 | 0.00000 |
| C6 | 13 | 493.88 | 0.00000 | 0.00000 | 0.00000 |
| C6#/D6b | 14 | 523.25 | 0.00000 | 0.00000 | 0.00000 |
| D6 | 15 | 554.37 | 0.00000 | 0.00000 | 0.00000 |
| D6#/E6b | 16 | 587.33 | 0.00000 | 0.00000 | 0.00000 |
| E6 | 17 | 622.25 | 0.00000 | 0.00000 | 0.00000 |
| F6 | 18 | 659.26 | 0.00000 | 0.00000 | 0.00000 |
| F6#/G6b | 19 | 698.46 | 0.00000 | 0.00000 | 0.00000 |
| G7 | 20 | 739.99 | 0.00000 | 0.00000 | 0.00000 |
| G7#/A7b | 21 | 783.99 | 0.00000 | 0.00000 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 311.13 | 0.00539 | 0.00000 | 0.00000 |
| F5 | 1 | 329.63 | 0.00000 | 0.00000 | 0.00000 |
| F5#/G5b | 2 | 349.23 | 0.00000 | 0.00000 | 0.00000 |
| G5 | 3 | 369.99 | 0.00000 | 0.00000 | 0.00000 |
| G5#/A5b | 4 | 392.00 | 0.00000 | 0.00000 | 0.00000 |
| A6 | 5 | 415.30 | 0.00000 | 0.00000 | 0.00000 |
| A6#/B6b | 6 | 440.00 | 0.00000 | 0.00000 | 0.00000 |
| B6 | 7 | 466.16 | 0.00000 | 0.00000 | 0.00000 |
| C6 | 8 | 493.88 | 0.00000 | 0.00000 | 0.00000 |
| C6#/D6b | 9 | 523.25 | 0.00000 | 0.00000 | 0.00000 |
| D6 | 10 | 554.37 | 0.00000 | 0.00000 | 0.00000 |
| D6#/E6b | 11 | 587.33 | 0.00000 | 0.00000 | 0.00000 |
| E6 | 12 | 622.25 | 0.00000 | 0.00000 | 0.00000 |
| F6 | 13 | 659.26 | 0.00000 | 0.00000 | 0.00000 |
| F6#/G6b | 14 | 698.46 | 0.00000 | 0.00000 | 0.00000 |
| G7 | 15 | 739.99 | 0.00000 | 0.00000 | 0.00000 |
| G7#/A7b | 16 | 783.99 | 0.00000 | 0.00000 | 0.00000 |
| A7 | 17 | 830.61 | 0.00000 | 0.00000 | 0.00000 |
| A7#/B7b | 18 | 880.00 | 0.00000 | 0.00000 | 0.00000 |
| B7 | 19 | 932.33 | 0.00000 | 0.00000 | 0.00000 |
| C7 | 20 | 987.77 | 0.00000 | 0.00000 | 0.00000 |
| C7#/D7b | 21 | 1046.50 | 0.00000 | 0.00000 | 0.00000 |

FIG.10

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | -0.25085 |
| F3 | 1 | 87.31 | 0.00000 | 0.00000 | -0.25085 |
| F3#/G3b | 2 | 92.50 | 0.00000 | 0.00000 | -0.25085 |
| G3 | 3 | 98.00 | 0.00000 | 0.00000 | -0.25085 |
| G3#/A4b | 4 | 103.83 | 0.00000 | 0.00000 | -0.25085 |
| A4 | 5 | 110.00 | 0.00000 | 0.00000 | -0.25085 |
| A4#/B4b | 6 | 116.54 | 0.00000 | 0.00000 | -0.25085 |
| B4 | 7 | 123.47 | 0.00000 | 0.00000 | -0.25085 |
| C4 | 8 | 130.81 | 0.00000 | 0.00000 | -0.25085 |
| C4#/D4b | 9 | 138.59 | 0.00000 | 0.00000 | -0.25085 |
| D4 | 10 | 146.83 | 0.00000 | 0.00000 | -0.25085 |
| D4#/E4b | 11 | 155.56 | 0.00000 | 0.00000 | -0.25085 |
| E4 | 12 | 164.81 | 0.00000 | 0.00000 | -0.25085 |
| F4 | 13 | 174.61 | 0.00000 | 0.00000 | -0.25085 |
| F4#/G4b | 14 | 185.00 | 0.00000 | 0.00000 | -0.25085 |
| G4 | 15 | 196.00 | 0.00000 | 0.00000 | -0.25085 |
| G4#/A4b | 16 | 207.65 | 0.00000 | 0.00000 | -0.25085 |
| A5 | 17 | 220.00 | 0.00000 | 0.00000 | -0.25085 |
| A5#/B5b | 18 | 233.08 | 0.00000 | 0.00000 | -0.25085 |
| B5 | 19 | 246.94 | 0.00000 | 0.00000 | -0.25085 |
| C5 | 20 | 261.63 | 0.00000 | 0.00000 | -0.25085 |
| C5#/D5b | 21 | 277.18 | 0.00000 | 0.00000 | -0.25085 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | -0.25085 |
| A4#/B4b | 1 | 116.54 | 0.00000 | 0.00000 | -0.25085 |
| B4 | 2 | 123.47 | 0.00000 | 0.00000 | -0.25085 |
| C4 | 3 | 130.81 | 0.00000 | 0.00000 | -0.25085 |
| C4#/D4b | 4 | 138.59 | 0.00000 | 0.00000 | -0.25085 |
| D4 | 5 | 146.83 | 0.00000 | 0.00000 | -0.25085 |
| D4#/E4b | 6 | 155.56 | 0.00000 | 0.00000 | -0.25085 |
| E4 | 7 | 164.81 | 0.00000 | 0.00000 | -0.25085 |
| F4 | 8 | 174.61 | 0.00000 | 0.00000 | -0.25085 |
| F4#/G4b | 9 | 185.00 | 0.00000 | 0.00000 | -0.25085 |
| G4 | 10 | 196.00 | 0.00000 | 0.00000 | -0.25085 |
| G4#/A4b | 11 | 207.65 | 0.00000 | 0.00000 | -0.25085 |
| A5 | 12 | 220.00 | 0.00000 | 0.00000 | -0.25085 |
| A5#/B5b | 13 | 233.08 | 0.00000 | 0.00000 | -0.25085 |
| B5 | 14 | 246.94 | 0.00000 | 0.00000 | -0.25085 |
| C5 | 15 | 261.63 | 0.00000 | 0.00000 | -0.25085 |
| C5#/D5b | 16 | 277.18 | 0.00000 | 0.00000 | -0.25085 |
| D5 | 17 | 293.66 | 0.00000 | 0.00000 | -0.25085 |
| D5#/E5b | 18 | 311.13 | 0.00000 | 0.00000 | -0.25085 |
| E5 | 19 | 329.63 | 0.00000 | 0.00000 | -0.25085 |
| F5 | 20 | 349.23 | 0.00000 | 0.00000 | -0.25085 |
| F5#/G5b | 21 | 369.99 | 0.00000 | 0.00000 | -0.25085 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | 0.00000 | -0.25085 |
| D4#/E4b | 1 | 155.56 | 0.00000 | 0.00000 | -0.25085 |
| E4 | 2 | 164.81 | 0.00000 | 0.00000 | -0.25085 |
| F4 | 3 | 174.61 | 0.00000 | 0.00000 | -0.25085 |
| F4#/G4b | 4 | 185.00 | 0.00000 | 0.00000 | -0.25085 |
| G4 | 5 | 196.00 | 0.00000 | 0.00000 | -0.25085 |
| G4#/A4b | 6 | 207.65 | 0.00000 | 0.00000 | -0.25085 |
| A5 | 7 | 220.00 | 0.00000 | 0.00000 | -0.25085 |
| A5#/B5b | 8 | 233.08 | 0.00000 | 0.00000 | -0.25085 |
| B5 | 9 | 246.94 | 0.00000 | 0.00000 | -0.25085 |
| C5 | 10 | 261.63 | 0.00000 | 0.00000 | -0.25085 |
| C5#/D5b | 11 | 277.18 | 0.00000 | 0.00000 | -0.25085 |
| D5 | 12 | 293.66 | 0.00000 | 0.00000 | -0.25085 |
| D5#/E5b | 13 | 311.13 | 0.00000 | 0.00000 | -0.25085 |
| E5 | 14 | 329.63 | 0.00000 | 0.00000 | -0.25085 |
| F5 | 15 | 349.23 | 0.00000 | 0.00000 | -0.25085 |
| F5#/G5b | 16 | 369.99 | 0.00000 | 0.00000 | -0.25085 |
| G5 | 17 | 392.00 | 0.00000 | 0.00000 | -0.25085 |
| G5#/A5b | 18 | 415.30 | 0.00000 | 0.00000 | -0.25085 |
| A6 | 19 | 440.00 | 0.00000 | 0.00000 | -0.25085 |
| A6#/B6b | 20 | 466.16 | 0.00000 | 0.00000 | -0.25085 |
| B6 | 21 | 493.88 | 0.00000 | 0.00000 | -0.25085 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | -0.25085 |
| G4#/A4b | 1 | 207.65 | 0.00000 | 0.00000 | -0.25085 |
| A5 | 2 | 220.00 | 0.00000 | 0.00000 | -0.25085 |
| A5#/B5b | 3 | 233.08 | 0.00000 | 0.00000 | -0.25085 |
| B5 | 4 | 246.94 | 0.00000 | 0.00000 | -0.25085 |
| C5 | 5 | 261.63 | 0.00000 | 0.00000 | -0.25085 |
| C5#/D5b | 6 | 277.18 | 0.00000 | 0.00000 | -0.25085 |
| D5 | 7 | 293.66 | 0.00000 | 0.00000 | -0.25085 |
| D5#/E5b | 8 | 311.13 | 0.00000 | 0.00000 | -0.25085 |
| E5 | 9 | 329.63 | 0.00000 | 0.00000 | -0.25085 |
| F5 | 10 | 349.23 | 0.00000 | 0.00000 | -0.25085 |
| F5#/G5b | 11 | 369.99 | 0.00000 | 0.00000 | -0.25085 |
| G5 | 12 | 392.00 | 0.00000 | 0.00000 | -0.25085 |
| G5#/A5b | 13 | 415.30 | 0.00000 | 0.00000 | -0.25085 |
| A6 | 14 | 440.00 | 0.00000 | 0.00000 | -0.25085 |
| A6#/B6b | 15 | 466.16 | 0.00000 | 0.00000 | -0.25085 |
| B6 | 16 | 493.88 | 0.00000 | 0.00000 | -0.25085 |
| C6 | 17 | 523.25 | 0.00000 | 0.00000 | -0.25085 |
| C6#/D6b | 18 | 554.37 | 0.00000 | 0.00000 | -0.25085 |
| D6 | 19 | 587.33 | 0.00000 | 0.00000 | -0.25085 |
| D6#/E6b | 20 | 622.25 | 0.00000 | 0.00000 | -0.25085 |
| E6 | 21 | 659.26 | 0.00000 | 0.00000 | -0.25085 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | -0.25085 |
| C5 | 1 | 261.63 | 0.00000 | 0.00000 | -0.25085 |
| C5#/D5b | 2 | 277.18 | 0.00000 | 0.00000 | -0.25085 |
| D5 | 3 | 293.66 | 0.00000 | 0.00000 | -0.25085 |
| D5#/E5b | 4 | 311.13 | 0.00000 | 0.00000 | -0.25085 |
| E5 | 5 | 329.63 | 0.00000 | 0.00000 | -0.25085 |
| F5 | 6 | 349.23 | 0.00000 | 0.00000 | -0.25085 |
| F5#/G5b | 7 | 369.99 | 0.00000 | 0.00000 | -0.25085 |
| G5 | 8 | 392.00 | 0.00000 | 0.00000 | -0.25085 |
| G5#/A5b | 9 | 415.30 | 0.00000 | 0.00000 | -0.25085 |
| A6 | 10 | 440.00 | 0.00000 | 0.00000 | -0.25085 |
| A6#/B6b | 11 | 466.16 | 0.00000 | 0.00000 | -0.25085 |
| B6 | 12 | 493.88 | 0.00000 | 0.00000 | -0.25085 |
| C6 | 13 | 523.25 | 0.00000 | 0.00000 | -0.25085 |
| C6#/D6b | 14 | 554.37 | 0.00000 | 0.00000 | -0.25085 |
| D6 | 15 | 587.33 | 0.00000 | 0.00000 | -0.25085 |
| D6#/E6b | 16 | 622.25 | 0.00000 | 0.00000 | -0.25085 |
| E6 | 17 | 659.26 | 0.00000 | 0.00000 | -0.25085 |
| F6 | 18 | 698.46 | 0.00000 | 0.00000 | -0.25085 |
| F6#/G6b | 19 | 739.99 | 0.00000 | 0.00000 | -0.25085 |
| G7 | 20 | 783.99 | 0.00000 | 0.00000 | -0.25085 |
| G7#/A7b | 21 | 830.61 | 0.00000 | 0.00000 | -0.25085 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | -0.25085 |
| F5 | 1 | 349.23 | 0.00000 | 0.00000 | -0.25085 |
| F5#/G5b | 2 | 369.99 | 0.00000 | 0.00000 | -0.25085 |
| G5 | 3 | 392.00 | 0.00000 | 0.00000 | -0.25085 |
| G5#/A5b | 4 | 415.30 | 0.00000 | 0.00000 | -0.25085 |
| A6 | 5 | 440.00 | 0.00000 | 0.00000 | -0.25085 |
| A6#/B6b | 6 | 466.16 | 0.00000 | 0.00000 | -0.25085 |
| B6 | 7 | 493.88 | 0.00000 | 0.00000 | -0.25085 |
| C6 | 8 | 523.25 | 0.00000 | 0.00000 | -0.25085 |
| C6#/D6b | 9 | 554.37 | 0.00000 | 0.00000 | -0.25085 |
| D6 | 10 | 587.33 | 0.00000 | 0.00000 | -0.25085 |
| D6#/E6b | 11 | 622.25 | 0.00000 | 0.00000 | -0.25085 |
| E6 | 12 | 659.26 | 0.00000 | 0.00000 | -0.25085 |
| F6 | 13 | 698.46 | 0.00000 | 0.00000 | -0.25085 |
| F6#/G6b | 14 | 739.99 | 0.00000 | 0.00000 | -0.25085 |
| G7 | 15 | 783.99 | 0.00000 | 0.00000 | -0.25085 |
| G7#/A7b | 16 | 830.61 | 0.00000 | 0.00000 | -0.25085 |
| A7 | 17 | 880.00 | 0.00000 | 0.00000 | -0.25085 |
| A7#/B7b | 18 | 932.33 | 0.00000 | 0.00000 | -0.25085 |
| B7 | 19 | 987.77 | 0.00000 | 0.00000 | -0.25085 |
| C7 | 20 | 1046.50 | 0.00000 | 0.00000 | -0.25085 |
| C7#/D7b | 21 | 1108.73 | 0.00000 | 0.00000 | -0.25085 |

FIG.11

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | -0.02000 | 0.00000 |
| F3 | 1 | 87.31 | 0.00000 | -0.01800 | 0.00000 |
| F3#/G3b | 2 | 92.50 | 0.00000 | -0.01600 | 0.00000 |
| G3 | 3 | 98.00 | 0.00000 | -0.01400 | 0.00000 |
| G3#/A4b | 4 | 103.83 | 0.00000 | -0.01200 | 0.00000 |
| A4 | 5 | 110.00 | 0.00000 | -0.01000 | 0.00000 |
| A4#/B4b | 6 | 116.54 | 0.00000 | -0.00800 | 0.00000 |
| B4 | 7 | 123.47 | 0.00000 | -0.00600 | 0.00000 |
| C4 | 8 | 130.81 | 0.00000 | -0.00400 | 0.00000 |
| C4#/D4b | 9 | 138.59 | 0.00000 | -0.00200 | 0.00000 |
| D4 | 10 | 146.83 | 0.00000 | 0.00000 | 0.00000 |
| D4#/E4b | 11 | 155.56 | 0.00000 | 0.00000 | 0.00000 |
| E4 | 12 | 164.81 | 0.00000 | 0.00000 | 0.00000 |
| F4 | 13 | 174.61 | 0.00000 | 0.00000 | 0.00000 |
| F4#/G4b | 14 | 185.00 | 0.00000 | 0.00000 | 0.00000 |
| G4 | 15 | 196.00 | 0.00000 | 0.00000 | 0.00000 |
| G4#/A4b | 16 | 207.65 | 0.00000 | 0.00000 | 0.00000 |
| A5 | 17 | 220.00 | 0.00000 | 0.00000 | 0.00000 |
| A5#/B5b | 18 | 233.08 | 0.00000 | 0.00000 | 0.00000 |
| B5 | 19 | 246.94 | 0.00000 | 0.00000 | 0.00000 |
| C5 | 20 | 261.63 | 0.00000 | 0.00000 | 0.00000 |
| C5#/D5b | 21 | 277.18 | 0.00000 | 0.00000 | 0.00000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | -0.02000 | 0.00000 |
| A4#/B4b | 1 | 116.54 | 0.00000 | -0.01650 | 0.00000 |
| B4 | 2 | 123.47 | 0.00000 | -0.01300 | 0.00000 |
| C4 | 3 | 130.81 | 0.00000 | -0.00950 | 0.00000 |
| C4#/D4b | 4 | 138.59 | 0.00000 | -0.00600 | 0.00000 |
| D4 | 5 | 146.83 | 0.00000 | -0.00250 | 0.00000 |
| D4#/E4b | 6 | 155.56 | 0.00000 | 0.00000 | 0.00000 |
| E4 | 7 | 164.81 | 0.00000 | 0.00000 | 0.00000 |
| F4 | 8 | 174.61 | 0.00000 | 0.00000 | 0.00000 |
| F4#/G4b | 9 | 185.00 | 0.00000 | 0.00250 | 0.00000 |
| G4 | 10 | 196.00 | 0.00000 | 0.00500 | 0.00000 |
| G4#/A4b | 11 | 207.65 | 0.00000 | 0.00750 | 0.00000 |
| A5 | 12 | 220.00 | 0.00000 | 0.01000 | 0.00000 |
| A5#/B5b | 13 | 233.08 | 0.00000 | 0.00750 | 0.00000 |
| B5 | 14 | 246.94 | 0.00000 | 0.01250 | 0.00000 |
| C5 | 15 | 261.63 | 0.00000 | 0.00750 | 0.00000 |
| C5#/D5b | 16 | 277.18 | 0.00000 | 0.00500 | 0.00000 |
| D5 | 17 | 293.66 | 0.00000 | 0.00000 | 0.00000 |
| D5#/E5b | 18 | 311.13 | 0.00000 | 0.00000 | 0.00000 |
| E5 | 19 | 329.63 | 0.00000 | 0.00000 | 0.00000 |
| F5 | 20 | 349.23 | 0.00000 | 0.00000 | 0.00000 |
| F5#/G5b | 21 | 369.99 | 0.00000 | 0.00000 | 0.00000 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | -0.02000 | 0.00000 |
| D4#/E4b | 1 | 155.56 | 0.00000 | -0.01650 | 0.00000 |
| E4 | 2 | 164.81 | 0.00000 | -0.01300 | 0.00000 |
| F4 | 3 | 174.61 | 0.00000 | -0.00950 | 0.00000 |
| F4#/G4b | 4 | 185.00 | 0.00000 | -0.00600 | 0.00000 |
| G4 | 5 | 196.00 | 0.00000 | -0.00250 | 0.00000 |
| G4#/A4b | 6 | 207.65 | 0.00000 | 0.00000 | 0.00000 |
| A5 | 7 | 220.00 | 0.00000 | 0.00000 | 0.00000 |
| A5#/B5b | 8 | 233.08 | 0.00000 | 0.00000 | 0.00000 |
| B5 | 9 | 246.94 | 0.00000 | 0.00250 | 0.00000 |
| C5 | 10 | 261.63 | 0.00000 | 0.00500 | 0.00000 |
| C5#/D5b | 11 | 277.18 | 0.00000 | 0.00750 | 0.00000 |
| D5 | 12 | 293.66 | 0.00000 | 0.01000 | 0.00000 |
| D5#/E5b | 13 | 311.13 | 0.00000 | 0.00750 | 0.00000 |
| E5 | 14 | 329.63 | 0.00000 | 0.01250 | 0.00000 |
| F5 | 15 | 349.23 | 0.00000 | 0.00750 | 0.00000 |
| F5#/G5b | 16 | 369.99 | 0.00000 | 0.00500 | 0.00000 |
| G5 | 17 | 392.00 | 0.00000 | 0.00000 | 0.00000 |
| G5#/A5b | 18 | 415.30 | 0.00000 | 0.00000 | 0.00000 |
| A6 | 19 | 440.00 | 0.00000 | 0.00000 | 0.00000 |
| A6#/B6b | 20 | 466.16 | 0.00000 | 0.00000 | 0.00000 |
| B6 | 21 | 493.88 | 0.00000 | 0.00000 | 0.00000 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | -0.02000 | 0.00000 |
| G4#/A4b | 1 | 207.65 | 0.00000 | -0.01650 | 0.00000 |
| A5 | 2 | 220.00 | 0.00000 | -0.01300 | 0.00000 |
| A5#/B5b | 3 | 233.08 | 0.00000 | -0.00950 | 0.00000 |
| B5 | 4 | 246.94 | 0.00000 | -0.00600 | 0.00000 |
| C5 | 5 | 261.63 | 0.00000 | -0.00250 | 0.00000 |
| C5#/D5b | 6 | 277.18 | 0.00000 | 0.00000 | 0.00000 |
| D5 | 7 | 293.66 | 0.00000 | 0.00000 | 0.00000 |
| D5#/E5b | 8 | 311.13 | 0.00000 | 0.00000 | 0.00000 |
| E5 | 9 | 329.63 | 0.00000 | 0.00250 | 0.00000 |
| F5 | 10 | 349.23 | 0.00000 | 0.00500 | 0.00000 |
| F5#/G5b | 11 | 369.99 | 0.00000 | 0.00750 | 0.00000 |
| G5 | 12 | 392.00 | 0.00000 | 0.01000 | 0.00000 |
| G5#/A5b | 13 | 415.30 | 0.00000 | 0.00750 | 0.00000 |
| A6 | 14 | 440.00 | 0.00000 | 0.01250 | 0.00000 |
| A6#/B6b | 15 | 466.16 | 0.00000 | 0.00750 | 0.00000 |
| B6 | 16 | 493.88 | 0.00000 | 0.00500 | 0.00000 |
| C6 | 17 | 523.25 | 0.00000 | 0.00000 | 0.00000 |
| C6#/D6b | 18 | 554.37 | 0.00000 | 0.00000 | 0.00000 |
| D6 | 19 | 587.33 | 0.00000 | 0.00000 | 0.00000 |
| D6#/E6b | 20 | 622.25 | 0.00000 | 0.00000 | 0.00000 |
| E6 | 21 | 659.26 | 0.00000 | 0.00000 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | -0.01000 | 0.00000 |
| C5 | 1 | 261.63 | 0.00000 | -0.00750 | 0.00000 |
| C5#/D5b | 2 | 277.18 | 0.00000 | -0.00500 | 0.00000 |
| D5 | 3 | 293.66 | 0.00000 | -0.00250 | 0.00000 |
| D5#/E5b | 4 | 311.13 | 0.00000 | 0.00000 | 0.00000 |
| E5 | 5 | 329.63 | 0.00000 | 0.00000 | 0.00000 |
| F5 | 6 | 349.23 | 0.00000 | 0.00000 | 0.00000 |
| F5#/G5b | 7 | 369.99 | 0.00000 | 0.00000 | 0.00000 |
| G5 | 8 | 392.00 | 0.00000 | 0.00000 | 0.00000 |
| G5#/A5b | 9 | 415.30 | 0.00000 | 0.00000 | 0.00000 |
| A6 | 10 | 440.00 | 0.00000 | 0.00000 | 0.00000 |
| A6#/B6b | 11 | 466.16 | 0.00000 | 0.00000 | 0.00000 |
| B6 | 12 | 493.88 | 0.00000 | 0.00000 | 0.00000 |
| C6 | 13 | 523.25 | 0.00000 | 0.00000 | 0.00000 |
| C6#/D6b | 14 | 554.37 | 0.00000 | 0.00000 | 0.00000 |
| D6 | 15 | 587.33 | 0.00000 | 0.00000 | 0.00000 |
| D6#/E6b | 16 | 622.25 | 0.00000 | 0.00000 | 0.00000 |
| E6 | 17 | 659.26 | 0.00000 | 0.00000 | 0.00000 |
| F6 | 18 | 698.46 | 0.00000 | 0.00000 | 0.00000 |
| F6#/G6b | 19 | 739.99 | 0.00000 | 0.00000 | 0.00000 |
| G7 | 20 | 783.99 | 0.00000 | 0.00000 | 0.00000 |
| G7#/A7b | 21 | 830.61 | 0.00000 | 0.00000 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | 0.00000 |
| F5 | 1 | 349.23 | 0.00000 | 0.00000 | 0.00000 |
| F5#/G5b | 2 | 369.99 | 0.00000 | 0.00000 | 0.00000 |
| G5 | 3 | 392.00 | 0.00000 | 0.00000 | 0.00000 |
| G5#/A5b | 4 | 415.30 | 0.00000 | 0.00000 | 0.00000 |
| A6 | 5 | 440.00 | 0.00000 | 0.00000 | 0.00000 |
| A6#/B6b | 6 | 466.16 | 0.00000 | 0.00000 | 0.00000 |
| B6 | 7 | 493.88 | 0.00000 | 0.00000 | 0.00000 |
| C6 | 8 | 523.25 | 0.00000 | 0.00000 | 0.00000 |
| C6#/D6b | 9 | 554.37 | 0.00000 | 0.00000 | 0.00000 |
| D6 | 10 | 587.33 | 0.00000 | 0.00000 | 0.00000 |
| D6#/E6b | 11 | 622.25 | 0.00000 | 0.00000 | 0.00000 |
| E6 | 12 | 659.26 | 0.00000 | 0.00000 | 0.00000 |
| F6 | 13 | 698.46 | 0.00000 | 0.00000 | 0.00000 |
| F6#/G6b | 14 | 739.99 | 0.00000 | 0.00000 | 0.00000 |
| G7 | 15 | 783.99 | 0.00000 | 0.00000 | 0.00000 |
| G7#/A7b | 16 | 830.61 | 0.00000 | 0.00000 | 0.00000 |
| A7 | 17 | 880.00 | 0.00000 | 0.00000 | 0.00000 |
| A7#/B7b | 18 | 932.33 | 0.00000 | 0.00000 | 0.00000 |
| B7 | 19 | 987.77 | 0.00000 | 0.00000 | 0.00000 |
| C7 | 20 | 1046.50 | 0.00000 | 0.00000 | 0.00000 |
| C7#/D7b | 21 | 1108.73 | 0.00000 | 0.00000 | 0.00000 |

FIG.12

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | -0.25085 |
| F3 | 1 | 87.31 | 0.00000 | 0.00000 | -0.25085 |
| F3#/G3b | 2 | 92.50 | 0.00000 | 0.00000 | -0.25085 |
| G3 | 3 | 98.00 | 0.00000 | 0.00000 | -0.25085 |
| G3#/A4b | 4 | 103.83 | 0.00000 | 0.00000 | -0.25085 |
| A4 | 5 | 110.00 | 0.00000 | 0.00000 | 0.00000 |
| A4#/B4b | 6 | 116.54 | 0.00000 | 0.00000 | 0.00000 |
| B4 | 7 | 123.47 | 0.00000 | 0.00000 | 0.00000 |
| C4 | 8 | 130.81 | 0.00000 | 0.00000 | 0.00000 |
| C4#/D4b | 9 | 138.59 | 0.00000 | 0.00000 | 0.00000 |
| D4 | 10 | 146.83 | 0.00000 | 0.00000 | 0.00000 |
| D4#/E4b | 11 | 155.56 | 0.00000 | 0.00000 | 0.00000 |
| E4 | 12 | 164.81 | 0.00000 | 0.00000 | 0.00000 |
| F4 | 13 | 174.61 | 0.00000 | 0.00000 | 0.00000 |
| F4#/G4b | 14 | 185.00 | 0.00000 | 0.00000 | 0.00000 |
| G4 | 15 | 196.00 | 0.00000 | 0.00000 | 0.00000 |
| G4#/A4b | 16 | 207.65 | 0.00000 | 0.00000 | 0.00000 |
| A5 | 17 | 220.00 | 0.00000 | 0.00000 | 0.00000 |
| A5#/B5b | 18 | 233.08 | 0.00000 | 0.00000 | 0.00000 |
| B5 | 19 | 246.94 | 0.00000 | 0.00000 | 0.00000 |
| C5 | 20 | 261.63 | 0.00000 | 0.00000 | 0.00000 |
| C5#/D5b | 21 | 277.18 | 0.00000 | 0.00000 | 0.00000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | -0.25085 |
| A4#/B4b | 1 | 116.54 | 0.00000 | 0.00000 | -0.25085 |
| B4 | 2 | 123.47 | 0.00000 | 0.00000 | -0.25085 |
| C4 | 3 | 130.81 | 0.00000 | 0.00000 | -0.25085 |
| C4#/D4b | 4 | 138.59 | 0.00000 | 0.00000 | -0.25085 |
| D4 | 5 | 146.83 | 0.00000 | 0.00000 | 0.00000 |
| D4#/E4b | 6 | 155.56 | 0.00000 | 0.00000 | 0.00000 |
| E4 | 7 | 164.81 | 0.00000 | 0.00000 | 0.00000 |
| F4 | 8 | 174.61 | 0.00000 | 0.00000 | 0.00000 |
| F4#/G4b | 9 | 185.00 | 0.00000 | 0.00000 | 0.00000 |
| G4 | 10 | 196.00 | 0.00000 | 0.00000 | 0.00000 |
| G4#/A4b | 11 | 207.65 | 0.00000 | 0.00000 | 0.00000 |
| A5 | 12 | 220.00 | 0.00000 | 0.00000 | 0.00000 |
| A5#/B5b | 13 | 233.08 | 0.00000 | 0.00000 | 0.00000 |
| B5 | 14 | 246.94 | 0.00000 | 0.00000 | 0.00000 |
| C5 | 15 | 261.63 | 0.00000 | 0.00000 | 0.00000 |
| C5#/D5b | 16 | 277.18 | 0.00000 | 0.00000 | 0.00000 |
| D5 | 17 | 293.66 | 0.00000 | 0.00000 | 0.00000 |
| D5#/E5b | 18 | 311.13 | 0.00000 | 0.00000 | 0.00000 |
| E5 | 19 | 329.63 | 0.00000 | 0.00000 | 0.00000 |
| F5 | 20 | 349.23 | 0.00000 | 0.00000 | 0.00000 |
| F5#/G5b | 21 | 369.99 | 0.00000 | 0.00000 | 0.00000 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | 0.00000 | -0.25085 |
| D4#/E4b | 1 | 155.56 | 0.00000 | 0.00000 | -0.25085 |
| E4 | 2 | 164.81 | 0.00000 | 0.00000 | -0.25085 |
| F4 | 3 | 174.61 | 0.00000 | 0.00000 | -0.25085 |
| F4#/G4b | 4 | 185.00 | 0.00000 | 0.00000 | -0.25085 |
| G4 | 5 | 196.00 | 0.00000 | 0.00000 | 0.00000 |
| G4#/A4b | 6 | 207.65 | 0.00000 | 0.00000 | 0.00000 |
| A5 | 7 | 220.00 | 0.00000 | 0.00000 | 0.00000 |
| A5#/B5b | 8 | 233.08 | 0.00000 | 0.00000 | 0.00000 |
| B5 | 9 | 246.94 | 0.00000 | 0.00000 | 0.00000 |
| C5 | 10 | 261.63 | 0.00000 | 0.00000 | 0.00000 |
| C5#/D5b | 11 | 277.18 | 0.00000 | 0.00000 | 0.00000 |
| D5 | 12 | 293.66 | 0.00000 | 0.00000 | 0.00000 |
| D5#/E5b | 13 | 311.13 | 0.00000 | 0.00000 | 0.00000 |
| E5 | 14 | 329.63 | 0.00000 | 0.00000 | 0.00000 |
| F5 | 15 | 349.23 | 0.00000 | 0.00000 | 0.00000 |
| F5#/G5b | 16 | 369.99 | 0.00000 | 0.00000 | 0.00000 |
| G5 | 17 | 392.00 | 0.00000 | 0.00000 | 0.00000 |
| G5#/A5b | 18 | 415.30 | 0.00000 | 0.00000 | 0.00000 |
| A6 | 19 | 440.00 | 0.00000 | 0.00000 | 0.00000 |
| A6#/B6b | 20 | 466.16 | 0.00000 | 0.00000 | 0.00000 |
| B6 | 21 | 493.88 | 0.00000 | 0.00000 | 0.00000 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | -0.25085 |
| G4#/A4b | 1 | 207.65 | 0.00000 | 0.00000 | -0.25085 |
| A5 | 2 | 220.00 | 0.00000 | 0.00000 | -0.25085 |
| A5#/B5b | 3 | 233.08 | 0.00000 | 0.00000 | -0.25085 |
| B5 | 4 | 246.94 | 0.00000 | 0.00000 | -0.25085 |
| C5 | 5 | 261.63 | 0.00000 | 0.00000 | 0.00000 |
| C5#/D5b | 6 | 277.18 | 0.00000 | 0.00000 | 0.00000 |
| D5 | 7 | 293.66 | 0.00000 | 0.00000 | 0.00000 |
| D5#/E5b | 8 | 311.13 | 0.00000 | 0.00000 | 0.00000 |
| E5 | 9 | 329.63 | 0.00000 | 0.00000 | 0.00000 |
| F5 | 10 | 349.23 | 0.00000 | 0.00000 | 0.00000 |
| F5#/G5b | 11 | 369.99 | 0.00000 | 0.00000 | 0.00000 |
| G5 | 12 | 392.00 | 0.00000 | 0.00000 | 0.00000 |
| G5#/A5b | 13 | 415.30 | 0.00000 | 0.00000 | 0.00000 |
| A6 | 14 | 440.00 | 0.00000 | 0.00000 | 0.00000 |
| A6#/B6b | 15 | 466.16 | 0.00000 | 0.00000 | 0.00000 |
| B6 | 16 | 493.88 | 0.00000 | 0.00000 | 0.00000 |
| C6 | 17 | 523.25 | 0.00000 | 0.00000 | 0.00000 |
| C6#/D6b | 18 | 554.37 | 0.00000 | 0.00000 | 0.00000 |
| D6 | 19 | 587.33 | 0.00000 | 0.00000 | 0.00000 |
| D6#/E6b | 20 | 622.25 | 0.00000 | 0.00000 | 0.00000 |
| E6 | 21 | 659.26 | 0.00000 | 0.00000 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | -0.25085 |
| C5 | 1 | 261.63 | 0.00000 | 0.00000 | -0.25085 |
| C5#/D5b | 2 | 277.18 | 0.00000 | 0.00000 | -0.25085 |
| D5 | 3 | 293.66 | 0.00000 | 0.00000 | -0.25085 |
| D5#/E5b | 4 | 311.13 | 0.00000 | 0.00000 | -0.25085 |
| E5 | 5 | 329.63 | 0.00000 | 0.00000 | 0.00000 |
| F5 | 6 | 349.23 | 0.00000 | 0.00000 | 0.00000 |
| F5#/G5b | 7 | 369.99 | 0.00000 | 0.00000 | 0.00000 |
| G5 | 8 | 392.00 | 0.00000 | 0.00000 | 0.00000 |
| G5#/A5b | 9 | 415.30 | 0.00000 | 0.00000 | 0.00000 |
| A6 | 10 | 440.00 | 0.00000 | 0.00000 | 0.00000 |
| A6#/B6b | 11 | 466.16 | 0.00000 | 0.00000 | 0.00000 |
| B6 | 12 | 493.88 | 0.00000 | 0.00000 | 0.00000 |
| C6 | 13 | 523.25 | 0.00000 | 0.00000 | 0.00000 |
| C6#/D6b | 14 | 554.37 | 0.00000 | 0.00000 | 0.00000 |
| D6 | 15 | 587.33 | 0.00000 | 0.00000 | 0.00000 |
| D6#/E6b | 16 | 622.25 | 0.00000 | 0.00000 | 0.00000 |
| E6 | 17 | 659.26 | 0.00000 | 0.00000 | 0.00000 |
| F6 | 18 | 698.46 | 0.00000 | 0.00000 | 0.00000 |
| F6#/G6b | 19 | 739.99 | 0.00000 | 0.00000 | 0.00000 |
| G7 | 20 | 783.99 | 0.00000 | 0.00000 | 0.00000 |
| G7#/A7b | 21 | 830.61 | 0.00000 | 0.00000 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | -0.25085 |
| F5 | 1 | 349.23 | 0.00000 | 0.00000 | -0.25085 |
| F5#/G5b | 2 | 369.99 | 0.00000 | 0.00000 | -0.25085 |
| G5 | 3 | 392.00 | 0.00000 | 0.00000 | -0.25085 |
| G5#/A5b | 4 | 415.30 | 0.00000 | 0.00000 | -0.25085 |
| A6 | 5 | 440.00 | 0.00000 | 0.00000 | 0.00000 |
| A6#/B6b | 6 | 466.16 | 0.00000 | 0.00000 | 0.00000 |
| B6 | 7 | 493.88 | 0.00000 | 0.00000 | 0.00000 |
| C6 | 8 | 523.25 | 0.00000 | 0.00000 | 0.00000 |
| C6#/D6b | 9 | 554.37 | 0.00000 | 0.00000 | 0.00000 |
| D6 | 10 | 587.33 | 0.00000 | 0.00000 | 0.00000 |
| D6#/E6b | 11 | 622.25 | 0.00000 | 0.00000 | 0.00000 |
| E6 | 12 | 659.26 | 0.00000 | 0.00000 | 0.00000 |
| F6 | 13 | 698.46 | 0.00000 | 0.00000 | 0.00000 |
| F6#/G6b | 14 | 739.99 | 0.00000 | 0.00000 | 0.00000 |
| G7 | 15 | 783.99 | 0.00000 | 0.00000 | 0.00000 |
| G7#/A7b | 16 | 830.61 | 0.00000 | 0.00000 | 0.00000 |
| A7 | 17 | 880.00 | 0.00000 | 0.00000 | 0.00000 |
| A7#/B7b | 18 | 932.33 | 0.00000 | 0.00000 | 0.00000 |
| B7 | 19 | 987.77 | 0.00000 | 0.00000 | 0.00000 |
| C7 | 20 | 1046.50 | 0.00000 | 0.00000 | 0.00000 |
| C7#/D7b | 21 | 1108.73 | 0.00000 | 0.00000 | 0.00000 |

FIG.13

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | -0.50000 |
| F3 | 1 | 87.31 | 0.00000 | 0.00000 | -0.50000 |
| F3#/G3b | 2 | 92.50 | 0.00000 | 0.00000 | -0.50000 |
| G3 | 3 | 98.00 | 0.00000 | 0.00000 | -0.50000 |
| G3#/A4b | 4 | 103.83 | 0.00000 | 0.00000 | -0.50000 |
| A4 | 5 | 110.00 | 0.00000 | 0.00000 | -0.50000 |
| A4#/B4b | 6 | 116.54 | 0.00000 | 0.00000 | -0.50000 |
| B4 | 7 | 123.47 | 0.00000 | 0.00000 | -0.50000 |
| C4 | 8 | 130.81 | 0.00000 | 0.00000 | -0.50000 |
| C4#/D4b | 9 | 138.59 | 0.00000 | 0.00000 | -0.50000 |
| D4 | 10 | 146.83 | 0.00000 | 0.00000 | -0.50000 |
| D4#/E4b | 11 | 155.56 | 0.00000 | 0.00000 | -0.50000 |
| E4 | 12 | 164.81 | 0.00000 | 0.00000 | -0.50000 |
| F4 | 13 | 174.61 | 0.00000 | 0.00000 | -0.50000 |
| F4#/G4b | 14 | 185.00 | 0.00000 | 0.00000 | -0.50000 |
| G4 | 15 | 196.00 | 0.00000 | 0.00000 | -0.50000 |
| G4#/A4b | 16 | 207.65 | 0.00000 | 0.00000 | -0.50000 |
| A5 | 17 | 220.00 | 0.00000 | 0.00000 | -0.50000 |
| A5#/B5b | 18 | 233.08 | 0.00000 | 0.00000 | -0.50000 |
| B5 | 19 | 246.94 | 0.00000 | 0.00000 | -0.50000 |
| C5 | 20 | 261.63 | 0.00000 | 0.00000 | -0.50000 |
| C5#/D5b | 21 | 277.18 | 0.00000 | 0.00000 | -0.50000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | -0.50000 |
| A4#/B4b | 1 | 116.54 | 0.00000 | 0.00000 | -0.50000 |
| B4 | 2 | 123.47 | 0.00000 | 0.00000 | -0.50000 |
| C4 | 3 | 130.81 | 0.00000 | 0.00000 | -0.50000 |
| C4#/D4b | 4 | 138.59 | 0.00000 | 0.00000 | -0.50000 |
| D4 | 5 | 146.83 | 0.00000 | 0.00000 | -0.50000 |
| D4#/E4b | 6 | 155.56 | 0.00000 | 0.00000 | -0.50000 |
| E4 | 7 | 164.81 | 0.00000 | 0.00000 | -0.50000 |
| F4 | 8 | 174.61 | 0.00000 | 0.00000 | -0.50000 |
| F4#/G4b | 9 | 185.00 | 0.00000 | 0.00000 | -0.50000 |
| G4 | 10 | 196.00 | 0.00000 | 0.00000 | -0.50000 |
| G4#/A4b | 11 | 207.65 | 0.00000 | 0.00000 | -0.50000 |
| A5 | 12 | 220.00 | 0.00000 | 0.00000 | -0.50000 |
| A5#/B5b | 13 | 233.08 | 0.00000 | 0.00000 | -0.50000 |
| B5 | 14 | 246.94 | 0.00000 | 0.00000 | -0.50000 |
| C5 | 15 | 261.63 | 0.00000 | 0.00000 | -0.50000 |
| C5#/D5b | 16 | 277.18 | 0.00000 | 0.00000 | -0.50000 |
| D5 | 17 | 293.66 | 0.00000 | 0.00000 | -0.50000 |
| D5#/E5b | 18 | 311.13 | 0.00000 | 0.00000 | -0.50000 |
| E5 | 19 | 329.63 | 0.00000 | 0.00000 | -0.50000 |
| F5 | 20 | 349.23 | 0.00000 | 0.00000 | -0.50000 |
| F5#/G5b | 21 | 369.99 | 0.00000 | 0.00000 | -0.50000 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | 0.00000 | 0.00000 |
| D4#/E4b | 1 | 155.56 | 0.00000 | 0.00000 | 0.00000 |
| E4 | 2 | 164.81 | 0.00000 | 0.00000 | 0.00000 |
| F4 | 3 | 174.61 | 0.00000 | 0.00000 | 0.00000 |
| F4#/G4b | 4 | 185.00 | 0.00000 | 0.00000 | 0.00000 |
| G4 | 5 | 196.00 | 0.00000 | 0.00000 | 0.00000 |
| G4#/A4b | 6 | 207.65 | 0.00000 | 0.00000 | 0.00000 |
| A5 | 7 | 220.00 | 0.00000 | 0.00000 | 0.00000 |
| A5#/B5b | 8 | 233.08 | 0.00000 | 0.00000 | 0.00000 |
| B5 | 9 | 246.94 | 0.00000 | 0.00000 | 0.00000 |
| C5 | 10 | 261.63 | 0.00000 | 0.00000 | 0.00000 |
| C5#/D5b | 11 | 277.18 | 0.00000 | 0.00000 | 0.00000 |
| D5 | 12 | 293.66 | 0.00000 | 0.00000 | 0.00000 |
| D5#/E5b | 13 | 311.13 | 0.00000 | 0.00000 | 0.00000 |
| E5 | 14 | 329.63 | 0.00000 | 0.00000 | 0.00000 |
| F5 | 15 | 349.23 | 0.00000 | 0.00000 | 0.00000 |
| F5#/G5b | 16 | 369.99 | 0.00000 | 0.00000 | 0.00000 |
| G5 | 17 | 392.00 | 0.00000 | 0.00000 | 0.00000 |
| G5#/A5b | 18 | 415.30 | 0.00000 | 0.00000 | 0.00000 |
| A6 | 19 | 440.00 | 0.00000 | 0.00000 | 0.00000 |
| A6#/B6b | 20 | 466.16 | 0.00000 | 0.00000 | 0.00000 |
| B6 | 21 | 493.88 | 0.00000 | 0.00000 | 0.00000 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | 0.00000 |
| G4#/A4b | 1 | 207.65 | 0.00000 | 0.00000 | 0.00000 |
| A5 | 2 | 220.00 | 0.00000 | 0.00000 | 0.00000 |
| A5#/B5b | 3 | 233.08 | 0.00000 | 0.00000 | 0.00000 |
| B5 | 4 | 246.94 | 0.00000 | 0.00000 | 0.00000 |
| C5 | 5 | 261.63 | 0.00000 | 0.00000 | 0.00000 |
| C5#/D5b | 6 | 277.18 | 0.00000 | 0.00000 | 0.00000 |
| D5 | 7 | 293.66 | 0.00000 | 0.00000 | 0.00000 |
| D5#/E5b | 8 | 311.13 | 0.00000 | 0.00000 | 0.00000 |
| E5 | 9 | 329.63 | 0.00000 | 0.00000 | 0.00000 |
| F5 | 10 | 349.23 | 0.00000 | 0.00000 | 0.00000 |
| F5#/G5b | 11 | 369.99 | 0.00000 | 0.00000 | 0.00000 |
| G5 | 12 | 392.00 | 0.00000 | 0.00000 | 0.00000 |
| G5#/A5b | 13 | 415.30 | 0.00000 | 0.00000 | 0.00000 |
| A6 | 14 | 440.00 | 0.00000 | 0.00000 | 0.00000 |
| A6#/B6b | 15 | 466.16 | 0.00000 | 0.00000 | 0.00000 |
| B6 | 16 | 493.88 | 0.00000 | 0.00000 | 0.00000 |
| C6 | 17 | 523.25 | 0.00000 | 0.00000 | 0.00000 |
| C6#/D6b | 18 | 554.37 | 0.00000 | 0.00000 | 0.00000 |
| D6 | 19 | 587.33 | 0.00000 | 0.00000 | 0.00000 |
| D6#/E6b | 20 | 622.25 | 0.00000 | 0.00000 | 0.00000 |
| E6 | 21 | 659.26 | 0.00000 | 0.00000 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | 0.00000 |
| C5 | 1 | 261.63 | 0.00000 | 0.00000 | 0.00000 |
| C5#/D5b | 2 | 277.18 | 0.00000 | 0.00000 | 0.00000 |
| D5 | 3 | 293.66 | 0.00000 | 0.00000 | 0.00000 |
| D5#/E5b | 4 | 311.13 | 0.00000 | 0.00000 | 0.00000 |
| E5 | 5 | 329.63 | 0.00000 | 0.00000 | 0.00000 |
| F5 | 6 | 349.23 | 0.00000 | 0.00000 | 0.00000 |
| F5#/G5b | 7 | 369.99 | 0.00000 | 0.00000 | 0.00000 |
| G5 | 8 | 392.00 | 0.00000 | 0.00000 | 0.00000 |
| G5#/A5b | 9 | 415.30 | 0.00000 | 0.00000 | 0.00000 |
| A6 | 10 | 440.00 | 0.00000 | 0.00000 | 0.00000 |
| A6#/B6b | 11 | 466.16 | 0.00000 | 0.00000 | 0.00000 |
| B6 | 12 | 493.88 | 0.00000 | 0.00000 | 0.00000 |
| C6 | 13 | 523.25 | 0.00000 | 0.00000 | 0.00000 |
| C6#/D6b | 14 | 554.37 | 0.00000 | 0.00000 | 0.00000 |
| D6 | 15 | 587.33 | 0.00000 | 0.00000 | 0.00000 |
| D6#/E6b | 16 | 622.25 | 0.00000 | 0.00000 | 0.00000 |
| E6 | 17 | 659.26 | 0.00000 | 0.00000 | 0.00000 |
| F6 | 18 | 698.46 | 0.00000 | 0.00000 | 0.00000 |
| F6#/G6b | 19 | 739.99 | 0.00000 | 0.00000 | 0.00000 |
| G7 | 20 | 783.99 | 0.00000 | 0.00000 | 0.00000 |
| G7#/A7b | 21 | 830.61 | 0.00000 | 0.00000 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | 0.00000 |
| F5 | 1 | 349.23 | 0.00000 | 0.00000 | 0.00000 |
| F5#/G5b | 2 | 369.99 | 0.00000 | 0.00000 | 0.00000 |
| G5 | 3 | 392.00 | 0.00000 | 0.00000 | 0.00000 |
| G5#/A5b | 4 | 415.30 | 0.00000 | 0.00000 | 0.00000 |
| A6 | 5 | 440.00 | 0.00000 | 0.00000 | 0.00000 |
| A6#/B6b | 6 | 466.16 | 0.00000 | 0.00000 | 0.00000 |
| B6 | 7 | 493.88 | 0.00000 | 0.00000 | 0.00000 |
| C6 | 8 | 523.25 | 0.00000 | 0.00000 | 0.00000 |
| C6#/D6b | 9 | 554.37 | 0.00000 | 0.00000 | 0.00000 |
| D6 | 10 | 587.33 | 0.00000 | 0.00000 | 0.00000 |
| D6#/E6b | 11 | 622.25 | 0.00000 | 0.00000 | 0.00000 |
| E6 | 12 | 659.26 | 0.00000 | 0.00000 | 0.00000 |
| F6 | 13 | 698.46 | 0.00000 | 0.00000 | 0.00000 |
| F6#/G6b | 14 | 739.99 | 0.00000 | 0.00000 | 0.00000 |
| G7 | 15 | 783.99 | 0.00000 | 0.00000 | 0.00000 |
| G7#/A7b | 16 | 830.61 | 0.00000 | 0.00000 | 0.00000 |
| A7 | 17 | 880.00 | 0.00000 | 0.00000 | 0.00000 |
| A7#/B7b | 18 | 932.33 | 0.00000 | 0.00000 | 0.00000 |
| B7 | 19 | 987.77 | 0.00000 | 0.00000 | 0.00000 |
| C7 | 20 | 1046.50 | 0.00000 | 0.00000 | 0.00000 |
| C7#/D7b | 21 | 1108.73 | 0.00000 | 0.00000 | 0.00000 |

FIG.14

| Pitch Shift Amount(in semitones) | shift direction | $F_{SHIFT}$ |
|---|---|---|
| 24 | | 3.00000 |
| | | -0.75000 |
| 23 | up | 2.77550 |
| | down | -0.73513 |
| 22 | up | 2.56359 |
| | down | -0.71938 |
| 21 | up | 2.36359 |
| | down | -0.70270 |
| 20 | up | 2.17482 |
| | down | -0.68502 |
| 19 | up | 1.99664 |
| | down | -0.66629 |
| 18 | up | 1.82841 |
| | down | -0.64644 |
| 17 | up | 1.66968 |
| | down | -0.62542 |
| 16 | up | 1.51986 |
| | down | -0.60315 |
| 15 | up | 1.37841 |
| | down | -0.57955 |
| 14 | up | 1.24491 |
| | down | -0.55455 |
| 13 | up | 1.11891 |
| | down | -0.52806 |
| 12 | up | 2.00000 |
| | down | -0.50000 |
| 11 | up | 0.88775 |
| | down | -0.47027 |
| 10 | up | 0.78180 |
| | down | -0.43877 |
| 9 | up | 0.68180 |
| | down | -0.40540 |
| 8 | up | 0.58741 |
| | down | -0.37004 |
| 7 | up | 0.49832 |
| | down | -0.33259 |
| 6 | up | 0.41420 |
| | down | -0.29289 |
| 5 | up | 0.33484 |
| | down | -0.25085 |
| 4 | up | 0.25993 |
| | down | -0.20631 |
| 3 | up | 0.18920 |
| | down | -0.15910 |
| 2 | up | 0.12245 |
| | down | -0.10910 |
| 1 | up | 0.05945 |
| | down | -0.05612 |

FIG.15a Pitch Shift Table

| string | CAL[ ] | $F_R$ |
|---|---|---|
| E(6) | 5 | 82.41 |
| A(5) | 4 | 110.00 |
| D(4) | 3 | 146.83 |
| G(3) | 2 | 196.00 |
| B(2) | 1 | 246.94 |
| E(1) | 0 | 329.63 |

FIG.15b Calibration Table

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | 0.58741 |
| F3 | 1 | 87.31 | 0.00000 | 0.00000 | 0.58741 |
| F3#/G3b | 2 | 92.50 | 0.00000 | 0.00000 | 0.58741 |
| G3 | 3 | 98.00 | 0.00000 | 0.00000 | 0.58741 |
| G3#/A4b | 4 | 103.83 | 0.00000 | 0.00000 | 0.58741 |
| A4 | 5 | 110.00 | 0.00000 | 0.00000 | 0.58741 |
| A4#/B4b | 6 | 116.54 | 0.00000 | 0.00000 | 0.58741 |
| B4 | 7 | 123.47 | 0.00000 | 0.00000 | 0.58741 |
| C4 | 8 | 130.81 | 0.00000 | 0.00000 | 0.58741 |
| C4#/D4b | 9 | 138.59 | 0.00000 | 0.00000 | 0.58741 |
| D4 | 10 | 146.83 | 0.00000 | 0.00000 | 0.58741 |
| D4#/E4b | 11 | 155.56 | 0.00000 | 0.00000 | 0.58741 |
| E4 | 12 | 164.81 | 0.00000 | 0.00000 | 0.58741 |
| F4 | 13 | 174.61 | 0.00000 | 0.00000 | 0.58741 |
| F4#/G4b | 14 | 185.00 | 0.00000 | 0.00000 | 0.58741 |
| G4 | 15 | 196.00 | 0.00000 | 0.00000 | 0.58741 |
| G4#/A4b | 16 | 207.65 | 0.00000 | 0.00000 | 0.58741 |
| A5 | 17 | 220.00 | 0.00000 | 0.00000 | 0.58741 |
| A5#/B5b | 18 | 233.08 | 0.00000 | 0.00000 | 0.58741 |
| B5 | 19 | 246.94 | 0.00000 | 0.00000 | 0.58741 |
| C5 | 20 | 261.63 | 0.00000 | 0.00000 | 0.58741 |
| C5#/D5b | 21 | 277.18 | 0.00000 | 0.00000 | 0.58741 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | 0.58741 |
| A4#/B4b | 1 | 116.54 | 0.00000 | 0.00000 | 0.58741 |
| B4 | 2 | 123.47 | 0.00000 | 0.00000 | 0.58741 |
| C4 | 3 | 130.81 | 0.00000 | 0.00000 | 0.58741 |
| C4#/D4b | 4 | 138.59 | 0.00000 | 0.00000 | 0.58741 |
| D4 | 5 | 146.83 | 0.00000 | 0.00000 | 0.58741 |
| D4#/E4b | 6 | 155.56 | 0.00000 | 0.00000 | 0.58741 |
| E4 | 7 | 164.81 | 0.00000 | 0.00000 | 0.58741 |
| F4 | 8 | 174.61 | 0.00000 | 0.00000 | 0.58741 |
| F4#/G4b | 9 | 185.00 | 0.00000 | 0.00000 | 0.58741 |
| G4 | 10 | 196.00 | 0.00000 | 0.00000 | 0.58741 |
| G4#/A4b | 11 | 207.65 | 0.00000 | 0.00000 | 0.58741 |
| A5 | 12 | 220.00 | 0.00000 | 0.00000 | 0.58741 |
| A5#/B5b | 13 | 233.08 | 0.00000 | 0.00000 | 0.58741 |
| B5 | 14 | 246.94 | 0.00000 | 0.00000 | 0.58741 |
| C5 | 15 | 261.63 | 0.00000 | 0.00000 | 0.58741 |
| C5#/D5b | 16 | 277.18 | 0.00000 | 0.00000 | 0.58741 |
| D5 | 17 | 293.66 | 0.00000 | 0.00000 | 0.58741 |
| D5#/E5b | 18 | 311.13 | 0.00000 | 0.00000 | 0.58741 |
| E5 | 19 | 329.63 | 0.00000 | 0.00000 | 0.58741 |
| F5 | 20 | 349.23 | 0.00000 | 0.00000 | 0.58741 |
| F5#/G5b | 21 | 369.99 | 0.00000 | 0.00000 | 0.58741 |

| D(4) string | TBL[3] | $F_R$ | $F_C$ | $F_{MOD}$ | $F_{SHIFT}$ |
|---|---|---|---|---|---|
| Note Name* | Fret Position* | 0 | 1 | 2 | 3 |
| D4 | 0 | 146.83 | -0.01000 | 0.00000 | 0.58741 |
| D4#/E4b | 1 | 155.56 | 0.00000 | 0.00000 | 0.58741 |
| E4 | 2 | 164.81 | 0.00000 | 0.00000 | 0.58741 |
| F4 | 3 | 174.61 | 0.00000 | 0.00000 | 0.58741 |
| F4#/G4b | 4 | 185.00 | 0.00000 | 0.00000 | 0.58741 |
| G4 | 5 | 196.00 | 0.00000 | 0.00000 | 0.58741 |
| G4#/A4b | 6 | 207.65 | 0.00000 | 0.00000 | 0.58741 |
| A5 | 7 | 220.00 | 0.00000 | 0.00000 | 0.58741 |
| A5#/B5b | 8 | 233.08 | 0.00000 | 0.00000 | 0.58741 |
| B5 | 9 | 246.94 | 0.00000 | 0.00000 | 0.58741 |
| C5 | 10 | 261.63 | 0.00000 | 0.00000 | 0.58741 |
| C5#/D5b | 11 | 277.18 | 0.00000 | 0.00000 | 0.58741 |
| D5 | 12 | 293.66 | 0.00000 | 0.00000 | 0.58741 |
| D5#/E5b | 13 | 311.13 | 0.00000 | 0.00000 | 0.58741 |
| E5 | 14 | 329.63 | 0.00000 | 0.00000 | 0.58741 |
| F5 | 15 | 349.23 | 0.00000 | 0.00000 | 0.58741 |
| F5#/G5b | 16 | 369.99 | 0.00000 | 0.00000 | 0.58741 |
| G5 | 17 | 392.00 | 0.00000 | 0.00000 | 0.58741 |
| G5#/A5b | 18 | 415.30 | 0.00000 | 0.00000 | 0.58741 |
| A6 | 19 | 440.00 | 0.00000 | 0.00000 | 0.58741 |
| A6#/B6b | 20 | 466.16 | 0.00000 | 0.00000 | 0.58741 |
| B6 | 21 | 493.88 | 0.00000 | 0.00000 | 0.58741 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | 0.58741 |
| G4#/A4b | 1 | 207.65 | 0.00000 | 0.00000 | 0.58741 |
| A5 | 2 | 220.00 | 0.00000 | 0.00000 | 0.58741 |
| A5#/B5b | 3 | 233.08 | 0.00000 | 0.00000 | 0.58741 |
| B5 | 4 | 246.94 | 0.00000 | 0.00000 | 0.58741 |
| C5 | 5 | 261.63 | 0.00000 | 0.00000 | 0.58741 |
| C5#/D5b | 6 | 277.18 | 0.00000 | 0.00000 | 0.58741 |
| D5 | 7 | 293.66 | 0.00000 | 0.00000 | 0.58741 |
| D5#/E5b | 8 | 311.13 | 0.00000 | 0.00000 | 0.58741 |
| E5 | 9 | 329.63 | 0.00000 | 0.00000 | 0.58741 |
| F5 | 10 | 349.23 | 0.00000 | 0.00000 | 0.58741 |
| F5#/G5b | 11 | 369.99 | 0.00000 | 0.00000 | 0.58741 |
| G5 | 12 | 392.00 | 0.00000 | 0.00000 | 0.58741 |
| G5#/A5b | 13 | 415.30 | 0.00000 | 0.00000 | 0.58741 |
| A6 | 14 | 440.00 | 0.00000 | 0.00000 | 0.58741 |
| A6#/B6b | 15 | 466.16 | 0.00000 | 0.00000 | 0.58741 |
| B6 | 16 | 493.88 | 0.00000 | 0.00000 | 0.58741 |
| C6 | 17 | 523.25 | 0.00000 | 0.00000 | 0.58741 |
| C6#/D6b | 18 | 554.37 | 0.00000 | 0.00000 | 0.58741 |
| D6 | 19 | 587.33 | 0.00000 | 0.00000 | 0.58741 |
| D6#/E6b | 20 | 622.25 | 0.00000 | 0.00000 | 0.58741 |
| E6 | 21 | 659.26 | 0.00000 | 0.00000 | 0.58741 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | 0.58741 |
| C5 | 1 | 261.63 | 0.00000 | 0.00000 | 0.58741 |
| C5#/D5b | 2 | 277.18 | 0.00000 | 0.00000 | 0.58741 |
| D5 | 3 | 293.66 | 0.00000 | 0.00000 | 0.58741 |
| D5#/E5b | 4 | 311.13 | 0.00000 | 0.00000 | 0.58741 |
| E5 | 5 | 329.63 | 0.00000 | 0.00000 | 0.58741 |
| F5 | 6 | 349.23 | 0.00000 | 0.00000 | 0.58741 |
| F5#/G5b | 7 | 369.99 | 0.00000 | 0.00000 | 0.58741 |
| G5 | 8 | 392.00 | 0.00000 | 0.00000 | 0.58741 |
| G5#/A5b | 9 | 415.30 | 0.00000 | 0.00000 | 0.58741 |
| A6 | 10 | 440.00 | 0.00000 | 0.00000 | 0.58741 |
| A6#/B6b | 11 | 466.16 | 0.00000 | 0.00000 | 0.58741 |
| B6 | 12 | 493.88 | 0.00000 | 0.00000 | 0.58741 |
| C6 | 13 | 523.25 | 0.00000 | 0.00000 | 0.58741 |
| C6#/D6b | 14 | 554.37 | 0.00000 | 0.00000 | 0.58741 |
| D6 | 15 | 587.33 | 0.00000 | 0.00000 | 0.58741 |
| D6#/E6b | 16 | 622.25 | 0.00000 | 0.00000 | 0.58741 |
| E6 | 17 | 659.26 | 0.00000 | 0.00000 | 0.58741 |
| F6 | 18 | 698.46 | 0.00000 | 0.00000 | 0.58741 |
| F6#/G6b | 19 | 739.99 | 0.00000 | 0.00000 | 0.58741 |
| G7 | 20 | 783.99 | 0.00000 | 0.00000 | 0.58741 |
| G7#/A7b | 21 | 830.61 | 0.00000 | 0.00000 | 0.58741 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | 0.58741 |
| F5 | 1 | 349.23 | 0.00000 | 0.00000 | 0.58741 |
| F5#/G5b | 2 | 369.99 | 0.00000 | 0.00000 | 0.58741 |
| G5 | 3 | 392.00 | 0.00000 | 0.00000 | 0.58741 |
| G5#/A5b | 4 | 415.30 | 0.00000 | 0.00000 | 0.58741 |
| A6 | 5 | 440.00 | 0.00000 | 0.00000 | 0.58741 |
| A6#/B6b | 6 | 466.16 | 0.00000 | 0.00000 | 0.58741 |
| B6 | 7 | 493.88 | 0.00000 | 0.00000 | 0.58741 |
| C6 | 8 | 523.25 | 0.00000 | 0.00000 | 0.58741 |
| C6#/D6b | 9 | 554.37 | 0.00000 | 0.00000 | 0.58741 |
| D6 | 10 | 587.33 | 0.00000 | 0.00000 | 0.58741 |
| D6#/E6b | 11 | 622.25 | 0.00000 | 0.00000 | 0.58741 |
| E6 | 12 | 659.26 | 0.00000 | 0.00000 | 0.58741 |
| F6 | 13 | 698.46 | 0.00000 | 0.00000 | 0.58741 |
| F6#/G6b | 14 | 739.99 | 0.00000 | 0.00000 | 0.58741 |
| G7 | 15 | 783.99 | 0.00000 | 0.00000 | 0.58741 |
| G7#/A7b | 16 | 830.61 | 0.00000 | 0.00000 | 0.58741 |
| A7 | 17 | 880.00 | 0.00000 | 0.00000 | 0.58741 |
| A7#/B7b | 18 | 932.33 | 0.00000 | 0.00000 | 0.58741 |
| B7 | 19 | 987.77 | 0.00000 | 0.00000 | 0.58741 |
| C7 | 20 | 1046.50 | 0.00000 | 0.00000 | 0.58741 |
| C7#/D7b | 21 | 1108.73 | 0.00000 | 0.00000 | 0.58741 |

FIG.16

| E(6) string | TBL[5] | $F_R$ | $F_C$ | $F_{MOD}$ | $F_{SHIFT}$ |
|---|---|---|---|---|---|
| Note Name* | Fret Position* | 0 | 1 | 2 | 3 |
| E3 | 0 | 82.41 | 0.02000 | 0.00000 | 0.00000 |
| F3 | 1 | 87.31 | 0.00000 | 0.00197 | 0.00000 |
| F3#/G3b | 2 | 92.50 | 0.00000 | 0.00395 | 0.00000 |
| G3 | 3 | 98.00 | 0.00000 | 0.00592 | 0.00000 |
| G3#/A4b | 4 | 103.83 | 0.00000 | 0.00790 | 0.00000 |
| A4 | 5 | 110.00 | 0.00000 | 0.00987 | 0.00000 |
| A4#/B4b | 6 | 116.54 | 0.00000 | 0.01185 | 0.00000 |
| B4 | 7 | 123.47 | 0.00000 | 0.01382 | 0.00000 |
| C4 | 8 | 130.81 | 0.00000 | 0.01580 | 0.00000 |
| C4#/D4b | 9 | 138.59 | 0.00000 | 0.01777 | 0.00000 |
| D4 | 10 | 146.83 | 0.00000 | 0.01975 | 0.00000 |
| D4#/E4b | 11 | 155.56 | 0.00000 | 0.02172 | 0.00000 |
| E4 | 12 | 164.81 | 0.00000 | 0.02369 | 0.00000 |
| F4 | 13 | 174.61 | 0.00000 | 0.02567 | 0.00000 |
| F4#/G4b | 14 | 185.00 | 0.00000 | 0.02764 | 0.00000 |
| G4 | 15 | 196.00 | 0.00000 | 0.02962 | 0.00000 |
| G4#/A4b | 16 | 207.65 | 0.00000 | 0.03159 | 0.00000 |
| A5 | 17 | 220.00 | 0.00000 | 0.03357 | 0.00000 |
| A5#/B5b | 18 | 233.08 | 0.00000 | 0.03554 | 0.00000 |
| B5 | 19 | 246.94 | 0.00000 | 0.03752 | 0.00000 |
| C5 | 20 | 261.63 | 0.00000 | 0.03949 | 0.00000 |
| C5#/D5b | 21 | 277.18 | 0.00000 | 0.04147 | 0.00000 |

| A(5) string | TBL[4] | $F_R$ | $F_C$ | $F_{MOD}$ | $F_{SHIFT}$ |
|---|---|---|---|---|---|
| Note Name* | Fret Position* | 0 | 1 | 2 | 3 |
| A4 | 0 | 110.00 | 0.02400 | 0.00000 | 0.00000 |
| A4#/B4b | 1 | 116.54 | 0.00000 | 0.00221 | 0.00000 |
| B4 | 2 | 123.47 | 0.00000 | 0.00442 | 0.00000 |
| C4 | 3 | 130.81 | 0.00000 | 0.00664 | 0.00000 |
| C4#/D4b | 4 | 138.59 | 0.00000 | 0.00885 | 0.00000 |
| D4 | 5 | 146.83 | 0.00000 | 0.01106 | 0.00000 |
| D4#/E4b | 6 | 155.56 | 0.00000 | 0.01327 | 0.00000 |
| E4 | 7 | 164.81 | 0.00000 | 0.01549 | 0.00000 |
| F4 | 8 | 174.61 | 0.00000 | 0.01770 | 0.00000 |
| F4#/G4b | 9 | 185.00 | 0.00000 | 0.01991 | 0.00000 |
| G4 | 10 | 196.00 | 0.00000 | 0.02212 | 0.00000 |
| G4#/A4b | 11 | 207.65 | 0.00000 | 0.02434 | 0.00000 |
| A5 | 12 | 220.00 | 0.00000 | 0.02655 | 0.00000 |
| A5#/B5b | 13 | 233.08 | 0.00000 | 0.02876 | 0.00000 |
| B5 | 14 | 246.94 | 0.00000 | 0.03097 | 0.00000 |
| C5 | 15 | 261.63 | 0.00000 | 0.03319 | 0.00000 |
| C5#/D5b | 16 | 277.18 | 0.00000 | 0.03540 | 0.00000 |
| D5 | 17 | 293.66 | 0.00000 | 0.03761 | 0.00000 |
| D5#/E5b | 18 | 311.13 | 0.00000 | 0.03982 | 0.00000 |
| E5 | 19 | 329.63 | 0.00000 | 0.04204 | 0.00000 |
| F5 | 20 | 349.23 | 0.00000 | 0.04425 | 0.00000 |
| F5#/G5b | 21 | 369.99 | 0.00000 | 0.04646 | 0.00000 |

| D(4) string | TBL[3] | $F_R$ | $F_C$ | $F_{MOD}$ | $F_{SHIFT}$ |
|---|---|---|---|---|---|
| Note Name* | Fret Position* | $F_R$ | $F_C$ | $F_{MOD}$ | $F_{SHIFT}$ |
| D4 | 0 | 146.83 | 0.01000 | 0.00000 | 0.00000 |
| D4#/E4b | 1 | 155.56 | 0.00000 | -0.00355 | 0.00000 |
| E4 | 2 | 164.81 | 0.00000 | -0.00710 | 0.00000 |
| F4 | 3 | 174.61 | 0.00000 | -0.01065 | 0.00000 |
| F4#/G4b | 4 | 185.00 | 0.00000 | -0.01420 | 0.00000 |
| G4 | 5 | 196.00 | 0.00000 | -0.01775 | 0.00000 |
| G4#/A4b | 6 | 207.65 | 0.00000 | -0.02130 | 0.00000 |
| A5 | 7 | 220.00 | 0.00000 | -0.02485 | 0.00000 |
| A5#/B5b | 8 | 233.08 | 0.00000 | -0.02840 | 0.00000 |
| B5 | 9 | 246.94 | 0.00000 | -0.03195 | 0.00000 |
| C5 | 10 | 261.63 | 0.00000 | -0.03550 | 0.00000 |
| C5#/D5b | 11 | 277.18 | 0.00000 | -0.03905 | 0.00000 |
| D5 | 12 | 293.66 | 0.00000 | -0.04260 | 0.00000 |
| D5#/E5b | 13 | 311.13 | 0.00000 | -0.04615 | 0.00000 |
| E5 | 14 | 329.63 | 0.00000 | -0.04970 | 0.00000 |
| F5 | 15 | 349.23 | 0.00000 | -0.05325 | 0.00000 |
| F5#/G5b | 16 | 369.99 | 0.00000 | -0.05681 | 0.00000 |
| G5 | 17 | 392.00 | 0.00000 | -0.06036 | 0.00000 |
| G5#/A5b | 18 | 415.30 | 0.00000 | -0.06391 | 0.00000 |
| A6 | 19 | 440.00 | 0.00000 | -0.06746 | 0.00000 |
| A6#/B6b | 20 | 466.16 | 0.00000 | -0.07101 | 0.00000 |
| B6 | 21 | 493.88 | 0.00000 | -0.07456 | 0.00000 |

| G(3) string | TBL[2] | $F_R$ | $F_C$ | $F_{MOD}$ | $F_{SHIFT}$ |
|---|---|---|---|---|---|
| Note Name* | Fret Position* | 0 | 1 | 2 | 3 |
| G4 | 0 | 196.00 | 0.00340 | 0.00000 | 0.00000 |
| G4#/A4b | 1 | 207.65 | 0.00000 | -0.00332 | 0.00000 |
| A5 | 2 | 220.00 | 0.00000 | -0.00663 | 0.00000 |
| A5#/B5b | 3 | 233.08 | 0.00000 | -0.00995 | 0.00000 |
| B5 | 4 | 246.94 | 0.00000 | -0.01326 | 0.00000 |
| C5 | 5 | 261.63 | 0.00000 | -0.01658 | 0.00000 |
| C5#/D5b | 6 | 277.18 | 0.00000 | -0.01989 | 0.00000 |
| D5 | 7 | 293.66 | 0.00000 | -0.02321 | 0.00000 |
| D5#/E5b | 8 | 311.13 | 0.00000 | -0.02653 | 0.00000 |
| E5 | 9 | 329.63 | 0.00000 | -0.02984 | 0.00000 |
| F5 | 10 | 349.23 | 0.00000 | -0.03316 | 0.00000 |
| F5#/G5b | 11 | 369.99 | 0.00000 | -0.03647 | 0.00000 |
| G5 | 12 | 392.00 | 0.00000 | -0.03979 | 0.00000 |
| G5#/A5b | 13 | 415.30 | 0.00000 | -0.04310 | 0.00000 |
| A6 | 14 | 440.00 | 0.00000 | -0.04642 | 0.00000 |
| A6#/B6b | 15 | 466.16 | 0.00000 | -0.04974 | 0.00000 |
| B6 | 16 | 493.88 | 0.00000 | -0.05305 | 0.00000 |
| C6 | 17 | 523.25 | 0.00000 | -0.05637 | 0.00000 |
| C6#/D6b | 18 | 554.37 | 0.00000 | -0.05968 | 0.00000 |
| D6 | 19 | 587.33 | 0.00000 | -0.06300 | 0.00000 |
| D6#/E6b | 20 | 622.25 | 0.00000 | -0.06631 | 0.00000 |
| E6 | 21 | 659.26 | 0.00000 | -0.06963 | 0.00000 |

| B(2) string | TBL[1] | $F_R$ | $F_C$ | $F_{MOD}$ | $F_{SHIFT}$ |
|---|---|---|---|---|---|
| Note Name* | Fret Position* | 0 | 1 | 2 | 3 |
| B5 | 0 | 246.94 | 0.00760 | 0.00000 | 0.00000 |
| C5 | 1 | 261.63 | 0.00000 | -0.00172 | 0.00000 |
| C5#/D5b | 2 | 277.18 | 0.00000 | -0.00344 | 0.00000 |
| D5 | 3 | 293.66 | 0.00000 | -0.00517 | 0.00000 |
| D5#/E5b | 4 | 311.13 | 0.00000 | -0.00689 | 0.00000 |
| E5 | 5 | 329.63 | 0.00000 | -0.00861 | 0.00000 |
| F5 | 6 | 349.23 | 0.00000 | -0.01033 | 0.00000 |
| F5#/G5b | 7 | 369.99 | 0.00000 | -0.01206 | 0.00000 |
| G5 | 8 | 392.00 | 0.00000 | -0.01378 | 0.00000 |
| G5#/A5b | 9 | 415.30 | 0.00000 | -0.01550 | 0.00000 |
| A6 | 10 | 440.00 | 0.00000 | -0.01722 | 0.00000 |
| A6#/B6b | 11 | 466.16 | 0.00000 | -0.01894 | 0.00000 |
| B6 | 12 | 493.88 | 0.00000 | -0.02067 | 0.00000 |
| C6 | 13 | 523.25 | 0.00000 | -0.02239 | 0.00000 |
| C6#/D6b | 14 | 554.37 | 0.00000 | -0.02411 | 0.00000 |
| D6 | 15 | 587.33 | 0.00000 | -0.02583 | 0.00000 |
| D6#/E6b | 16 | 622.25 | 0.00000 | -0.02755 | 0.00000 |
| E6 | 17 | 659.26 | 0.00000 | -0.02928 | 0.00000 |
| F6 | 18 | 698.46 | 0.00000 | -0.03100 | 0.00000 |
| F6#/G6b | 19 | 739.99 | 0.00000 | -0.03272 | 0.00000 |
| G7 | 20 | 783.99 | 0.00000 | -0.03444 | 0.00000 |
| G7#/A7b | 21 | 830.61 | 0.00000 | -0.03617 | 0.00000 |

| E(1) string | TBL[0] | $F_R$ | $F_C$ | $F_{MOD}$ | $F_{SHIFT}$ |
|---|---|---|---|---|---|
| Note Name* | Fret Position* | 0 | 1 | 2 | 3 |
| E5 | 0 | 329.63 | 0.00539 | 0.00000 | 0.00000 |
| F5 | 1 | 349.23 | 0.00000 | 0.00477 | 0.00000 |
| F5#/G5b | 2 | 369.99 | 0.00000 | 0.00953 | 0.00000 |
| G5 | 3 | 392.00 | 0.00000 | 0.01430 | 0.00000 |
| G5#/A5b | 4 | 415.30 | 0.00000 | 0.01907 | 0.00000 |
| A6 | 5 | 440.00 | 0.00000 | 0.02383 | 0.00000 |
| A6#/B6b | 6 | 466.16 | 0.00000 | 0.02860 | 0.00000 |
| B6 | 7 | 493.88 | 0.00000 | 0.03337 | 0.00000 |
| C6 | 8 | 523.25 | 0.00000 | 0.03814 | 0.00000 |
| C6#/D6b | 9 | 554.37 | 0.00000 | 0.04290 | 0.00000 |
| D6 | 10 | 587.33 | 0.00000 | 0.04767 | 0.00000 |
| D6#/E6b | 11 | 622.25 | 0.00000 | 0.05244 | 0.00000 |
| E6 | 12 | 659.26 | 0.00000 | 0.05720 | 0.00000 |
| F6 | 13 | 698.46 | 0.00000 | 0.06197 | 0.00000 |
| F6#/G6b | 14 | 739.99 | 0.00000 | 0.06674 | 0.00000 |
| G7 | 15 | 783.99 | 0.00000 | 0.07150 | 0.00000 |
| G7#/A7b | 16 | 830.61 | 0.00000 | 0.07627 | 0.00000 |
| A7 | 17 | 880.00 | 0.00000 | 0.08104 | 0.00000 |
| A7#/B7b | 18 | 932.33 | 0.00000 | 0.08581 | 0.00000 |
| B7 | 19 | 987.77 | 0.00000 | 0.09057 | 0.00000 |
| C7 | 20 | 1046.50 | 0.00000 | 0.09534 | 0.00000 |
| C7#/D7b | 21 | 1108.73 | 0.00000 | 0.10011 | 0.00000 |

FIG.17

AUTOMATIC PITCH PROCESSING FOR ELECTRIC STRINGED INSTRUMENTS

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Field of the Invention

This invention relates to electrified stringed musical instruments such as electric guitars, electric basses, electric pedal steel guitars, and electric violins.

2. Background of the Invention

A fundamental fact of all stringed instruments is that the strings need to be tuned to some reference pitch to produce coherent and pleasing music. For example, the accepted standard reference pitch of a 6-string guitar specifies tuning the strings to correspond with the notes E, A, D, G, B, and E corresponding to the frequencies 82.41 Hz, 110 Hz, 146.83 Hz, 196.00 Hz, 246.94 Hz, 329.63 Hz respectively. To avoid ambiguity in identifying the-strings of a guitar used in the discussion to follow, a dual nomenclature will be used of the form E(6), A(5), D(4), G(3), B(2), and E(1), where the E(6) string is the lowest pitched string, and E(1) is the highest pitched string.

Pitch drift is a problem that plagues all stringed instruments. There are many variables that affect the instrument's ability to maintain pitch over time. The unintended consequence is that the strings drift out of a state of tune. Key factors that conspire and contribute to pitch drift include variations in temperature and humidity, the materials, design, and assembly techniques used in the instrument's construction, the mechanical containment and tuning system employed, the string quality and age, and the musician's playing technique. For hundreds of years, tuning the instrument has always been accepted as routine maintenance.

Instrument builders and manufacturers continue to be challenged to create instruments that can reliably maintain their pitch. There is a tradeoff of manufacturing costs versus pitch stability. At one extreme, exotic materials and careful construction can be employed. For example, an instrument made of carbon fiber materials, precision mechanical tuners, and very high quality strings may have very good pitch stability when compared to lesser instruments. However, the price such an instrument would command would place it out of reach of most musicians. Unfortunately, it would still suffer pitch drift which can be reduced, but not eliminated. Mechanical tuning systems just cannot be made to maintain pitch over time without human interaction and correction. At the other extreme, it's a given that less expensive instruments drift more easily and require more frequent tuning adjustments.

In addition to pitch drift, another unintentional pitch problem occurs simply because some musicians are less adept than others at tuning their instrument. This is especially true if they rely on their ears alone for the tuning procedure rather than using an electronic tuning aid. Patience plays a factor. More time and effort expended on the tuning procedure usually produces better results.

Temperament is a specification for the note pitches an instrument should produce. Intonation is a measure of how well the instrument actually produces them. The instrument maker designs and fabricates the instrument to accurately produce pleasing note intervals of the chosen temperament, hoping that his efforts produce an instrument with good intonation. Attention to detail in the design phase, and good control of manufacturing tolerances typically produces an instrument capable of accurate intonation. A poorly designed and manufactured instrument may not be capable of accurate intonation due to sloppy workmanship.

Guitars and basses are designed to produce notes of the Equal Tempered chromatic scale. The nut 200 (FIG. 8), frets 201–222, and bridge saddles 872 are components of most fretted stringed instruments. These components are arranged such that the pitch of each note will be equidistant from the pitch of adjacent notes within the Equal Tempered scale. Going from one note to the next higher note, an interval of a semitone, increases the pitch by 5.95 percent.

The basic design of most fretted instruments makes slight compromises in intonation for simplicity of design. Guitars and basses use the "Rule of 18" to position the nut, frets and bridge saddles in appropriate relationships to produce reasonable Equal Temperament. This technique is not perfect. To quote from U.S. Pat. No. 5,404,783 Feiten, et al. (1995): "Unfortunately, this system is inherently deficient in that it does not result in perfect intonation. As one author stated: "Indeed, you can drive yourself batty trying to make the intonation perfect at every single fret. It'll simply never happen. Why? Remember what we said about the Rule of 18 and the fudging that goes on to make fret replacement come out right? That's why. Frets, by definition, are a bit of compromise, Roger Sadowsky observes. Even assuming you have your instrument professionally intonated and as perfect as it can be, your first three frets will always be a little sharp. The middle register—the 4th through the 10th frets—tends to be a little flat. The octave area tends to be accurate and the upper register tends to be either flat or sharp; your ear really can't tell the difference. That's normal for a perfectly intonated guitar." (See The Whole Guitar Book, "The Big Setup," Alan di Perna, p.17, Musician 1990."

Intonation compensation is performed by precisely moving the bridge saddle to adjust the physical length of the vibrating portion of the string. This fine adjustment is performed as a normal setup procedure when an instrument is new. Readjustment is required over time due to many of the same environmental factors that cause pitch drift. Readjustment is also required when strings are replaced on the instrument and when other mechanical adjustments, such as a change of string height relative to the frets and fret board, occur.

Thus, common stringed instruments are a compromise between the relationships of the mechanical elements (nut, frets, and bridge saddles) plus fine mechanical adjustment to attain intonation accuracy for the specified pitch temperament.

To summarize the previous discussion on intonation and temperament, we will distinguish the three key concepts outlined above, as they will be addressed separately by the present invention:

1. Choice of temperament: There are multiple temperaments that can be used with stringed instruments. The most common are Equal Temperament, Just Temperament, and Well Temperament. Guitars, banjos, and basses commonly use Equal Temperament. Pianos commonly use Well Temperament. Just Temperament is less commonly used. There are times when the musician may want to manually alter the instrument to change pitch temperament.

2. Inherent limitations of intonation accuracy: A given instrument, even when perfectly adjusted for intonation, may still deviate from its target temperament because the instrument design was somewhat compromised to begin with. The variability of manufacturing tolerances also contributes to this problem.

3. Intonation adjustment: A given instrument may require readjustment for intonation within the temperament specification the instrument was designed for. Readjustment is necessary due to numerous environmental and mechanical factors. Intonation adjustment is considered a normal maintenance procedure.

Altered tunings are intentional pitch changes employed to perform certain musical pieces, or styles. Altered tunings may also be a preference of the musician based on musical technique and/or playing comfort. For instance, "dropped-D" tuning is commonly used with guitar, when the E(6) string is lowered two semitones to D. Another common guitar tuning is "open G" where the strings E(6) through E(1) are retuned to D-G-D-G-B-D respectively. A performing guitarist who uses altered tunings will typically employ multiple guitars, each tuned to an altered tuning pattern to avoid the inconvenience of retuning a single instrument during a performance.

Unfortunately, using an altered tuning can radically alter the string tension. On instruments with necks (guitars, basses, banjos, etc.) this changes the neck curvature and the relief of the strings to the fret board and frets, also referred to as the "action". This can make the instrument more difficult to play, and can increase intonation error. To avoid this, instruments are typically adjusted appropriately for their altered tuning and kept that way. This is another reason many musicians employ multiple instruments in a performance, each setup for a different altered tuning.

A capo is a mechanical pitch altering device typically used on a guitar or banjo to temporarily raise the open unfretted position of play further up the fret board. A capo is shown as 860(FIG. 8) placed just behind the eighth fret 208.

A capo can produce a couple of unintentional side effects. A capo may force the instrument out of tune, as the tension on the strings may be affected depending on:

a) how tight or loose the capo is clamped onto the neck,
b) the capo's proximity and alignment to the target fret, and
c) how far up the fret board the capo is placed.

A capo used on an instrument that has an intonation problem tends to amplify the problem because intonation error increases the further up the neck one plays. Thus, a capo can be a blessing and a curse for the musician.

Other types of mechanical pitch altering devices include bridge tremolo/vibrato units and "B-benders" for rapid pitch bend effects. Hipshot bass detuners and similar pitch altering devices are used to temporarily pitch alter one or more strings. These devices are unreliable in restoring the instrument to a state of tune after use. Tremolo/vibrato units are especially problematic in this regard. The tremolo/vibrato unit shown in 870(FIG. 8) employs a moveable bridge that typically pivots on a fulcrum and use springs to maintain string tension. The musician applies pressure to a lever 874 to momentarily bend string pitch up or down. Pitch bending devices also add considerable cost to the instrument due to the additional parts, complexities, and labor involved. Once again, this type of device can be both a blessing and a curse.

Another deliberate pitch alteration occurs when a musician tunes the instrument to a higher or lower pitch to reduce or increase the string tension. Many guitarists flatten or lower the pitch of their guitars a semitone or more to reduce the string tension slightly to improve comfort and playability. Some believe it increases volume as well. A common detuning for guitar is a half-step or semitone detuning which changes string pitch to Eb, Ab, Db, Gb, Bb, and Eb.

Numerous patents address tuning improvements to conventional guitars and related stringed instruments in the mechanical domain using bearings, improved bridge designs, improved tremolo/vibrato mechanisms and so on. However, the patents listed below do not embody the novelty, scope or the key concepts of the present invention:

U.S. Pat. No. 6,175,066 McCabe (2001)
U.S. Pat. No. 6,143,967 Smith, et al. (2000)
U.S. Pat. No. 5,986,190 Wolff, et al.(1990)
U.S. Pat. No. 5,602,353 Juszkiewicz, et al. (1997)
U.S. Pat. No. 4,899,634 Geiger (1990)
U.S. Pat. No. 4,426,907 Scholz (1984)
U.S. Pat. No. 4,383,466 Shiboya (1983)
U.S. Pat. No. 4,171,661 Rose (1979)

Patents describing automatic tuning systems, as listed below, use electromechanical devices incorporating motors and gears or other electromechanical means to maintain pitch. A processing unit senses the string pitch in a closed-feedback system and adjusts the tension on the string using an electromechanical actuator of some type.

U.S. Pat. No. 6,437,226 Oudshoorn, et al. (2002)
U.S. Pat. No. 6,415,584 Whittall, et al. (2002)
U.S. Pat. No. 6,184,452 Long (2001)
U.S. Pat. No. 5,886,270 Wynn (1999)
U.S. Pat. No. 5,824,929 Freeland, et al. (1998)
U.S. Pat. No. 5,808,218 Grace (1998)
U.S. Pat. No. 5,767,429 Milano, et al. (1998)
U.S. Pat. No. 5,760,321 Seabert (1998)
U.S. Pat. No. 5,528,970 Zacaroli (1996)
U.S. Pat. No. 5,343,793 Pattie (1994)
U.S. Pat. No. 5,095,797 Zacaroli (1992)
U.S. Pat. No. 5,038,657 Busley (1991)
U.S. Pat. No. 5,009,142 Kurtz (1991)
U.S. Pat. No. 4,909,126 Skinn, et al. (1990)
U.S. Pat. No. 4,803,908 Skinn, et al. (1989)
U.S. Pat. No. 4,375,180 Scholz (1983)
U.S. Pat. No. 4,088,052 Hedrick (1978)
U.S. Pat. No. 4,044,239 Shumachi, et al. (1977)

Electromechanical tuning systems suffer from several major drawbacks:

a) These systems are costly, adding hundreds of dollars to the manufacturing cost of an instrument.
b) They add mechanical complexity and weight to the instrument. There are many components that may reduce reliability of the instrument due to age, wear, and possibly neglected maintenance.
c) These systems require substantial power to operate. Large capacity batteries with their weight penalty are needed if using an onboard power supply. More typically, external power supplies are required due to the demanding power requirements.
d) These systems do not work well for applying rapid pitch alterations as they are slow to react, and may throw the instrument out of adjustment when the string tension becomes radically altered. Radical string tension alterations change the "action". This usually makes the instrument more difficult to play, and has a negative effect on intonation accuracy as well.
e) These systems do not compensate for intonation error.

f) When applied to traditionally styled conventional instruments, these systems fundamentally alter the appearance, sound, and aesthetic appeal of these instruments.

g) These systems require additional maintenance and adjustment, usually by a trained professional thereby increasing the overall cost of ownership of the instrument.

Several commercial products are available that implement automatic mechanical tuning of the types described by this body of work, but due to high costs, complexity, and demanding power requirements, they have not attained mass market status and instead serve a niche for certain discriminating musicians.

In U.S. Pat. No. 5,973,252 Hildebrand (1999) describes an improved method for pitch correcting a single audio signal generated from musical instruments or from the human voice using a microphone. However, the scope of Hildebrand does not address pitch altering a stringed instrument with a plurality of strings as his invention does not process a plurality of audio signals in parallel. This would be required to alter pitch for multiple strings. It does not address intonation compensation in the context of a stringed instrument. It does not address the needs and requirements of the musical performance where a musician may intentionally change the pitch of the instrument for purposes of detuning the strings, and applying alternate tunings and temperaments. The Hildebrand invention also does not include in its scope the ability to be integrated into and become part of the instrument itself with the many advantages that may result. This patent does not embody the novelty, scope or the key concepts of the present invention.

A body of work exists that addresses methods of improving intonation and applying temperament adjustments. In U.S. Pat. No. 6,426,454 Gregory (2002) describes a mechanical redesign of guitars, basses, cellos, etc. to use the "Penta" tuning system where the instrument's strings are tuned in intervals of fifths rather than intervals of fourths as in conventional guitars, basses and cellos. While interesting, this invention and the instruments designed using the Penta tuning system are unconventional and would require a musician to learn a completely new instrument with the Penta tuning and have him play with other musicians using Penta instruments and music. This is a rather draconian principle and impractical when implemented in the real world.

In U.S. Pat. No. 5,501,130 Gannon, et al. (1996) and U.S. Pat. No. 5,442,129 Mohrlok, et al. (1995) describe methods to apply "Just" temperament pitch analysis to a keyboard instrument performance. This body of work does not address issues of handling stringed instruments with a plurality of strings. Nor does it address stringed instrument pitch alteration for pitch drift, intonation compensation, pitch shifting, pitch bending, and alternate tunings.

In U.S. Pat. No. 5,404,783 (1995), U.S. Pat. No. 5,600,079 (1997), U.S. Pat. No. 5,728,956 (1998), U.S. Pat. No. 5,814,745 (1998), U.S. Pat. No. 5,955,689 (1999), U.S. Pat. No. 6,143,966 (2000), and U.S. Pat. No. 6,359,202 (2002) Feiten, et al. describe improvements to fret, nut, and bridge dimensional relationships and adjustments to the "Rule of 18" that is typically used in designing fretted guitars and basses. The result is series of temperament profiles to slightly alter the tuning of guitars and basses to make more pleasing notes. However, Feiten's invention requires alterations to a conventional guitar by adjusting the placement of the nut to a minor degree from the convention of the "Rule of 18" plus requiring subtle pitch changes to alter the temperament. How well manufacturers and musicians will accept this change has not yet been proven. However, it is unlikely that this invention will cause abandonment of instrument design parameters used for hundreds of years of guitar building.

In U.S. Pat. No. 6,359,202 (2002) Feiten describes the "Feiten Tuning Tables" which defines different sets of correction values to correct intonation for acoustic guitars, nylon stringed guitars, and steel-stringed acoustic guitars, and basses. As will become evident later, a clever engineer can apply the "Feiten Tuning Tables" to an application of the present invention.

However, the Feiten and Gannon patents discussed above do not embody the novelty, scope or the key concepts of the present invention.

A body of work encompasses pitch correction in the context of an automated music performance applicable to karaoke machines, keyboard instruments, MIDI sequencers, and "Band in a Box" computer accompaniment software. These inventions do not address the pitch problems inherent in stringed musical instruments. These inventions do not embody the novelty, scope or key concepts of the present invention:

U.S. Pat. No. 6,326,538 Kay (2001)
U.S. Pat. No. 6,166,307 Caulkins (2000)
U.S. Pat. No. 6,121,533 Kay (2000)
U.S. Pat. No. 6,121,532 Kay (2000)
U.S. Pat. No. 6,103,964 Kay (2000)
U.S. Pat. No. 6,087,578 Kay (2000)
U.S. Pat. No. 5,962,802 Iizuka (1999)
U.S. Pat. No. 5,760,326 Ishibachi (1998)
U.S. Pat. No. 5,283,388 Shimada (1994)

A body of work encompasses pitch correction in the context of synthesized tone generation. These inventions do not address the pitch problems inherent in stringed musical instruments. These inventions do not embody the novelty, scope or key concepts of the present invention:

U.S. Pat. No. 5,763,800 Rossum (1998)
U.S. Pat. No. 5,641,931 Ogai, et al. (1997)

A body of work encompasses pitch detection in the context of tuning devices and tuning aids for stringed instruments. In U.S. Pat. No. 4,196,652 Raskin (1980) describes an embodiment where his tuner device contains an electronic circuit to control a stepper motor to automatically tune a stringed instrument. This embodiment would fall into the category of "electromechanical tuning devices" upon which the present invention improves upon and exceeds in scope. The following tuning device inventions do not embody the novelty, scope or key concepts of the present invention:

U.S. Pat. No. 4,207,791 Murakami (1980)
U.S. Pat. No. 4,196,652 Raskin (1980)
U.S. Pat. No. 4,067,254 Deutsch (1978)
U.S. Pat. No. 3,144,802 Faber, et al. (1964)

A commercial guitar synthesizer product family, which includes the models VG-8 and VG-88 from Roland Corporation of Japan, has a pitch correction and pitch shifting function built in. However there are several crucial limitations to these products when applied to the general problem of pitch management and control:

1. The VG-8/VG-88 devices are not built into the instrument. Instead they are external add-on peripheral systems of substantial size, weight, complexity, and cost.
2. The VG-8/VG-88 devices are designed specifically for guitar use only. They do not operate across a broad range of electric stringed instruments.

3. The VG8/VG-88 devices generally cost more than the guitars that they are intended to be used with. They generally retail in the range of $700 to $900, placing them out of reach of beginners and musicians on a budget.
4. The VG-8/VG-88 device's pitch shifting and pitch correction features are not effective when a direct guitar sound is needed. This is because the VG-8/VG-88 synthesizes sounds using the pitch and performance dynamics of the source instrument, rather than altering the source instrument's own sound for pitch.
5. The VG-8/VG-88 devices do not allow pitch shifting or temperament changes without manual programming and setup procedures.
6. The VG-8/VG-88 devices do not adjust for pitch drift in a continuous manner. The VG-8/VG-88 devices need to be placed into a calibration mode and then and only then are the string pitch correction values updated.
7. The VG-8/VG-88 devices do not provide intonation error compensation.

Japanese patent number 2745215 publication number 09-006351 "ELECTRONIC STRINGED MUSICAL INSTRUMENT", SHINSUKE, Roland Corp. 10-0101997, patent date Oct. 1, 1997, discusses how to pitch shift two sound sources, a synthesizer and a guitar, so that they match. This patent is specific to guitars and does not address the general category of all electric stringed instruments. In this patent, pitch shifting is performed by discrete "pitch shifter" logic, and not with a more economical and flexible solution using a general purpose processor and digital signal processing techniques. The presence of a footpedal control in drawings 2 and 6 of the patent indicates that this system is an accessory device that rests on the floor and thus is an inherently costly solution. While it addresses pitch shifting, it does not describe any ability to perform pitch shifting per string to create hybrid instruments, or to create pitch regions over the fret board. It does not address pitch bending to replace mechanical pitch bending devices on the instrument. It does not address pitch correction, nor does it address intonation compensation. It does not address the needs and requirements of the musical performance where a musician may intentionally change the pitch of the instrument for purposes of detuning the strings, and applying alternate temperaments. This patent does not embody the novelty, scope or the key concepts of the present invention.

A Japanese patent application pending review is application number 2000-220106 publication number 2002-041047 "PITCH SHIFT DEVICE", GOUSUKE, Roland Corp dated Aug. 2, 2002. The described application is specific to a guitar, does not address the broad category of electric stringed instruments. It does describe pitch shifting for altered guitar tunings. It does describe pitch shifting to emulate guitar capo use. It does not address the ability to pitch shift individual strings to create hybrid instruments. It does not address the ability to create pitch regions on the fret board. It is an external device resting on the floor per drawing 4 of the application, intended to be foot operated. This is an inherently costly solution. It does not address pitch bending to replace mechanical pitch bending devices on the instrument. It does not address pitch correction. It does not address intonation compensation. It does not address the needs and requirements of the musical performance where a musician may intentionally change the pitch of the instrument for purposes of detuning the strings, and applying alternate temperaments. This patent application does not embody the novelty, scope or the key concepts of the present invention.

BRIEF SUMMARY OF THE INVENTION

The present invention comprises an electronic data processing system that is integrated with an electric stringed musical instrument. The system automatically and continuously detects and corrects unintentional pitch drift, and applies intentional pitch alterations without reliance on manual or electromechanical changes to string tension. The system monitors each string separately and applies a pitch-alteration to the instrument's electronic signals using digital signal processing methods based on pitch parameters stored in a memory table. The result is a pitch altered signal output from the instrument.

OBJECTS AND ADVANTAGES

There are many advantages to using the Pitch Processing System in an electric stringed instrument:

1. Stringed instruments can be made self-tuning without resorting to electromechanical tuning actuators. The instrument will always sound in tune regardless of string tension. Pitch drift is eliminated. Sloppy tuning by the musician can be automatically corrected. This greatly enhances the ease-of-use when applied to conventional instruments, and especially helps novice or impatient musicians.

2. The Pitch Processing System is inherently more reliable, consumes less power, and is less costly to manufacture and maintain than instruments using electromechanical tuning systems.

3. Altered tunings and temperaments can be preprogrammed into the Pitch Processing System and applied to the performance. With the press of a button, alternative instruments tunings and temperaments can be applied instantaneously by the musician. For example, by shifting the pitch of a guitar's strings down by a fourth interval, the guitar now produces the pitch range of a baritone guitar. Thus, the Pitch Processing System allows a single instrument to quickly "morph" into a different type of instrument. Changing a guitar to use Well Temperament rather than Equal temperament is as easy as pressing a button.

4. The Pitch Processing System allows guitars, basses, banjos and any other stringed instrument using a fret board, to have multiple independent pitch regions allocated to the fret board. This provides unique hybrid instrument variations. Refer to the guitar illustrated in FIG. 2. If notes in the fret board region from 200 to 204 were pitch shifted down by an interval of a fourth, the notes played in those positions would be in the pitch range of a baritone guitar. Notes in fret positions 205 to 222 could be tuned conventionally. This provides simultaneous access to notes from both baritone guitar and conventional guitar ranges simply by changing the playing position on the fret board. Many different permutations of this concept are possible.

5. The Pitch Processing System allows the strings to be individually pitch shifted such that the strings can be configured to produce additional hybrid instrument variations. For example, one variation might include a bass/guitar hybrid combination. In this example, the lower two strings E(6) and A(5) can be pitch shifted down a whole octave, equivalent to the pitch range of the E and A strings of an electric bass. This way, a guitarist can play a bass accompaniment on the lower two strings while playing the upper 4 strings with conventional guitar tuning. Many different permutations of this concept are possible.

6. Performing guitarists and bassists frequently employ multiple instruments each tuned differently with an altered tuning. The ability of the Pitch Processing System to apply multiple instantaneous pitch changes to a single instrument removes the need to purchase and maintain multiple instruments.

7. When applied to guitars and banjos, pitch shifting using the Pitch Processing System eliminates the need to use a capo. The Pitch Processing System allows electronically altered open tunings, providing a "virtual capo" without the pitch irregularities and inconvenience of a capo.

8. Pitch bending accessories such as bridge tremolo/vibrato units, "B-benders", and detuner accessories can be eliminated as these functions can be performed electronically by the Pitch Processing System. The Pitch Processing System can be employed to apply electronic real time pitch shifting, thereby replacing the functions of mechanical pitch bending devices. The dynamic pitch bending effects of a tremolo/vibrato or other pitch bend device can be preserved while eliminating this mechanical source of unintentional pitch drift. An electronic control such as a pitch wheel, joystick, pressure sensor, or similar touch input device can send real time pitch bend information to the Pitch Processing System. This has the added benefit of lowering the cost of the instrument by eliminating the cost of the mechanical pitch bend accessory unit.

9. Produced in volume, a standard, high-volume Pitch Processing System implementation could be used on a multitude of different types of instruments. In high volume, it is expected that this system would add approximately $20 to $50 to the cost of the instrument. However, considering that it fulfills the same purposes of equipment that many musicians purchase separately (electronic tuner, outboard effects devices, extra guitars for alternate tunings, etc.) it could potentially lower a musician's overall equipment cost by several hundred to several thousand dollars.

10. Intonation errors can be automatically corrected by the Pitch Processing System. This reduces or eliminates the mechanical maintenance required to correct intonation problems. The result is a lower cost of ownership and improved customer satisfaction.

11. Strings can be selected with more degrees of freedom. For example, the string gauges typically used on an electric guitar are specified to maintain a target tension range, with the goal of producing the correct musical pitch while keeping the forces on the instrument within reasonable limits. With the Pitch Processing System, since the actual pitch of the strings does not matter, strings can be chosen with dimensions larger or smaller based on the musician's preference or instrument builder's specification to improve comfort, playability, or manufacturability. Lowered string tension also has the beneficial effect of extending the useful life of the strings and reducing string breakage.

12. It is entirely conceivable and practical to apply the Pitch Processing System to new instrument designs in a creative and unconventional way. Designers and engineers can take full advantage of the Pitch Processing System's ability to manage the instrument's pitch profile, as well as provide additional processing functions. Unique instrument designs using unconventional materials and fabrication techniques can be used. For example, it would be possible to construct an instrument out of very lightweight materials, such as balsa wood, cardboard, or inexpensive plastics.

13. When applied to traditionally styled conventional electric stringed instruments such as electric guitars and basses, the Pitch Processing System can be retrofitted into the instrument with minimal impact on the instrument's appearance, aesthetics, weight, balance, or sonic character.

14. Many guitarists prefer certain traditional instruments for their characteristic sound from their conventional magnetic pickups shown as 850 and 852(FIG. 2 and FIG. 8). The Pitch Processing System would allow the characteristic sound to be preserved. The Pitch Processing System can sample the audio signals from the magnetic pickups, store this characteristic sound in memory, and apply this characteristic sound to the processed pitch altered audio.

15. The Pitch Processing System, being an entirely electronic pitch altering solution, can be powered by inexpensive batteries and not suffer the high power liability inherent in electromechanical tuning systems. Also, it is possible to incorporate additional power conservation and power management techniques using power managed semiconductor devices and power management software to further extend battery life.

16. With the potential to reduce or eliminate much of the external equipment a musician may need, the Pitch Processing System will increase overall equipment reliability by minimizing the number of external devices, cable interconnects, and power supplies used by the musician.

17. The Pitch Processing System can provide data processing functions enabling the instrument to transmit and receive non-note information. For example, the instrument can be connected to an external computer to receive memory table updates with pitch information constructed on the external computer. Another example would be to enable the musician to control an external computer from the controls on the instrument by transmitting control information.

18. When applied to electric-acoustic instruments such as electrified acoustic guitars, the Pitch Processing System can be employed to deliver the electronically produced sound for the benefit of recording equipment and sound reinforcement systems which has been very accurately pitch altered.

There are also second-order advantages of using the Pitch Processing System in an electric stringed instrument:

1. The Pitch Processing System is scalable for future enhancements. This will allow more audio processing features and functions to be added in the future via software upgrades and hardware upgrades as they become available. As processor performance improves, new capabilities can be added. Costs of the electronic modules can be lowered by reducing component count as higher integration devices become available. Power consumption will be reduced as semiconductor technologies evolve with lower operating voltages, and smaller device geometries.

2. Sound effects processing (echo, flanging, distortion, tone synthesis, etc.) that is done today using electronic devices external to the instrument can be incorporated into the instrument using the Pitch Processing System.

3. The Pitch Processing System provides a conventional electronic tuner function, with the advantage of being built into the instrument for convenience.

4. The Pitch Processing System can provide a headphone amplifier output function for private listening with headphones.

5. The Pitch Processing System can provide a built-in metronome function for time keeping while listening through headphones for private listening.

Further objects and advantages of the present invention will become apparent from a consideration of the drawings and ensuing description.

DESCRIPTION OF DRAWINGS

FIG. 9 through FIG. 17 are graphical representations of memory lookup tables described in the Specification.

LIST OF REFERENCE NUMERALS

Figure 1:
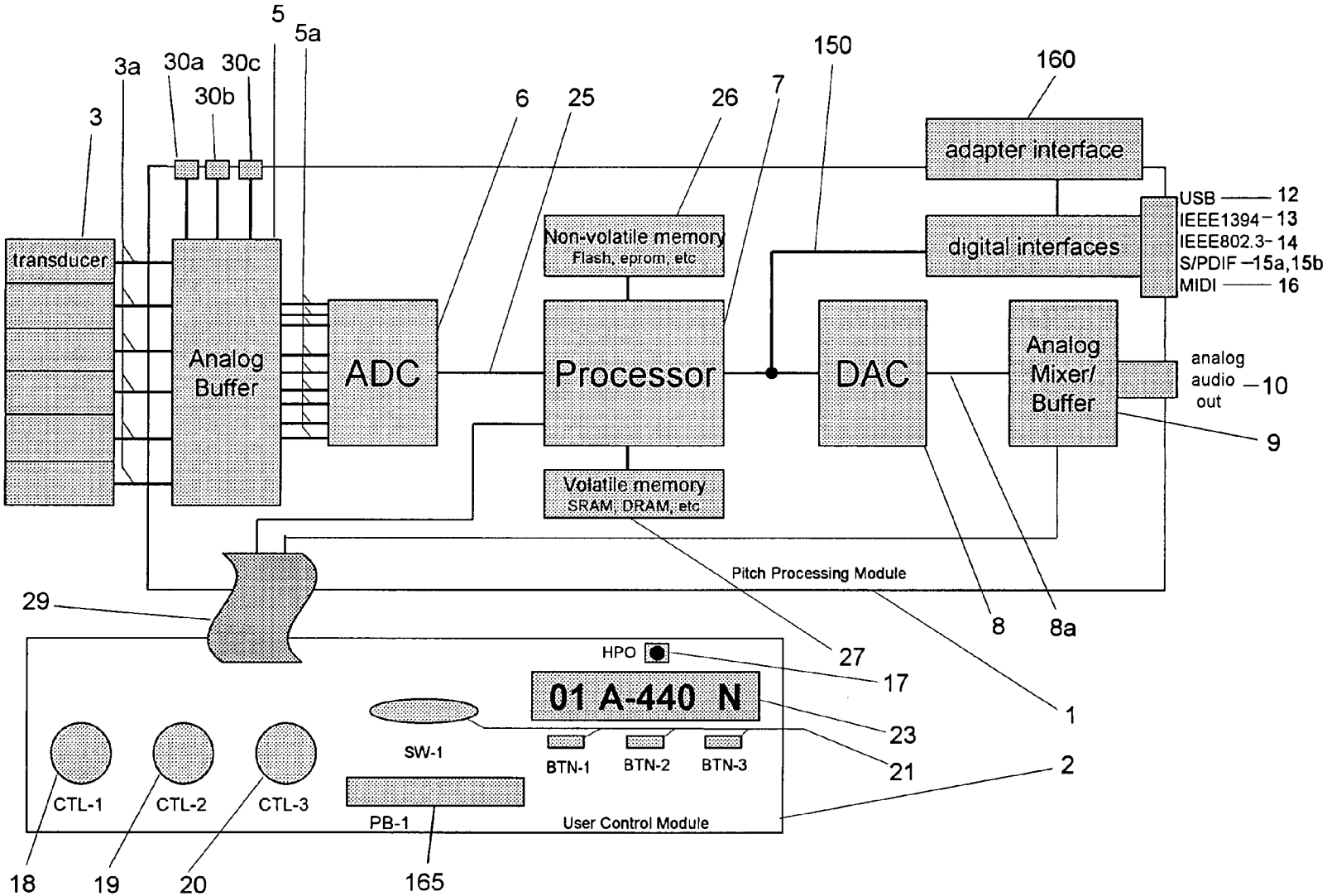
FIG. 1 shows two electronic modules used in the main embodiment of the invention.

| | | | |
|---|---|---|---|
| 1 | Pitch Processing Module | 2 | User Control Module |
| 3 | transducer | 3a | analog signals |
| 5 | analog buffer circuit | 5a | conditioned analog signals |
| 6 | analog to digital converter | 7 | processor |
| 8 | digital to analog converter | 8a | analog signals |
| 9 | analog mixer/buffer circuit | 10 | analog signal connections |
| 10b | ring-tip-sleeve connector | 10c | multiconductor analog connector |
| 12 | USB interface | 13 | 1EEE1394 interface |
| 14 | IEEE802.3 interface | 15a | S/PDIF interface |
| 15b | S/PDIF interface | 16 | MIDI interface |
| 17 | headphone output | 18 | user control |
| 19 | user control | 20 | user control |
| 21 | user controls | 22 | strings |
| 23 | display | 24 | mechanical tuners |
| 25 | Multiplexed digital data | 26 | non volatile memory |
| 29 | shielded multiconductor cable | 27 | volatile memory |
| 30b | analog input signal connector | 30a | analog input signal connector |
| 30c | analog input signal connector | 31 | rear access cover |
| 101 | input/output connector area | 150 | pitch altered digital signals |
| 160 | adapter interface | 165 | touch input device |
| 200 | nut | 201 | first fret |
| 204 | fourth fret | 208 | eight fret |
| 205 | fifth fret | 222 | twenty-second fret |
| 212 | twelfth fret | 660 | calibration process |
| 500 | pitch alteration process | 780 | pitch bend process |
| | | 750 | $F_{SHIFT}$ table update process |
| 700 | $F_{MOD}$ table update process | 852 | conventional magnetic pickup |
| 850 | conventional magnetic pickup | 870 | bridge tremolo/vibrato device |
| 860 | capo | 872 | bridge saddles |
| 880 | interconnect cable | 874 | tremolo/vibrato lever |
| 882 | amplifier and speakers | 6600 | intonation calibration process |
| 884 | computer | | |

DESCRIPTION OF INVENTION

This invention is an enhancement to common electric stringed instruments, such as electric guitars, electric basses, electric banjos, electric pedal steel guitars, electric violins, etc. While directly applicable to traditional electric instruments and that is the primary focus of the invention, the concept can be applied to traditional acoustic stringed instruments, such as violins, cellos, pianos, banjos, and acoustic guitars that have been equipped with electronic pickup systems.

This invention solves the unintentional pitch problems caused by pitch drift, and intonation errors. This invention also provides a fast and reliable way to apply intentional pitch alterations of an almost unlimited variety.

This invention equips the instrument with the Pitch Processing System. In the described main embodiment shown in FIG. 1, it includes the Pitch Processing Module 1 comprised of a microprocessor and support electronics, and the User Control Module 2 providing controls and indicators to the musician, and the transducer 3. The User Control Module 2 may be connected to the Pitch Processing Module 1 by means of a shielded, multiconductor cable 29.

The transducer has a plurality of sensors. The transducer may comprise magnetic, optical, or piezoelectric types of sensors.

Each sensor in the transducer system is dedicated to an individual string of the instrument.

The role of the Pitch Processing Module 1 and software in this invention is to:

a) digitally sample, store, filter, and track signals representing the notes as they are played, b) evaluate the fundamental pitch of each note, c) perform a pitch alteration to the notes in real-time in the digital domain using well-known pitch altering techniques, and then d) output the pitch altered signals to one or more signal connections.

The Pitch Processing Module 1 uses digital signal processing techniques. Types of digital signal processing which may be used in the present invention include, but are not limited to, lowpass filters, bandpass filters, highpass filters, multiplexing and demultiplexing, and Fast Fourier Transforms.

The Pitch Processing Module 1 will have been programmed a priori with data in lookup tables in its memory system to determine the correct pitch for notes played, and to apply the appropriate pitch alteration.

There are five components of pitch alteration used by the Pitch Processing System:

a) pitch correction, b) intonation compensation, c) temperament adjustment, d) pitch shift, and e) pitch bend.

Figure 8:
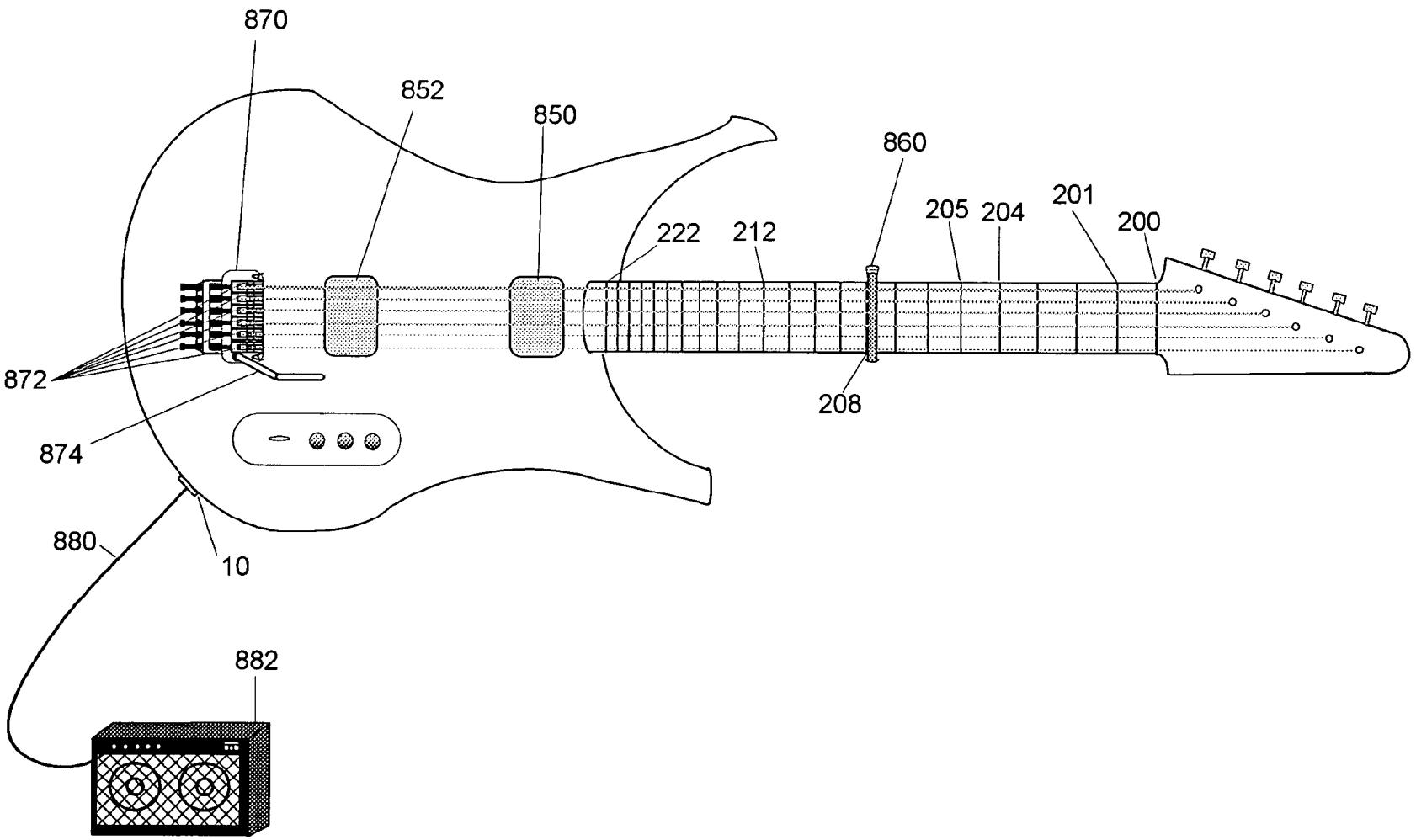
FIG. 8 is an illustration of a conventional guitar, with a bridge tremolo/vibrato unit and capo shown in situ.

Electric instruments generally require external amplification for sound reproduction. Refer to FIG. 8. Typically, the instrument emits an analog signal at connection 10 and connects to an amplifier and speakers 882 using an interconnect cable 880. The Pitch Processing System provides this traditional analog interconnection and also provides for several alternative analog and digital interconnection configurations described as alternative embodiments herein.

Interpreting the Memory Lookup Tables:

FIG. 9 through FIG. 17 illustrate memory lookup tables used in the succeeding discussion of the main embodiment using a six stringed guitar. Each string has a corresponding section of the lookup table which contains pitch alteration factors used to process notes of that string. The nomenclature used herein to address the multidimentional table is TBL[nSTRING][row, column] where TBL is the symbolic reference to the table structure, nSTRING is an integer reference to identify one of 6 strings, and [row,column] represent integer values to index the rows and columns of the table for a particular string. Table indexing used herein is zero-based, consistent with C and C++ programming language conventions.

Refer to FIG. 9. To lookup the D(4) string's $F_C$ value, we would use the nomenclature TBL[3][0,1] which identifies the fourth string in TBL, row zero, column one. The value in the table is −0.01000.

The first two columns labeled "Note name*" and "Fret position*" do not represent values in memory, but are shown in the illustrations as cross reference aids and to ease readability of the tables.

The column labeled "$F_R$" contains the reference fundamental pitch in units of Hz (Hertz) of each note on the string.

The table in FIG. 9 indicates that our instrument has five of six strings flat because the correction factors $F_C$ for five strings are numbers greater than zero. How $F_C$ is calculated will be explained momentarily.

As indicated by the table:

a) for the E(6) string, the $F_C$ value at TBL[5][0,1] is 0.02000 indicating the string is flat by two percent,
b) for the A(5) string, the $F_C$ value at TBL[4][0,1] is 0.02400 indicating the string is flat by 2.4 percent,
c) for the D(4) string, the $F_C$ value at TBL[3][0,1] is −0.01000 indicating the string is 1 percent sharp,
d) for the G(3) string, the $F_C$ value at TBL[2][0,1] is 0.00340 indicating the string is 0.34 percent flat,
e) for the B(2) string, the $F_C$ value at TBL[1][0,1] is 0.0076 indicating the string is 0.76 percent flat,
f) for the E(1) string, the $F_C$ value at TBL[0][0,1] is 0.00539 indicating the string is 0.539 percent flat.

In FIG. 9, the $F_{MOD}$ and $F_{SHIFT}$ parameter columns are programmed to zero indicating no adjustment is required.

The pitch altering lookup tables, which may reside in memory integral with the processor 7(FIG. 1), or which may reside off-chip in non-volatile or volatile memories 26 and 27, may be initialized several ways:

a) by calibration and loading processes to be described,
b) by a factory programming procedure,
c) by copying preloaded configuration tables in memory, and
d) by subsequent user reprogramming.

Operation of Invention—Main Embodiment

Figure 2:
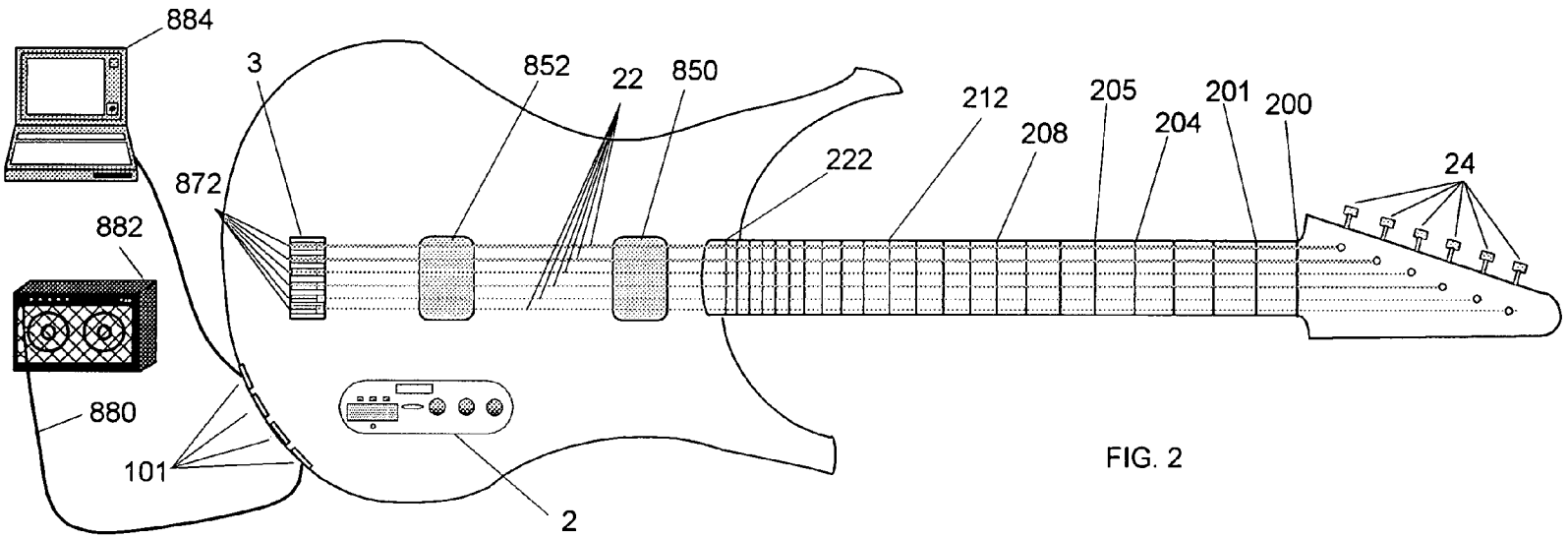
FIG. 2 shows a front elevation of the main embodiment of the invention applied to an electric guitar.
Figure 3:
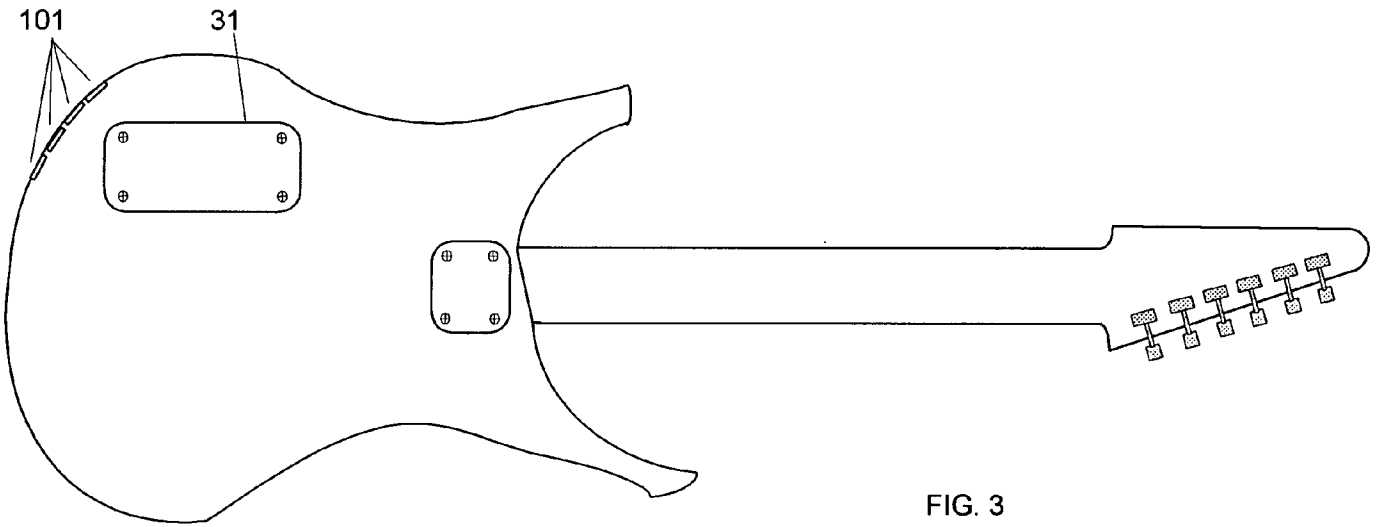
FIG. 3 shows a rear elevation of the main embodiment of the invention applied to an electric guitar.

FIG. 1 illustrates the main embodiment of the Pitch Processing System. FIG. 2 and FIG. 3 illustrate the main embodiment of the Pitch Processing System integrated into an electric guitar. The Pitch Processing Module 1 (FIG. 1) can be housed in the instrument under access cover 31 (FIG. 3). The User Control Module 2(FIG. 1) can be mounted appropriately for access from the front of the instrument shown as 2(FIG. 2) allowing the user to interact with the User Controls 18–21 and 165 (FIG. 1), and display 23(FIG. 1).

The transducer 3(FIG. 1, FIG. 2) detects string vibration from the strings 22(FIG. 2). The transducer has a plurality of sensors, one per string. The transducer in this embodiment is of a piezoelectric type and is integrated into the bridge of the instrument. Each bridge saddle 872 contains a separate piezoelectric element. There are six individual piezoelectric elements in the transducer shown. This type of bridge transducer is available from several companies including:

| | |
|---|---|
| Fishman Transducers, Inc.<br>340-D Fordham Road<br>Wilmington, MA 01887<br>Phone: (978)988-9199<br>Powerbridge ™ pickup models | L. R. Baggs<br>483 N. Frontage Rd.<br>Nipomo, CA 93444<br>Phone: (805)929-3545<br>X-Bridge bridge pickup models |

Refer again to FIG. 1. The transducer 3 emits analog signals 3*a* which are buffered and conditioned by the analog buffer circuit 5. The conditioned analog signals 5*a* are sent to the analog to digital converter (ADC) 6. The ADC 6 samples the conditioned analog signals 5*a* and converts them into digital data and transmits this result as multiplexed digital data 25 to the processor 7. The processor 7 can be implemented using a common off-the-shelf Digital Signal Processor or other suitable microprocessor type. Suitable examples are the TMS320C6000 family of Digital Signal Processors manufactured by Texas Instruments, Inc.

The processor 7 operates by analyzing the multiplexed digital data 25 in a manner such that the plurality of input signal information is acted upon incrementally and in parallel in software.

The Pitch Altering Procedure:

Process 500(FIG. 5) will start when an event occurs signaling that a new signal sample has been received from multiplexed digital data 25(FIG. 1) and has been demultiplexed and buffered in memory. At 502, the sample is analyzed by the software using well known pitch detection techniques to determine the fundamental pitch of the note being processed and assigning that value to the variable $F_{RT}$. At 504(FIG. 5) we know what string is being processing by an identifier extracted from the multiplexed digital data 25. This identifier is assigned to a variable nSTRING. In this embodiment using a guitar, nSTRING holds a value from 5 to 0 corresponding to strings E(6) to E(1) respectively. The variable $F_C$ is assigned the value from the memory table in FIG. 9 for fret position zero at TBL[nSTRING][0,1]. $F_C$ always represents the most recently calculated pitch correction factor. Assume that nSTRING holds the value 5 for the following discussion, corresponding to the E(6) string.

$F_C$ represents a pitch deviation from the open unfretted ideal pitch value $F_R$. If the value of $F_C$ is greater than the value zero, then the open unfretted note is flat, or lower than desired. If the value of $F_C$ is less than zero, the open unfretted note is sharp or higher than desired.

At 504(FIG. 5), the value of $F_R$ is retrieved from the memory table FIG. 9 location TBL[5][0,0]. $F_{RT}$ is adjusted by the most recent pitch correction factor, $F_C$, and assigned to the temporary variable $F_1$. Variables nFRET and $F_{ALT}$ are initialized to zero. Variable nFRET will be used to identify one of n note positions. For instruments with frets, this corresponds to the fret number at the note position.

Variable $F_{ALT}$ will be used to accumulate a series of pitch alteration factors: pitch correction $F_C$, real time pitch bend $F_{DTREM}$, temperament and intonation adjustment $F_{MOD}$, and pitch shift $F_{SHIFT}$. $F_C$, $F_{MOD}$, and $F_{SHIFT}$ are derived from values stored in the memory table and a unique value of each can be defined for every note of the instrument. The $F_{DTREM}$ value, in this embodiment, is a variable calculated in 788 (FIG. 7) based on a value derived from a touch input device such as a pressure transducer, touchpad, pitch wheel, or a joystick device.

At 506(FIG. 5), assuming Equal Tempered tuning, if the value of $F_1$ is in the range +/−2.9 percent of the $F_R$ value, the string has been sounded open unfretted. In this case, Active Calibration 550 can occur to update the pitch correction parameter variable $F_C$ at 512 and to store this new value in the memory table. The value +/−2.9 percent is used at 506 because Equal Tempered tuning provides approximately 5.95 percent pitch changes between successively higher notes. Half of 5.95 is 2.975, and we round this value down to 2.9 to provide a bit of guard band for convenience.

The decision at 510 allows an update to occur to the pitch correction value $F_C$ for this string, or the update can be disabled to accommodate an alternative embodiment.

If $F_C$ updating is enabled at 510, step 512 calculates a new $F_C$ value based on the current open string pitch $F_{RT}$ where $F_C=(F_R-F_{RT})/F_{RT}$, and stores $F_C$ in the memory table FIG. 9 at location TBL[5][0,1] to be used to compare future iterations through process 500.

If it is determined that this was not an open unfretted note at step 506, a reverse lookup content search at 513*a* is performed on TBL[5] in FIG. 9 to find the FR value nearest the value of $F_1$, and to use the resulting row index of the table to find this note's associated pitch factors. The row index is equivalent to the fret position or note number played.

A variety of methods could be used to perform the reverse lookup at step 513*a*. Since the TBL[5] array is small, limited by the number of frets on the instrument (guitars typically have 21 or 22 frets) a simple divide and conquer approach can be used for this discussion. In the reverse lookup, the value $F_1$ calculated in 504(FIG. 5) can first be compared to the $F_R$ value at the approximate midpoint of the table at TBL[5][11,0], to determine which half of the table to continue the lookup. If the value $F_1$ is closest to a value in the first half of TBL[5], a search is performed on $F_R$ entries from TBL[5][11,0] through TBL[5][0,0] until the closest match is found. If the value $F_1$ is closer to values in the second half of the TBL[5], a search is performed on $F_R$ entries at TBL[5][21,0] through TBL[5][12,0] until the closest match to $F_1$ is found.

When the closest match is determined, the resulting row index used in the search is equal to the row number of the table, and is equivalent to the fret number corresponding to the position of the note played. At step 513*b*, the nFRET variable is assigned the value of the row index returned from the search in 513*a*. Assume the value of nFRET is decimal 10 for this discussion. Also in 513*b*, variables $F_{MOD}$ and $F_{SHIFT}$ are assigned values of zero for this note from the table locations TBL[5][10,2] and TBL[5][10,3] respectively.

If so enabled at step 516, the pitch correction value $1+F_C$ is assigned to variable $F_{ALT}$ in step 518. If enabled at step 520, $F_{ALT}$ is multiplied by the pitch bend value $1+F_{DTREM}$ in step 521, and saved in $F_{ALT}$. If enabled at step 522 $F_{ALT}$ is multiplied by the temperament or intonation adjustment value $1+F_{MOD}$ at step 526 and saved in $F_{ALT}$. Lastly, if enabled at 528, $F_{ALT}$ is multiplied by the pitch shift value $1+F_{SHIFT}$ at 532 and saved in $F_{ALT}$.

A sanity check step is applied at step 533 to check whether the value of the cumulative pitch alteration factor $F_{ALT}$ is of sufficient magnitude to process a pitch alteration. If $F_{ALT}$ is within range of an implementation defined threshold, no processor resources need to be expended to perform a pitch alteration for this sample.

Step 534 initiates the computation to pitch alter the digital signal from the current string using the cumulative pitch alteration factor $F_{ALT}$. In this process, $F_{ALT}$ has been calculated from four pitch alteration factors as:

$$F_{ALT}=(1+F_C)*(1+F_{DTREM})*(1+F_{MOD})*(1+F_{SHIFT})$$

Using well known digital pitch altering algorithms, the digital signal buffered in memory is resampled, and adjusted for pitch using the value of $F_{ALT}$. The target pitch required is expressed as $F_{RT}*F_{ALT}$. If the resulting value of $F_{ALT}$ is greater than 1.00, then the pitch will be increased. If the resulting value of $F_{ALT}$ is less than 1.00, then the pitch will be decreased.

At step 536, statistics regarding the pitch drift of the instrument can be generated and stored in memory for later analysis. Also, an indication can be sent to the display 23(FIG. 1) to inform the user of the extent of pitch drift, which allows the user to decide if a manual calibration is in order. The manual calibration process will be discussed in detail in the next section.

After pitch altering is performed in process 500(FIG. 5), the pitch altered digital signal is multiplexed along with other active pitch altered digital signals. This results in pitch altered digital signals 150(FIG. 1), which are then transmitted to a digital-to-analog converter (DAC) 8 where they are converted to a plurality of analog signals 8*a*. The analog signals are then mixed, conditioned, and amplified by the analog mixer/buffer circuit 9 and presented to one or more analog signal connections 10 and presented to the headphone output 17 located on the User Control Module 2. A traditional amplifier and speakers 882(FIG. 2) can be attached to connector 10 with interconnect cable 880.

Figure 5:
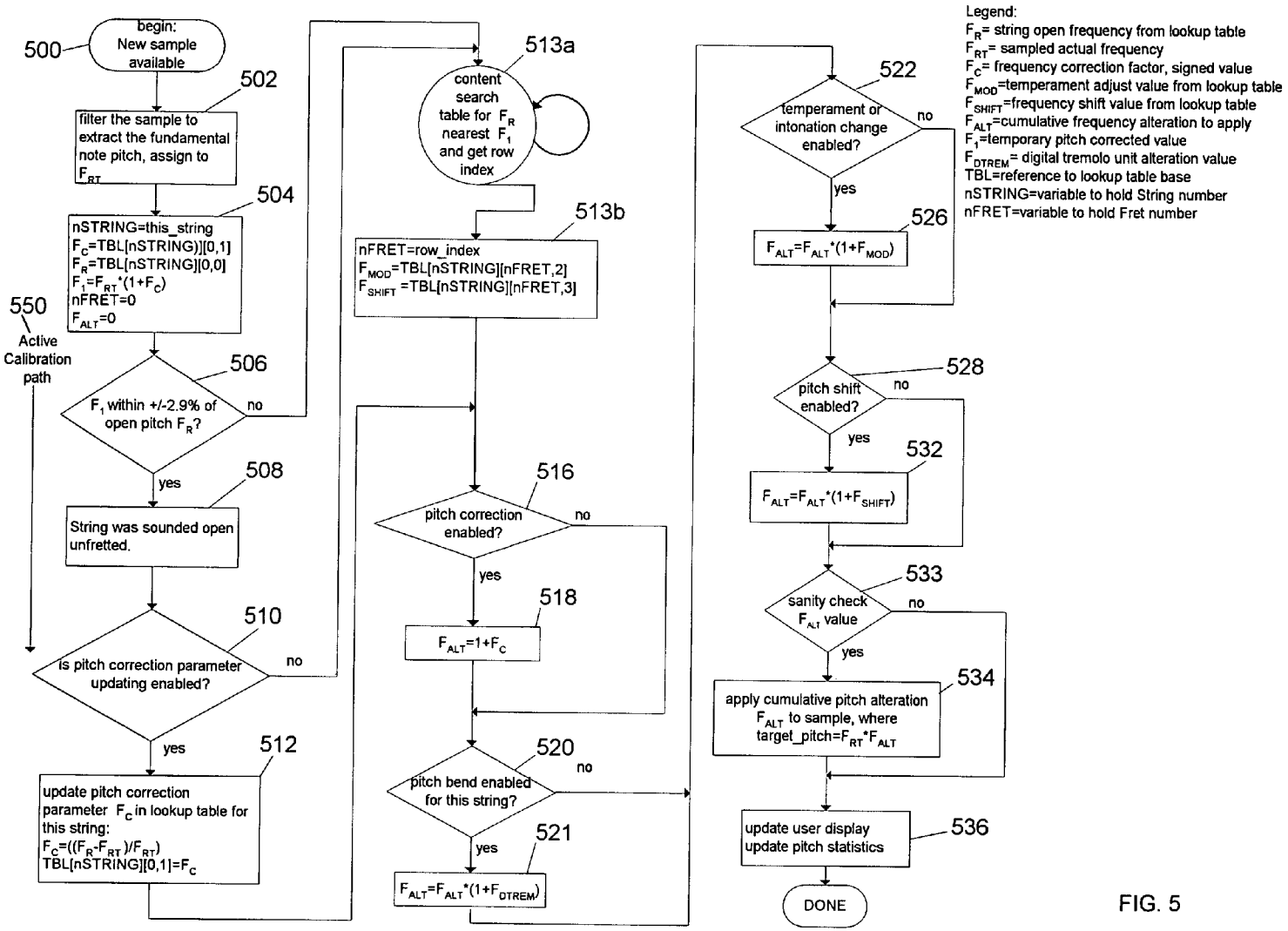
FIG. 5 shows a program flow chart of a software function described in the main embodiment.

Active Calibration is accomplished using the logic path 550(FIG. 5). Every time an open unfretted note is detected, the pitch correction factor $F_C$ atomatically is recalculated for the string. In this way, pitch drift is dynamically tracked and corrected over time whenever the string is played open unfretted.

There is flexibility in allocating the pitch correction factors in the memory table FIG. 9. For instance, in this main embodiment, only the fret zero locations of each string TBL[nSTRING][0,0] holds a value for $F_C$. The remaining positions TBL[nSTRING][0,1] through TBL[nSTRING][0, 21] are unused and therefore could be allocated to hold other useful data. For example, we have allocated $F_{MOD}$ to hold values for both temperament and intonation adjustment only because they perform the same function: provide a minor pitch realignment of the note. If we did not want the table's $F_{MOD}$ parameters to be shared for both temperament adjustment and intonation compensation, we could have chosen to allocate the unused $F_C$ locations of the table to either the temperament or intonation parameters. Alternately, shrinking the TBL structure size can save a small amount of memory. The $F_C$ values could be allocated to a separate table using only 6 entries rather than 132 entries in the TBL structure (22 entries times 6 strings=132 entries).

A good reason to grow the size of the TBL structure might be to allocate more entries to statistics such as "the number of times this note was played" which, along with similar statistics from the other note positions, could be used to estimate when it might be time to change strings.

The Calibration Process:

The calibration process 660(FIG. 6) performs two key functions. It provides a traditional instrument tuning procedure, and initializes the pitch correction and reference pitch values in the lookup table FIG. 9. Once this procedure has been performed, it only needs to be repeated infrequently and at a time of the musician's choosing.

Figure 6:
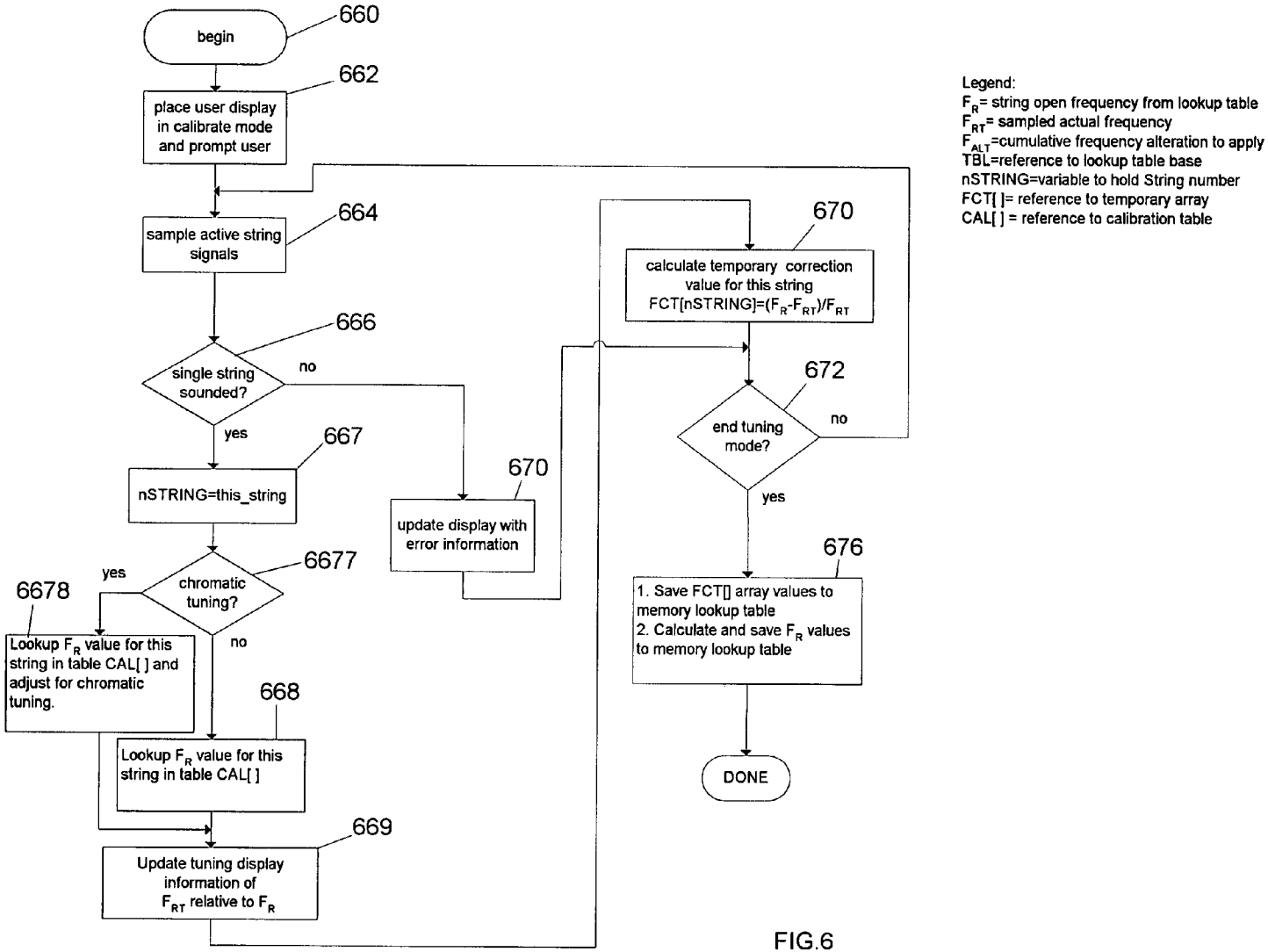
FIG. 6 shows a program flow chart of additional software functions described in the main embodiment.

The processor's software is placed in calibration mode by means of a control 18–21 and 165(FIG. 1) or command which causes the processor to execute routine 660(FIG. 6). At step 662, the display is placed in calibration mode, and prompts are displayed to guide the user. Step 664 will sample the signal from an active string. Step 666 is a filter employed to restrict the calibration process to operate on a single string at a time. While not required, this step is done to avoid electrical crosstalk or interference between strings during the calibration process. This step can also be employed to minimize the amount of information presented to the user at one time. When a single string is sounded, step 667 saves the string identifier in variable nSTRING.

Step 6677 determines which reference pitch to use for this string, depending on whether the user selected a standard or chromatic pitch reference. Using standard guitar pitch (E, A, D, G, B, E), step 668 will lookup a reference standard pitch value from table CAL[ ] shown in FIG. 15*b*, and assign it to variable $F_R$. Alternately, step 6678 will lookup a pitch value for this string in memory table CAL[ ], adjust the value for the specific chromatic pitch selected, and assign it to variable $F_R$.

The musician tunes the instrument using the mechanical tuners 24(FIG. 2) while visual feedback is provided at 669(FIG. 6) updating the display 23(FIG. 1) indicating the deviation of $F_{RT}$ from the target pitch $F_R$ for this string. Using the display indication, the musician then corrects the string pitch to his/her degree of satisfaction, repeating this process for each string. There will likely be some degree of error remaining at the end of the calibration procedure, therefore a pitch correction factor is calculated for this string in step 670 and saved in the array FCT[ ]. The pitch correction factor is calculated as a percentage deviation as $FCT[nSTRING]=(F_R-F_{RT})/F_{RT}$. The resulting array FCT[ ] will hold temporary values of the correction factors, one for each string.

Once the procedure is complete, the musician causes the processor to exit calibration mode by means of a control input or command causing the software to switch out of the calibration process at step 672(FIG. 6). In step 676, the temporary values for the string correction factors in array FCT[ ] are stored in the memory lookup table FIG. 9 for each string. Also, the $F_R$ values for all notes of all strings are calculated based on standard or chromatic calibration values derived from the pitch reference table CAL[ ](FIG. 15*b*) and are stored in the memory lookup table FIG. 9.

Note that the pitch of a string adjusted by the user in process 660(FIG. 6) only needs to be within reasonable range of the target pitch $F_R$. The Pitch Processing System will correct discrepancies when any note is played in 518 (FIG. 5) when returned to normal operation.

Tuning to an altered chromatic pattern, such as detuning a guitar one semitone to Eb from E, requires that the $F_R$ values in the lookup table be programmed to this Eb reference. These values are calculated in 6678(FIG. 6). The result of chromatic detuning to Eb is shown in FIG. 10 where all of the $F_R$ values are shifted lower by a semitone for all six strings as compared to standard pitch shown in FIG. 9.

The $F_R$ values that result from calibration will always reference the absolute pitches the musician has tuned the strings to, regardless of any other pitch alteration factors that may be stored in memory.

When switched to normal operation, the processor will continuously execute process 500(FIG. 5) and perform Active Calibration 550 when an open string is detected during play. This will periodically update the $F_C$ values for the strings. In addition, the musician can perform a deliberate update by playing the strings open unfretted, thereby invoking the Active Calibration 550.

Applying Intonation Compensation and Temperament Adjustments:

Intonation compensation and temperament adjustments are accomplished in an almost identical fashion, so they are described here together. The $F_{MOD}$ value is retrieved from the memory table FIG. 9 at step 513*b*(FIG. 5), and $F_{ALT}$ is multiplied by $1+F_{MOD}$ at step 526. The values of $F_{MOD}$ are loaded into the table using:

a) an intonation calibration procedure, to be described in an alternate embodiment, or
b) a preloaded template located in memory copied into the memory lookup table, or
c) a template received from an external source, or
d) manually by the user manipulating controls on the instrument.

Figure 7:
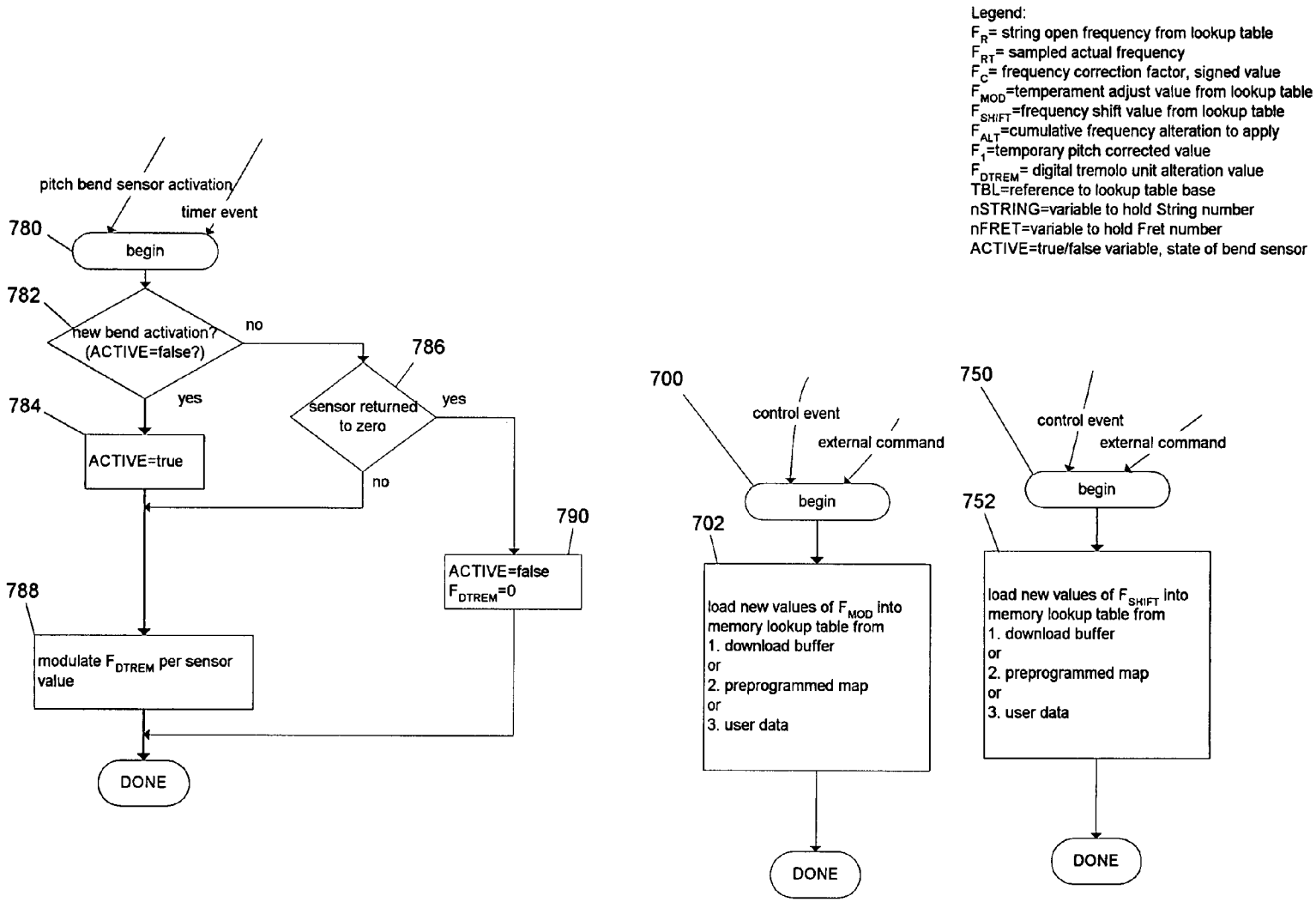
FIG. 7 shows a program flow chart of additional software functions described in the main embodiment.

In FIG. 7, the process 700 can be initiated by several actions; By a command received over one of the digital input/output interfaces 12–16 and 160 (FIG. 1), or by the musician operating the User Module controls 18–21 and 165. Process 700 will apply a buffer of $F_{MOD}$ data values provided from one of these sources or from a preprogrammed configuration table in memory, and program the $F_{MOD}$ values in the memory lookup table. The $F_{MOD}$ values in FIG. 17 shows the result of applying intonation compensation.

FIG. 12 shows what a lookup table might appear like when programmed with a temperament adjustment. FIG. 12 is setup for Feiten Electric Guitar Temperament. A disclaimer is in order. As this is for illustrative purposes only, some liberties were taken to distribute the Feiten temperament values over adjacent notes. The Feiten tables outlined in U.S. Pat. No. 6,359,202 only provide an adjustment value at the open unfretted position and at the twelfth fret. The flexibility of the Pitch Processing System can enable much higher temperament resolution than the Feiten tuning method. The Pitch Processing System can apply a unique temperament value for every note instead of being limited to only two fret positions.

Applying Pitch Shifting:

Pitch Shifting is accomplished by retrieving the $F_{SHIFT}$ value from the memory table in step 513*b*(FIG. 5), and multiplying $F_{ALT}$ by $1+F_{SHIFT}$ at step 532. The values of $F_{SHIFT}$ are loaded into the memory table using:

a) a preloaded pitch shift map located in memory copied into the lookup table or
b) a pitch shift map received from an external source or
c) manually by the user manipulating input controls on the instrument.

The process 750(FIG. 7) can be initiated by several actions: by a command received over one of the digital input/output interfaces 12–16 and 160 (FIG. 1), or by the musician operating the User Module controls 18–21 and 165. Process 750 will apply a buffer of $F_{SHIFT}$ data values provided from one of these sources and program the $F_{SHIFT}$ values in the memory lookup table.

Interesting and advantageous altered pitch configurations can be easily applied to the instrument by applying a pitch shift map to alter the memory lookup table. The following examples will show some of the more useful variations.

A "Virtual Capo" example is shown in FIG. 16. Using the value 0.58741 from the table in FIG. 15*a* for shifting 8 semitones up, and assigning to the $F_{SHIFT}$ values in the table in FIG. 16, all notes of all strings will be shifted up in pitch by eight semitones. Here we have created a pitch table to get the same result as if a capo were used on a conventional instrument and placed just behind the eighth fret as the capo positioned as shown in 860(FIG. 8).

A baritone guitar example is shown in the table of FIG. 11. The $F_{SHIFT}$ values are set to −0.25085 which is the value taken from table FIG. 15*a* to lower the pitch by five semitones. Here we have created a pitch table to lower the pitch of the entire guitar by five semitones resulting in the same pitch as a baritone guitar.

A hybrid example is shown in the table of FIG. 13. The $F_{SHIFT}$ values are set to −0.25085 as taken from table FIG.

15*a*, to lower the pitch by five semitones at fret positions 0 through 4. Fret positions 5 through 21 have $F_{SHIFT}$ values unchanged. Here we have created a pitch table using pitch regions that results in a baritone guitar pitch on the lower part of the fret board, and normal guitar pitch from fret position 5 and higher.

Another hybrid example is shown in the table of FIG. 14. The $F_{SHIFT}$ values for the lower two guitar strings are set to −0.5, which from table FIG. 15*a* pitch shifts down twelve semitones, or an octave. Here we have created a pitch map that allows the lower two strings to be played in the range of a bass while the upper four strings are played in the range of a conventional guitar.

Applying Pitch Bending:

Pitch bending is accomplished by multiplying $F_{ALT}$ by the value $1+F_{DTREM}$ at step 521(FIG. 5). When $F_{DTREM}$ is a value greater or less than zero, a pitch bend is indicated. When the value of $F_{DTREM}$ is zero, no further pitch bend is required. The value of $F_{DTREM}$ is determined as follows.

Pitch bending is accomplished when a pitch bend sensor device responding to touch input is activated. The touch input device shown as 165(FIG. 1) signals the processor when activated. Alternately, the processor may periodically poll the device to detect when it has been activated. Any practical sensor type may be used. The sensor may respond with an indication of finger pressure, or may provide coordinates to identify finger position. The process 780(FIG. 7) begins when the input sensor device is activated. It may also be periodically triggered by a timer event. Step 782 determines if this is a new sensor event or if there is a sensor event in progress by testing the Boolean variable ACTIVE. If this variable is false, then this is a new sensor activation, and step 784 will set the ACTIVE variable to true to indicate a sensor event is now in progress. If the variable is true, then this is a continuation of an in progress sensor event.

In step 788, the value of the pitch bend variable $F_{DTREM}$ is changed based on the sensor type and its current value, and then the process terminates.

If ACTIVE is true, step 786 then determines if the sensor is no longer in use. If the sensor is no longer in use, step 790 will change the ACTIVE variable to false indicating that there is no sensor event in progress, resets the $F_{DTREM}$ variable to zero, and then the process terminates.

Tracking Fingered Pitch Dynamics:

When a musician is using pitch altering techniques such as string bends, vibrato, or other pitch dynamics using fingered techniques, the process 500(FIG. 5) continues to track the note pitch in real time and adjusts the output signal accordingly at 534(FIG. 5). Since it is impossible to bend or fret an open string, the Active Calibration 550 is logically blocked when the bend or fingered vibrato is applied such that the correction factor $F_c$ cannot be changed inadvertently at 512.

DESCRIPTION OF ALTERNATIVE EMBODIMENTS

Description of Alternative Embodiment 1:

In an alternative embodiment applied to conventional electric stringed instruments such as electric guitars and basses, the sound from the existing magnetic pickups can be preserved. Many guitarists prefer certain instruments models and brands for the characteristic sound of their magnetic pickups.

Traditional magnetic pickups are shown as 850 and 852 (FIG. 2). The magnetic pickup's signals can be sampled by the Pitch Processing System by interfacing them to the Pitch Processing Module 1 (FIG. 1) at one or more connections 30*a*, 30*b*, and 30*c*. The audio signals from each of the magnetic pickups are sampled in the digital domain and stored as "alternate voices" in the memory integral to the processor 7 or in external memory 26 or 27. These alternate voices are merged and mixed with the pitch altered digital signals by the processor.

Alternative Embodiment 2:

In an alternative embodiment, a control can be employed to allow the musician to enable or disable Active Calibration.

A control 18–21 and 165(FIG. 1) can be employed to allow the musician to disable Active Calibration. The software step at 510(FIG. 5) allows this condition to lock out the pitch correction update.

Alternative Embodiment 3:

In an alternative embodiment, additional digital audio processing can be performed by the Pitch Processing System. Examples of this type of digital audio processing are applying effects such as equalization, echo, flanging, and distortion. The processor and software, possibly in combination with option card hardware and software available over the adapter interface 160(FIG. 1), can perform additional processing of the pitch altered digital signals to apply these digital audio effects.

Alternative Embodiments 4 through 11:

Pitch altered instrument signal outputs can be presented to a variety of external interface types in several alternative embodiments of the invention. The following sections describe the embodiments as applied to the electric guitar. The input/output connector area of the guitar is typically located on the instrument edge shown as 101(FIG. 2, FIG. 3), and shown in detail as 10–16 and 160 in FIG. 4.

Alternative Embodiment 4:

In this embodiment, the pitch altered digital signals are summed together in a digital mixing process performed by the processor 7(FIG. 1) to provide a summed pitch altered digital signal. The processor then emits the summed digital signal as one of the group of pitch altered digital signals 150 and is sent to the S/PDIF connector 15*a* in FIG. 4.

Figure 4:
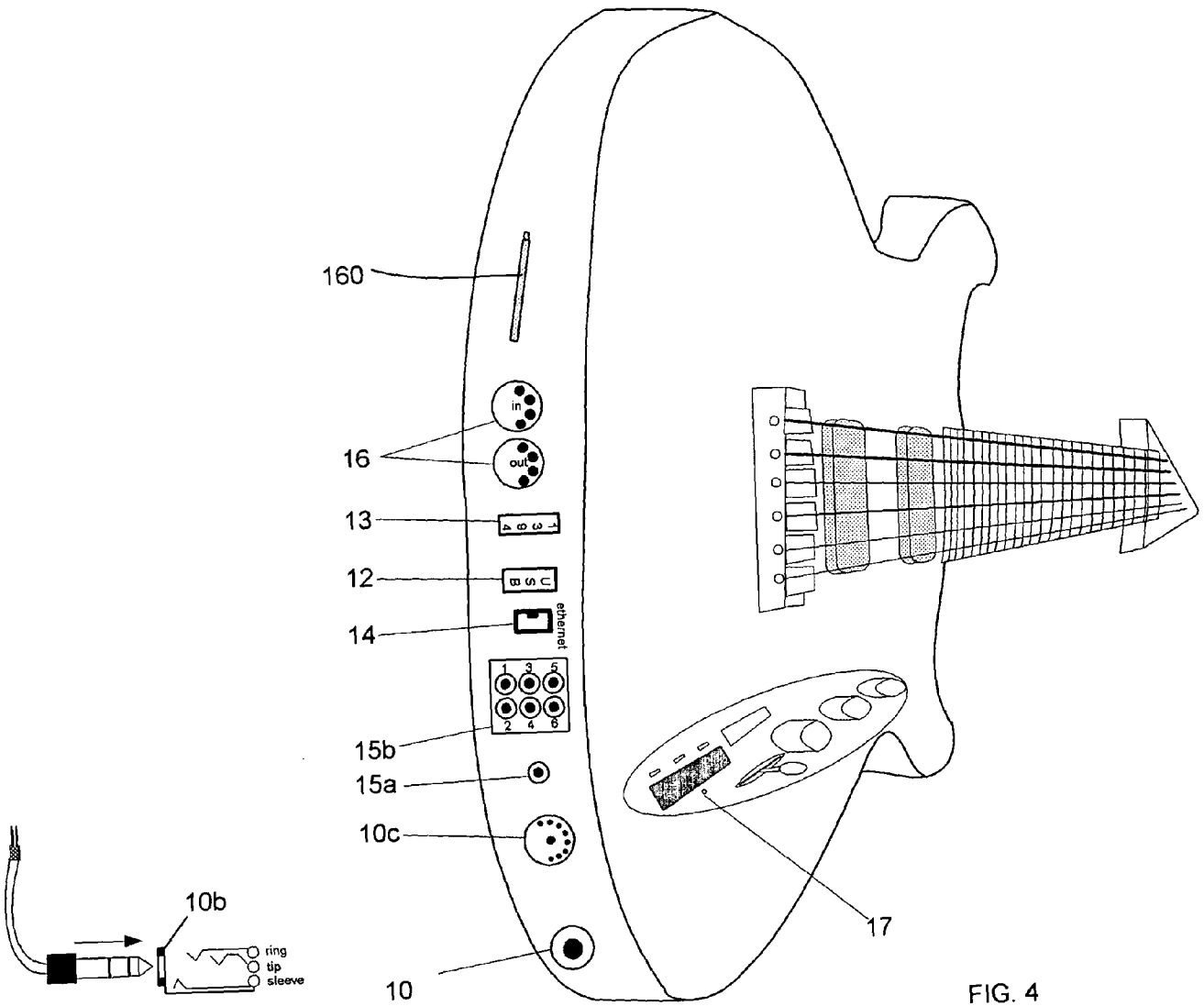
FIG. 4 shows a perspective view of an electric guitar highlighting the input/output connector area used to describe several embodiments of the invention.

Alternative Embodiment 5:

In this embodiment, a plurality of analog signals, one associated with each individual string, is processed and sent to an analog output connector. The processor 7(FIG. 1) sends pitch altered digital signals 150 to a digital to analog converter 8 producing a plurality of analog signals 8*a*. Analog signals 8*a* are conditioned and amplified by the analog mixer/buffer circuit 9 and sent to a multiconductor analog signal connector 10*c*(FIG. 4).

Alternative Embodiment 6:

In this embodiment, two separate analog signal outputs can present left/right stereo signals using a multiconductor ring-tip-sleeve connector and cable of the type shown in 10*b*(FIG. 4) and located at 10.

The signals are processed in a manner that produces a left/right stereo image, for example to produce a stereo chorus effect. The processor then emits digital signals 150 (FIG. 1) which are converted by digital-to-analog converter 8 to a plurality of analog signals 8*a*. Analog signals 8*a* are then mixed, conditioned and amplified by the analog mixer/buffer circuit 9 and sent to a multiconductor analog signal connector of type 10*b*(FIG. 4) and located at position 10. The left analog signal is assigned to one conductor of the connector 10*b*. The right analog signal is assigned to the other conductor of connector 10*b*.

Alternative Embodiment 7:

In this embodiment, DC power input can be supplied to the Pitch Processing System using a multiconductor ring-tip-sleeve connector and cable of the type shown in 10*b* (FIG. 4) and located at 10. The DC power is assigned to one conductor of the connector 10*b*. The analog output signal is assigned to the other conductor of connector 10*b*.

Alternative Embodiment 8:

In another embodiment, the instrument's pitch altered digital signals can be presented in a multichannel format wherein the pitch altered digital signals are separately presented to a plurality of external digital interfaces. One example of such an interface uses the six separate S/PDIF connections as shown as 15*b*(FIG. 4). Each string's pitch corrected digital signal is individually assigned to one of the S/PDIF connectors.

Alternative Embodiment 9:

In another embodiment, the pitch altered digital signals may be multiplexed using a variety of techniques such as encoding, packet or cell multiplexing, or time division multiplexing to transmit the resulting data over an interface connection. This embodiment describes the use of the IEEE802.3 interface 14 (FIG. 4). Each of six pitch altered digital signals is encapsulated in a separate data packet, and packets containing data from all six strings are time-multiplexed and transmitted across the IEEE802.3 interface. At the physical layer, the IEEE802.3 medium provides one transmit channel and one receive channel. The Pitch Processing System transmits six strings worth of data over the transmit channel in a succession of separate data packets to external equipment such as a computer 884(FIG. 2). The external equipment can then receive and decode the packets to reconstruct the pitch altered digital signals in their entirety. In further embodiments of this type, any other type of digital interfaces can be used such as Universal Serial Bus (USB) 12(FIG. 4), IEEE1394 13, MIDI 16 and the Adapter Interface 160.

Alternative Embodiment 10:

The pitch altered digital signals 150(FIG. 1) may be transmitted such that notes from different strings are encapsulated or addressed in cells or packets in a manner such that they can be routed to different destinations. For example, using the bass/guitar hybrid configuration in FIG. 14, the data for the two lower strings E(6) and A(5) are encapsulated in IEEE802.3 packets with the same destination address A. The upper 4 strings D(4) through E(1) are encapsulated in packets with the same destination address B. This way, the packets can be sent to different destinations, A and B, which may be two different computers 884 or other types of external equipment.

Alternative Embodiment 11:

In another embodiment, an adapter interface 160(FIG. 1, FIG. 4) is provided on the Pitch Processing Module, which can be used to connect to a variety of option card types. Examples of option card types are PCMCIA, Cardbus, Bluetooth, Sony MemoryStick™, CompactFlash, SDCard, and SmartMedia. Logic to support the option card interface may be integrated on the processor or available as one or more interface components for a particular interface. For example a PCMCIA Host Adapter similar to model CL-PD6730 from Cirrus Logic, Inc. may be employed to provide a standard hardware interface to a wide range of available PCMCIA option cards.

Alternative Embodiment 12:

This embodiment describes the use of data processing and transmitting data. Data gathered from the instrument may accompany the pitch altered digital signals. Bidirectional digital interfaces such as USB 12(FIG. 1), IEEE1394 13, IEEE802.3 14, S/PDIF 15*a* 15*b*, and MIDI 16 can be employed. Useful data generated by the instrument is transmitted externally over these digital interfaces. Examples of useful information are statistical data, time-code data, clock data, status data or command data from controls. For example, the positions of controls 18–21 and 165(FIG. 1) can be used to issue commands to control an external device such as a computer 884(FIG. 2). In another example, a recording of a musical performance stored in memory can be played back by transmitting the play back data to an external computer 884.

Alternative Embodiment 13:

This alternative embodiment describes the use of data processing and receiving data. External devices can send information to the instrument to be received by the Pitch Processing System to be acted upon in useful ways.

An external device can be connected to the instrument using one or more of the bidirectional digital interfaces shown as 12–16 and 160 (FIG. 1 and FIG. 4). The external device, such as a computer 884(FIG. 2), can transmit programming information to the instrument to update the Pitch Processing System's memory table and software object code, and send messages to the display 23(FIG. 1) or to other visual indicators which may be present.

Alternative Embodiment 14:

It should be clear to those familiar with the art to understand that the invention has many potential mechanical configurations. The partitioning of the electronic components based on the instrument's design may warrant different module configurations from those described in the main embodiment.

The display 23(FIG. 1) are placed on a separate module and placed in some other location on the instrument. Additional controls of the type 18–21 and 165 are mounted on another module and located elsewhere on the instrument.

Alternate Embodiment 15:

This embodiment describes how intonation calibration can be used on a guitar or bass to program the memory table $F_{MOD}$ values to correct for intonation error.

Figure 6A:
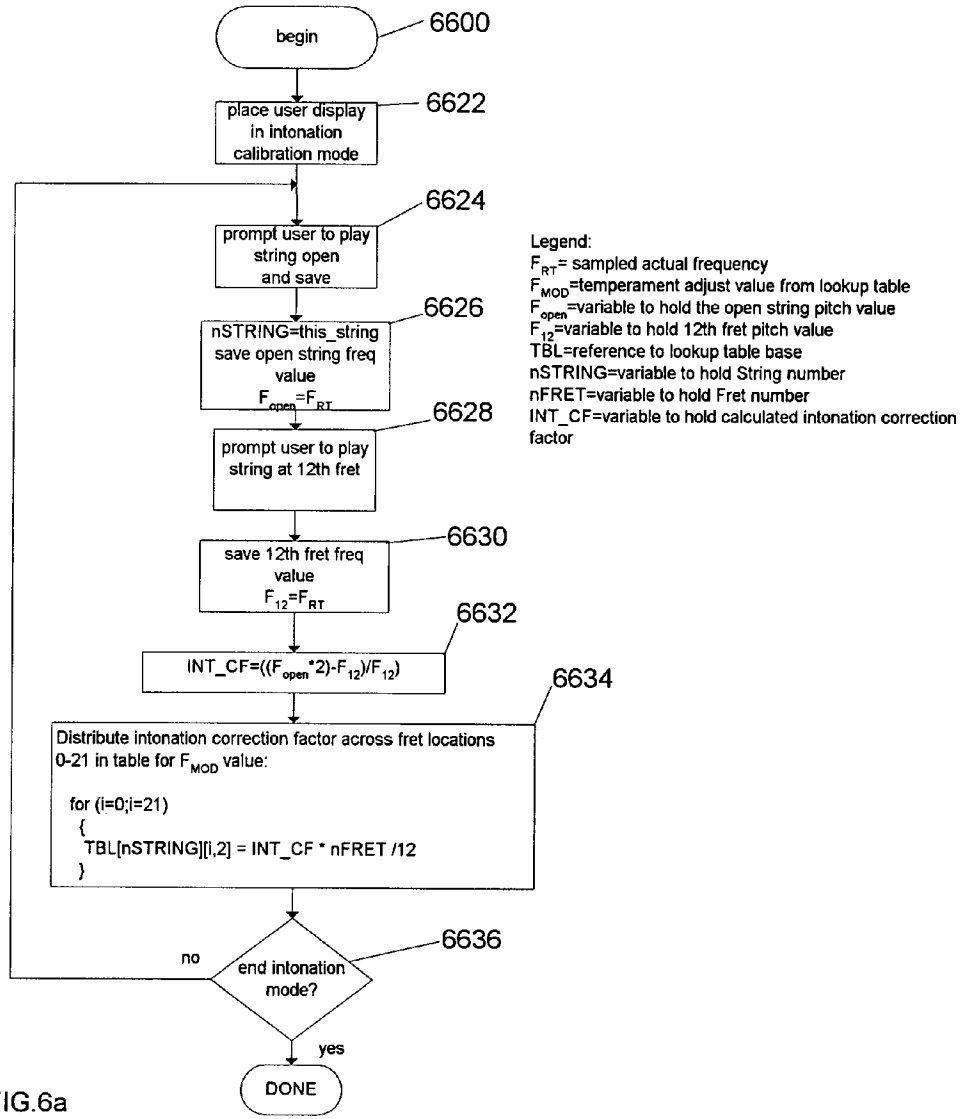
FIG. 6*a* shows a program flow chart of a software function described in an additional embodiment.

An intonation calibration process 6600 is shown in FIG. 6*a*. The user activates a control 18–21 and 165 (FIG. 1) to enable this process. The display 23 is placed in intonation calibration mode in step 6622 and is used to prompt the user to perform the necessary actions. In step 6624, the user is prompted to play a string in the open unfretted position. At step 6626, the identity of the string being played is stored in variable nSTRING, and the pitch of the open string $F_{RT}$ is identified and stored in the temporary variable $F_{open}$. At 6628, the user is prompted to play the same string fretted at the twelfth fret. Step 6630 saves the twelfth fret pitch $F_{RT}$ in temporary variable $F_{12}$.

The difference between the open string pitch $F_{open}$ multiplied by two, and the twelfth fret pitch $F_{12}$, is a measure of the twelfth fret intonation error. This calculation takes place at step 6632, is assigned to variable INT_CF and is expressed as a fraction either less than or greater than zero.

The intonation error for the fret positions 1 through 11 tends to be less than the twelfth fret error INT_CF. The intonation error for fret positions 13 through 21 tends to be greater than the twelfth fret error INT_CF. At step 6634, the twelfth fret error is amortized across all of the fret positions and $F_{MOD}$ values for each fret are calculated and stored in the table at step 6634. In this simple example, the calculation weights a greater error to the higher numbered fret positions.

Other more sophisticated amortization schemes could be employed at step 6634 depending on specific implementation requirements.

The resulting $F_{MOD}$ values are shown in the memory table shown in FIG. 17. Fret position 0 holds zero value indicating no correction is required. Fret position 21 holds the highest degree of correction required. The error correction increases progressively from fret position 1 to its maximum value at fret position 21.

The intonation calibration process is terminated by the user activating a control 18–21 and 165 (FIG. 1) at step 6636, returning the processor to normal operation.

Conclusions, Ramifications, and Scope

The reader will see that the Pitch Processing System eliminates the major sources of pitch drift, and provides a reliable and sophisticated method of applying pitch alterations to electric stringed instruments. The invention manages the instrument pitch electronically without electromechanical devices required to adjust string tension.

A summary of the Pitch Processing System's broad advantages over the prior art:

a) The instrument will always play in tune. The instrument will be self-tuning without resorting to electromechanical tuning actuators. Pitch drift is eliminated. The frequency and rigor of manual tuning can be reduced by relying on the Pitch Processing System. Poor tuning by the musician can be automatically corrected. Instrument ease-of-use is greatly improved, especially for novice or impatient musicians.

b) The Pitch Processing System does not use motors, gears or actuators to control string tension, and is much more flexible, more reliable, less power hungry, and less expensive than electromechanical tuning systems.

c) Altered tunings can be easily programmed into the Pitch Processing System and applied to the performance. The Pitch Processing System allows a single instrument to quickly "morph" into different types of instruments. The ability of the Pitch Processing System to apply multiple instantaneous pitch changes to a single instrument removes the need to purchase and maintain multiple instruments.

d) The Pitch Processing System allows stringed instruments using a fret board to have multiple independent pitch regions allocated to the fret board.

e) The Pitch Processing System allows the strings to be individually pitch shifted.

f) Eliminates the need for a capo. Pitch shifting using the Pitch Processing System performs the same function of a capo.

g) Eliminates mechanical pitch benders. Pitch bending accessories such as bridge tremolo/vibrato units, "B-benders, and detuning accessories can be eliminated while performing equivalent pitch bending functions electronically. This has the added benefit of lowering the cost of the instrument by eliminating the costs associated with the mechanical pitch bend accessory unit.

h) Lowers overall equipment costs. The Pitch Processing System is a low-cost ($20 to $50 in volume) addition to the instrument, with potentially much greater overall equipment cost savings of hundreds to thousands of dollars to the musician. It can provide equivalent functions of equipment traditionally purchased separately (electronic tuner, outboard effects devices, extra guitars for alternate tunings, etc.).

i) Corrects intonation errors. This reduces or eliminates the labor costs required to adjust intonation. The result is a lower cost of ownership and improved customer satisfaction.

j) Liberates string restrictions. Strings can be selected with more degrees of freedom. Strings can be chosen with dimensions larger or smaller based on the musician's preference or instrument builder's specification to improve comfort, playability, or manufacturability. Lowered string tension also has the beneficial effect of extending the lifetime of the strings and reducing string breakage.

k) Liberates designers and engineers to take full advantage of the Pitch Processing System's ability to manage the instrument's pitch profile to create new, unconventional, and exciting instrument designs.

l) Can be retrofitted into the classic instruments with minimal impact on the appearance, aesthetics, weight, balance, or sonic character.

m) Increases overall equipment reliability by minimizing the number of external devices, cable interconnects, and power supplies used by the musician.

n) Provides data processing functions enabling the instrument to transmit and receive data in addition to transmitting music.

o) Enables the musician to control an external computer from the controls on the instrument.

The scope of the invention should be determined by the appended claims and their legal equivalents, rather than by the many examples discussed in the specification.

I claim:

1. A method for regularly updating a plurality of pitch correction factors for a stringed musical instrument employing a plurality of strings comprising the steps of:

(a) sampling the fundamental pitch value of a sounded note from a string and (b) calculating a temporary value from said fundamental pitch value and adjusting said temporary value with a saved pitch correction factor retrieved from a memory and (c) comparing said temporary value to a predetermined open string pitch value retrieved from said memory and (d) determining if said temporary value is within a predetermined range of said predetermined open string pitch value and (e) calculating a new pitch correction factor if said string was sounded within said predetermined range of said predetermined open string pitch value and (f) saving said new pitch correction factor in said memory and (g) repeating steps (a) through (f) for any additional notes sounded on said strings.

2. An electronic data processing system, integrated with an electric stringed musical instrument comprising:

(a) a transducer with a plurality of sensors used to generate a plurality of electrical signals and (b) an analog buffer circuit and an analog-to-digital converter circuit to create a plurality of digital signals from said electrical signals and (c) volatile and non volatile types of memory used to store said digital signals, software object code, and one or more tables containing pitch alteration factors and (d) a microprocessor to execute said software object code and (e) instructions in said software object code comprising a first frequency or time domain digital signal process to determine, for each note played, the fundamental pitch of said note, then calculating a table index and a table address pointer from the result of a table content search locating a reference pitch in said table in proximity to said fundamental pitch and said table index and said table address pointer used by said microprocessor to retrieve from said table a plurality of pitch alteration factors associated with said note and (f) additional instructions in said software object code comprising a second frequency or time domain digital signal process that calculates an accumulated pitch alteration value for each of said notes played, said accumulated pitch alteration value calculated from said pitch alteration factors, and performs a resampling of said digital signals by the degree of said accumulated pitch alteration value, resulting in the synthesis of a plurality of pitch altered digital signals and (e) digital-to-analog conversion circuits, and a plurality of signal conditioning interface circuits to present said pitch altered digital signals to a plurality of interface connections, and (f) controls consisting of switches, selection knobs, visual indicators such as light emitting diodes and video display panels, and touch input devices responsive to a hand or finger in contact with said touch input device, said controls allow human interaction with said data processing system.

3. The system of claim 2 wherein said pitch alteration factors are comprised of (a) a pitch correction factor stored in said table and (b) a pitch modification factor stored in said table and (c) a pitch shift factor stored in said table and (d) a pitch bend parameter stored in said memory or within said microprocessor.

4. The system of claim 3 further including means to continuously update said pitch correction factor, said means comprising the steps of (a) calculating a temporary value from said fundamental pitch value and adjusting said temporary value with a saved pitch correction factor retrieved from said table and (b) comparing said temporary value to a predetermined open string reference pitch value retrieved from said table and (c) determining if said temporary value is within a predetermined range of said predetermined open string reference pitch value and (d) calculating a new pitch correction factor if said string was sounded within said predetermined range of said predetermined open string reference pitch value and (e) storing said new pitch correction factor in said table and (f) repeating steps (a) through (e) in a continuous manner.

5. The system of claim 3 further employing a table lookup procedure to apply pitch temperament and intonation compensation to said digital signals, said procedure comprising the steps of (a) calculating a pitch modification address pointer to a corresponding location in said table containing said pitch modification value for each of said notes and (b) reading said pitch modification value from said table and (c) adding said pitch modification value to said accumulated pitch alteration value.

6. The system of claim 3 further employing a table lookup procedure to apply a pitch shift to said digital signals, said procedure comprising the steps of (a) calculating a pitch shift address pointer to a corresponding location in said table containing a pitch shift value for each of said notes and (b) reading said pitch shift value from said table and (c) adding said pitch shift value to said accumulated pitch alteration value.

7. The system of claim 3 further employing an additional control sequence to store said pitch shift factors in said table in a manner that partitions an instrument's note positions into independent pitch regions by (a) calculating an address pointer to a plurality of predefined pitch shift factors stored in said memory, said pitch shift factors calculated to distribute said pitch shift values similarly to all of said strings corresponding to a predetermined range of said note positions and (b) using said address pointer to subsequently copy said predefined pitch shift factors to said table.

8. The system of claim 3 further employing an additional control sequence to store said pitch shift factors in said table in a manner that stores pitch shift factors for individual strings by (a) calculating an address pointer to a plurality of predefined pitch shift factors stored in said memory, said pitch shift factors calculated to provide a unique pitch shift factor for each of said strings of said instrument, and (b) using said address pointer to subsequently copy said predefined pitch shift factors to said table.

9. The system of claim 3 further including a calculating process to (a) determine when the musician is interacting with said touch input device and (b) calculating the value of said pitch bend parameter in proportion to touch input device output response, said touch input device output response consisting of a change of one or more of the parameters of voltage, current, frequency, phase, amplitude, pulse width, or alternately consisting of a message containing a numerical value representing said touch input device output response and (c) repeating step (b) until said process determines from said response to said touch input device that the musician has stopped interacting with said touch input device.

10. The system of claim 3 further employing a calculating process to impart additional alteration to said digital signals consisting of a third time or frequency domain digital signal process to impart digital filtering to alter the amplitude and phase relationships of the component frequencies of said digital signals.

11. The system of claim 10 further employing a calculating process to sample the instrument's characteristic sound and to synthesize substitute digital signals by (a) capturing samples of said characteristic sound or characteristic elements from said characteristic sound, and storing said samples in said memory and (b) employing a fourth time or frequency domain digital signal process to synthesize a plurality of substitute digital signals from said samples and said note's fundamental pitch and (c) applying a plurality of accumulated pitch alteration values to said substitute digital signals to generate said pitch altered digital signals.

12. The system of claim 3 further including a communications process which (a) receives software object code and command and control information from one or more of said interface connections and (b) stores said software object code and command and control information to said memory and (c) decodes said command and control information and (d) performs specific actions in response to said command and control information.

13. The system of claim 3 further including a recording process that (a) stores performance data in the form of said digital signals or said pitch altered digital signals or events and commands representing the musical performance to said memory, and (b) transfers said performance data to one or more said interface connections upon the touch of a user control or upon a command or control action received from one or more said interface connections, or automatically when a predetermined amount of said memory has been consumed by said performance data.

14. The system of claim 11 further including a fifth time or frequency domain digital signal process to sum together two or more said pitch altered digital signals resulting in a summed pitch altered digital signal, and transmit said summed pitch altered digital signal to one or more said interface connections.

15. The system of claim 2 further including a data processing means to time multiplex said pitch altered digital signals into data packets and subsequently transmitting said data packets onto said interface connections, said data processing means consists of creating time fragments of individual pitch altered digital signals sampled over a predetermined time interval and storing said time fragments into said data packet, and repeating this process for each occurrence of said predetermined time interval.

16. The system of claim 2 further including means to connect and interact with option cards, said means consisting of (a) digital hardware bridge interface logic designed to provide the electrical signal levels, timing functions, and protocol functions for the option card and (b) software driver object code, stored in said memory or stored in option card memory contained within said option card, said software driver object code containing instructions to be executed by said microprocessor allowing interaction with said digital hardware bridge interface logic to further access said option card.

* * * * *